US012428804B2

(12) United States Patent
Nishi

(10) Patent No.: US 12,428,804 B2
(45) Date of Patent: Sep. 30, 2025

(54) SHOVEL THAT PERFORMS CONTROL TO AVOID CONTACT WITH SURROUNDING OBJECT

(71) Applicant: SUMITOMO CONSTRUCTION MACHINERY CO., LTD., Tokyo (JP)

(72) Inventor: Takashi Nishi, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 913 days.

(21) Appl. No.: 17/030,867

(22) Filed: Sep. 24, 2020

(65) Prior Publication Data

US 2021/0002852 A1 Jan. 7, 2021

Related U.S. Application Data

(63) Continuation of application No. PCT/JP2019/012563, filed on Mar. 25, 2019.

(30) Foreign Application Priority Data

Mar. 26, 2018 (JP) ..... 2018-058914

(51) Int. Cl.

| | |
|---|---|
| ***E02F 3/43*** | (2006.01) |
| ***E02F 9/20*** | (2006.01) |
| ***E02F 9/26*** | (2006.01) |

(52) U.S. Cl.

CPC ..... *E02F 3/434* (2013.01); *E02F 3/439* (2013.01); *E02F 9/2033* (2013.01); *E02F 9/2037* (2013.01); *E02F 9/2041* (2013.01); *E02F 9/2045* (2013.01); *E02F 9/265* (2013.01)

(58) Field of Classification Search

CPC ..... E02F 9/2033; E02F 3/431; E02F 9/2004; E02F 9/265; E02F 9/2037; E02F 3/434; E02F 3/439; E02F 9/26; E02F 9/261; E02F 9/2041; E02F 9/2045; B60R 1/00

See application file for complete search history.

(56) References Cited

U.S. PATENT DOCUMENTS

| | | | | |
|---|---|---|---|---|
| 6,076,030 A * | 6/2000 | Rowe | ..... | G05B 19/19 701/50 |
| 6,169,948 B1 * | 1/2001 | Fujishima | ..... | E02F 9/26 340/684 |
| 6,247,538 B1 | 6/2001 | Takeda et al. | | |
| 6,363,173 B1 | 3/2002 | Stentz et al. | | |

(Continued)

FOREIGN PATENT DOCUMENTS

| | | | | |
|---|---|---|---|---|
| CN | 114521228 A * | 5/2022 | ..... | B65G 67/04 |
| DE | 19858750 A1 * | 6/1999 | ..... | E02F 9/2045 |

(Continued)

OTHER PUBLICATIONS

International Search Report for PCT/JP2019/012563 mailed on Jun. 11, 2019.

*Primary Examiner* — Christopher J Sebesta
*Assistant Examiner* — Blake E Scoville
(74) *Attorney, Agent, or Firm* — IPUSA, PLLC

(57) ABSTRACT

A shovel includes a lower traveling body, an upper turning body turnably mounted on the lower traveling body, a surroundings monitoring device attached to the upper turning body, and a controller configured to identify the state of an object based on the output of the surroundings monitoring device.

16 Claims, 28 Drawing Sheets

(56) References Cited

U.S. PATENT DOCUMENTS

| | | | | |
|---|---|---|---|---|
| 8,768,583 | B2 * | 7/2014 | Hargrave, Jr. | E02F 9/261 340/436 |
| 9,454,147 | B1 | 9/2016 | Friend et al. | |
| 10,072,395 | B2 | 9/2018 | Tsukamoto | |
| 10,506,179 | B2 | 12/2019 | Kowatari et al. | |
| 2013/0261903 | A1 * | 10/2013 | Hargrave, Jr. | E02F 9/2033 701/50 |
| 2014/0257647 | A1 * | 9/2014 | Wu | E02F 9/24 701/50 |
| 2014/0267731 | A1 * | 9/2014 | Izumikawa | B60R 1/23 348/148 |
| 2014/0330490 | A1 * | 11/2014 | Aoki | E02F 9/2079 701/50 |
| 2015/0142276 | A1 | 5/2015 | Wu et al. | |
| 2017/0167109 | A1 * | 6/2017 | Ge | E02F 9/265 |
| 2017/0328031 | A1 * | 11/2017 | Jang | E02F 9/265 |
| 2018/0142441 | A1 * | 5/2018 | Berry | E02F 3/434 |
| 2018/0178342 | A1 * | 6/2018 | Russell | G01C 9/04 |
| 2018/0305902 | A1 | 10/2018 | Tsukamoto | |

FOREIGN PATENT DOCUMENTS

| | | | | |
|---|---|---|---|---|
| JP | 10088625 | A * | 4/1998 | E02F 3/842 |
| JP | H10-088625 | | 4/1998 | |
| JP | 11325880 | A * | 11/1999 | E02F 9/2045 |
| JP | H11-325880 | | 11/1999 | |
| JP | 2015-190159 | | 11/2015 | |
| JP | 2015190159 | A * | 11/2015 | E02F 3/435 |
| JP | 2016-089388 | | 5/2016 | |
| JP | 2018-024997 | | 2/2018 | |
| WO | 2012/161062 | | 11/2012 | |
| WO | 2014/123228 | | 8/2014 | |
| WO | 2017/115809 | | 7/2017 | |
| WO | WO-2017115809 | A1 * | 7/2017 | E02F 3/32 |

* cited by examiner

SHOVEL THAT PERFORMS CONTROL TO AVOID CONTACT WITH SURROUNDING OBJECT

CROSS-REFERENCE TO RELATED APPLICATION

The present application is a continuation of International Application No. PCT/JP2019/012563, filed on Mar. 25, 2019, which claims priority to Japanese Application No. JP2018-058914, filed on Mar. 26, 2018, the entire content of each of which is incorporated herein by reference.

BACKGROUND

Technical Field

The disclosures herein relate to a shovel.

Description of Related Art

A shovel that prevents contact between the attachment and a dump truck when loading excavated soil into the dump truck is known. The shovel generates a trajectory line followed by the end of the bucket, based on the distance between the shovel and the dump truck and the height of the dump truck. The shovel controls the flow rate of hydraulic oil supplied to each of a boom cylinder and a turning hydraulic motor, such that the end of the bucket is moved along the trajectory line when a boom raising and turning operation is performed.

SUMMARY

According to an embodiment of the present invention, a shovel includes a lower traveling body, an upper turning body turnably mounted on the lower traveling body, a surroundings monitoring device attached to the upper turning body, and a controller configured to identify the state of an object based on the output of the surroundings monitoring device.

BRIEF DESCRIPTION OF THE DRAWINGS

Other objects and further features of the present invention will be apparent from the following detailed description when read in conjunction with the accompanying drawings, in which.

DETAILED DESCRIPTION

The shovel may be unable to handle changes in the state of the dump truck, which serves as an object detected by a camera. For example, when an automatic cover attached to the gate of the bed of the dump truck is switched from an open state to a close state, the shovel may cause the bucket to contact the automatic cover.

Therefore, it is desirable to provide a shovel that can securely prevent contact between the attachment and an object during loading work.

Figure 1A:
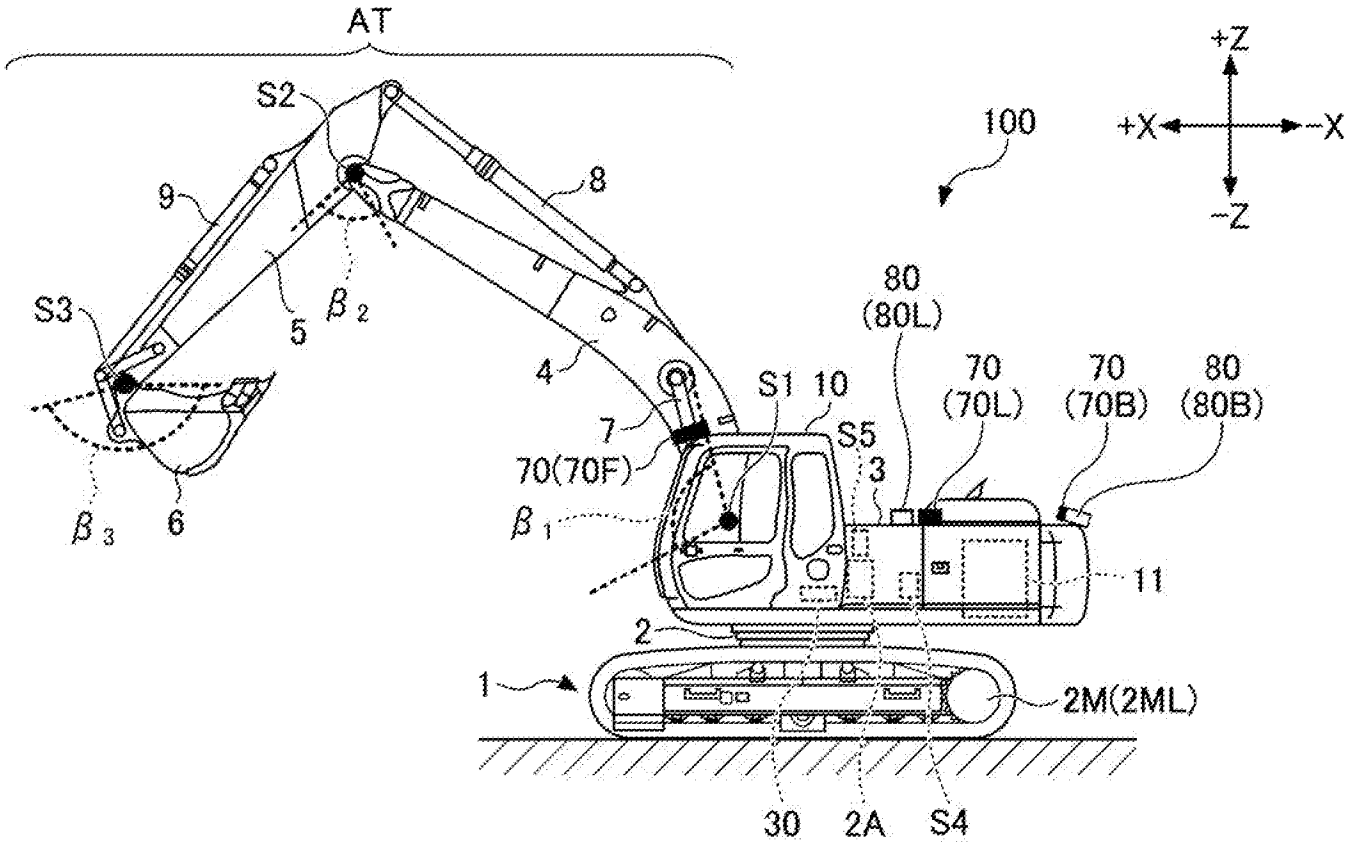
FIG. 1A is a side view of a shovel according to an embodiment of the present invention.
Figure 1B:
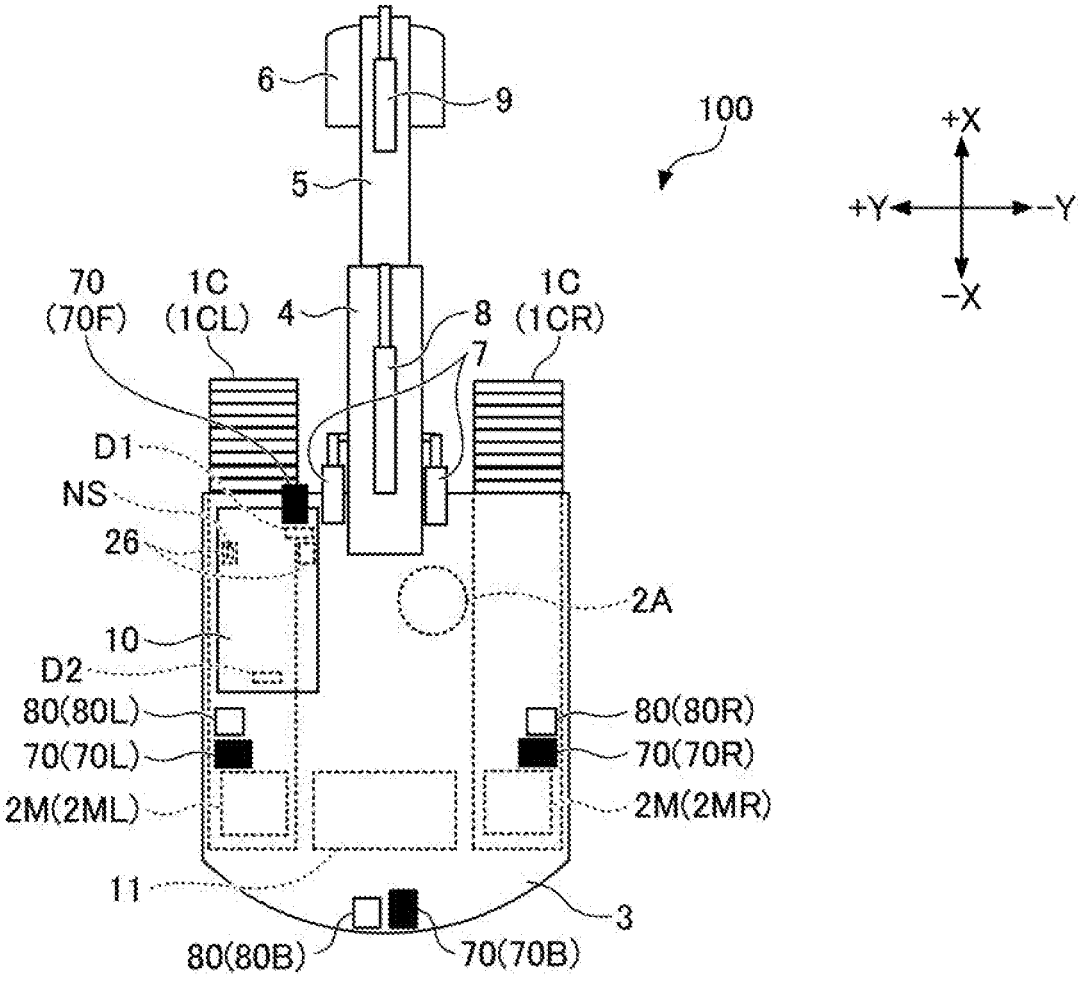
FIG. 1B is a top view of the shovel 100 according to the embodiment of the present invention.

First, a shovel 100 serving as an excavator according to an embodiment of the present invention will be described with reference to FIG. 1A and FIG. 1B. FIG. 1A is a side view of the shovel 100 and FIG. 1B is a top view of the shovel 100.

In the present embodiment, a lower traveling body 1 of the shovel 100 includes crawlers 10. The crawlers 1C are driven by traveling hydraulic motors 2M mounted on the lower traveling body 1. Specifically, the crawlers 1C include a left crawler 1CL and a right crawler 1CR. The left crawler 1CL is driven by a left traveling hydraulic motor 2ML, and the right crawler 1CR is driven by a right traveling hydraulic motor 2MR.

An upper turning body 3 is turnably mounted on the lower traveling body 1 of the shovel 100 via a turning mechanism 2. The turning mechanism 2 is driven by a turning hydraulic motor 2A mounted on the upper turning body 3. However, the turning hydraulic motor 2A may be a turning electric motor serving as an electric actuator.

A boom 4 is mounted on the upper turning body 3. An arm 5 is attached to the end of the boom 4, and a bucket 6, which serves as an end attachment, is attached to the end of the arm 5. The boom 4, the arm 5, and the bucket 6 constitute an excavation attachment AT, which is an example of an attachment. The boom 4 is driven by a boom cylinder 7, the arm 5 is driven by an arm cylinder 8, and the bucket 6 is driven by a bucket cylinder 9.

The boom 4 is supported so as to be pivotable relative to the upper turning body 3. A boom angle sensor S1 is attached to the boom 4. The boom angle sensor S1 can detect a boom angle $\beta_1$ that is the rotation angle of the boom 4. The boom angle $\beta_1$ is, for example, a climb angle from the lowermost position of the boom 4. Therefore, the boom angle $\beta_1$ maximizes when the boom 4 is raised most.

The arm 5 is supported so as to be pivotable relative to the boom 4. An arm angle sensor S2 is attached to the arm 5. The arm angle sensor S2 can detect an arm angle $\beta_2$ that is the rotation angle of the arm 5. The arm angle $\beta_2$ is, for example, an opening angle from the most closed position of the arm 5. Therefore, the arm angle 132 maximizes when the arm 5 is most open.

The bucket 6 is supported so as to be pivotable relative to the arm 5. A bucket angle sensor S3 is attached to the bucket 6. The bucket angle sensor S3 can detect a bucket angle $\beta_3$ that is the rotation angle of the bucket 6. The bucket angle $\beta_3$ is an opening angle from the most closed position of the bucket 6. Therefore, the bucket angle $\beta_3$ maximizes when the bucket 6 is most open.

According to the embodiment of FIG. 1A and FIG. 1B, each of the boom angle sensor S1, the arm angle sensor S2, and the bucket angle sensor S3 is constituted of a combination of an acceleration sensor and a gyroscope. However, at least one of the boom angle sensor S1, the arm angle sensor S2, and the bucket angle sensor S3 may be constituted of an acceleration sensor alone. Furthermore, the boom angle sensor S1 may be a stroke sensor attached to the boom cylinder 7, or may be a rotary encoder, a potentiometer, an inertial measurement unit, or the like. The same applies to the arm angle sensor S2 and the bucket angle sensor S3.

A cabin 10 that is a cab is provided on the upper turning body 3, and a power source such as an engine 11 is mounted on the upper turning body 3. Further, an object detector 70, an image capturing device 80, a body tilt sensor S4, a turning angular velocity sensor S5, and the like are attached to the upper turning body 3. An operation device 26, a controller 30, a display device D1, an audio output device D2, and the like are provided in the cabin 10. In the present specification, for convenience, the side of the upper turning body 3 to which the excavation attachment AT is attached is defined as the front side, and the side of the upper turning body 3 to which a counterweight is attached is defined as the back side.

The object detector 70 is an example of a surroundings monitoring device, and is configured to monitor objects in the vicinity of the shovel 100. Examples of the objects include people, animals, vehicles, work equipment, construction machines, buildings, walls, fences, and holes. The object detector 70 may be a camera, an ultrasonic sensor, a milliwave radar, a stereo camera, a light detection and ranging (LIDAR), a distance image sensor, or an infrared sensor. In the present embodiment, the object detector 70 includes a front sensor 70F attached to the front end of the upper surface of the cabin 10, a back sensor 70B attached to the back end of the upper surface of the upper turning body 3, a left sensor 70L attached to the left end of the upper surface of the upper turning body 3, and a right sensor 70R attached to the right end of the upper surface of the upper turning body 3.

The object detector 70 may be configured to detect a predetermined object within a predetermined region set in the vicinity of the shovel 100. The object detector 70 may be configured to distinguish between a person and an object other than a person. The object detector 70 may be configured to calculate the distance from the object detector 70 or the shovel 100 to a detected object.

The image capturing device 80 is another example of the surroundings monitoring device, and captures an image of an area surrounding the shovel 100. In the present embodiment, the image capturing device 80 includes a back camera 80B attached to the back end of the upper surface of the upper turning body 3, a left camera 80L attached to the left end of the upper surface of the upper turning body 3, and a right camera 80R attached to the right end of the upper surface of the upper turning body 3. The image capturing device 80 may also include a front camera.

The back camera 80B is placed next to the back sensor 70B, the left camera 80L is placed next to the left sensor 70L, and the right camera 80R is placed next to the right sensor 70R. If the image capturing device 80 includes a front camera, the front camera may be placed next to the front sensor 70F.

An image captured by the image capturing device 80 is displayed on the display device D1. The image capturing device 80 may be configured to be able to display a viewpoint change image such as an overhead view image on the display device D1. For example, an overhead view image is generated by combining respective output images of the back camera 80B, the left camera 80L, and the right camera 80R.

The body tilt sensor S4 is configured to detect the inclination of the upper turning body 3 relative to a predetermined plane. In the present embodiment, the body tilt sensor S4 is an acceleration sensor that detects the tilt angle (roll angle) of the upper turning body 3 around its longitudinal axis and the tilt angle (pitch angle) of the upper turning body 3 around its lateral axis relative to a horizontal plane. For example, the longitudinal axis and the lateral axis of the upper turning body 3 are perpendicular to each other and pass the shovel center point that is a point on the turning axis of the shovel 100. The body tilt sensor S4 may be configured by a combination of an acceleration sensor and a gyroscope.

The turning angular velocity sensor S5 is configured to detect the turning angular velocity of the upper turning body 3. In the present embodiment, the turning angular velocity sensor S5 is a gyroscope. However, the turning angular velocity sensor S5 may be a resolver, a rotary encoder, or the like. The turning angular velocity sensor S5 may also detect a turning speed. The turning speed may be calculated from a turning angular velocity.

In the following, at least one of the boom angle sensor S1, the arm angle sensor S2, the bucket angle sensor S3, the body tilt sensor S4, and the turning angular velocity sensor S5 may also be referred to as an orientation detector.

The display device D1 is configured to display various information. The audio output device D2 is configured to output audio. The operation device 26 is a device used by the operator to operate actuators.

The controller 30 is a control device for controlling the shovel 100. In the present embodiment, the controller 30 is configured by a computer including a CPU, a volatile storage device, and a nonvolatile storage device. The controller 30 reads programs corresponding to functions from the nonvolatile storage device and executes the programs. Examples of the functions include a machine guidance function that provides the operator with guidance (directions) on manually operating the shovel 100 and a machine control function that automatically assists the operator in manually operating the shovel 100.

Figure 2:
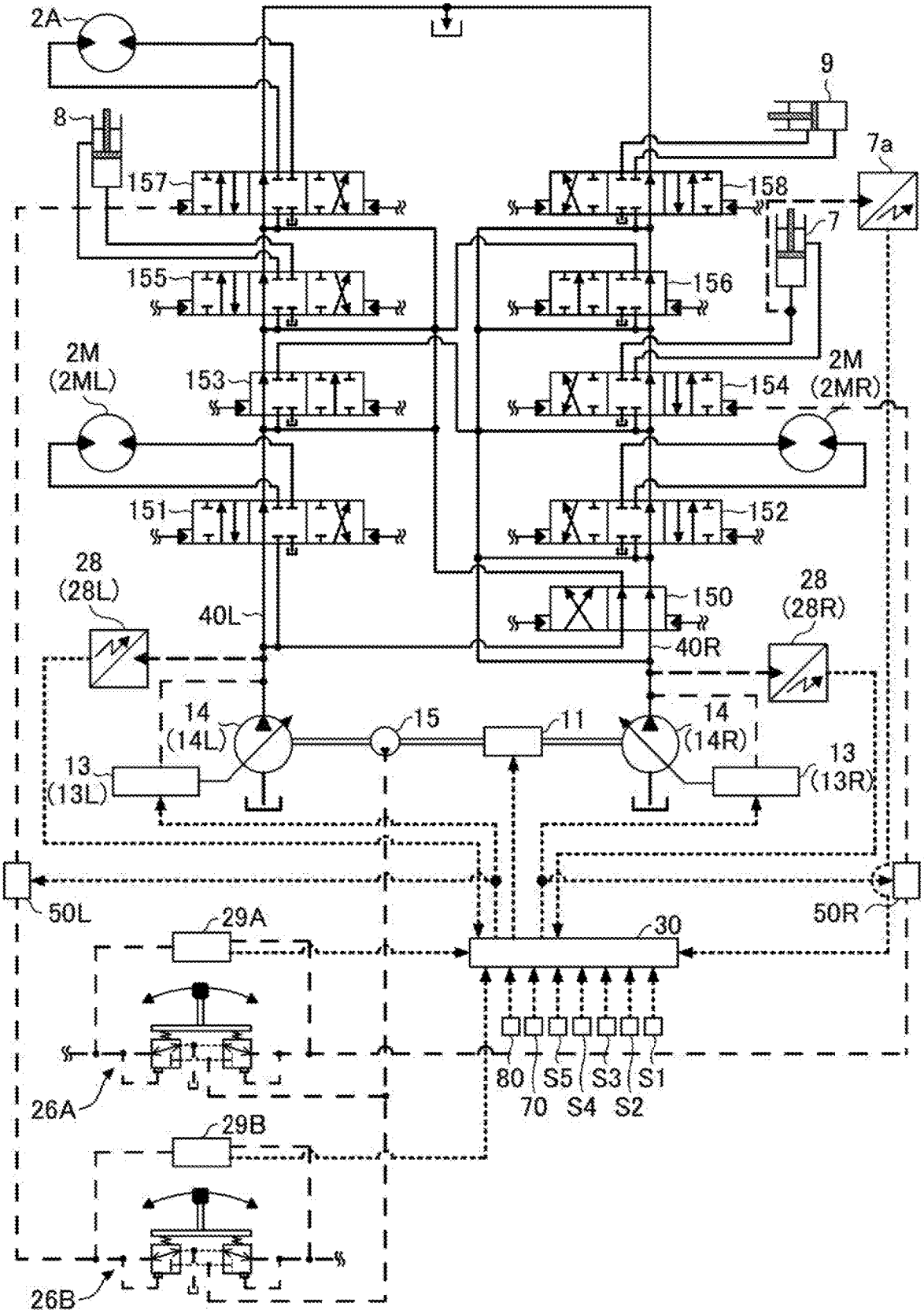
FIG. 2 is a diagram illustrating an example configuration of a hydraulic system installed in the shovel of FIG. 1A.

FIG. 2 is a diagram illustrating an example configuration of a hydraulic system installed in the shovel 100. In FIG. 2, a mechanical power transmission system, a hydraulic oil line, a pilot line, and an electrical control system are indicated by a double line, a solid line, a dashed line, and a dotted line, respectively.

The hydraulic system circulates hydraulic oil from a main pump 14, serving as a hydraulic pump and driven by the engine 11, to a hydraulic oil tank via a center bypass conduit 40. The main pump 14 includes a left main pump 14L and a right main pump 14R. The center bypass conduit 40 includes a left center bypass conduit 40L and a right center bypass conduit 40R.

The left center bypass conduit 40L is a hydraulic oil line that passes through control valves 151, 153, 155, and 157 placed in a control valve. The right center bypass conduit 40R is a hydraulic oil line that passes through the control valves 150, 152, 154, 156, and 158 placed in the control valve.

The control valve 150 is a straight travel valve. The control valve 151 is a spool valve that switches the flow of hydraulic oil in order to supply hydraulic oil discharged by the left main pump 14L to the left traveling hydraulic motor 2ML, and to discharge hydraulic oil in the left traveling hydraulic motor 2ML into the hydraulic oil tank. The control valve 152 is a spool valve that switches the flow of hydraulic oil in order to supply hydraulic oil discharged by the right main pump 14R to the right traveling hydraulic motor 2MR, and to discharge hydraulic oil in the right traveling hydraulic motor 2MR into the hydraulic oil tank.

The control valve 153 is a spool valve that switches the flow of hydraulic oil in order to supply hydraulic oil discharged by the left main pump 14L to the boom cylinder 7. The control valve 154 is a spool valve that switches the flow of hydraulic oil in order to supply hydraulic oil discharged by the right main pump 14R to the boom cylinder 7, and to discharge hydraulic oil in the boom cylinder 7 into the hydraulic oil tank.

The control valve 155 is a spool valve that switches the flow of hydraulic oil in order to supply hydraulic oil discharged by the left main pump 14L to the arm cylinder 8, and to discharge hydraulic oil in the arm cylinder 8 into the hydraulic oil tank. The control valve 156 is a spool valve that switches the flow of hydraulic oil in order to supply hydraulic oil discharged by the right main pump 14R to the arm cylinder 8.

The control valve 157 is a spool valve that switches the flow of hydraulic oil such that hydraulic oil discharged by the left main pump 14L circulates in the hydraulic motor 2A.

The control valve 158 is a spool valve that switches the flow of hydraulic oil in order to supply hydraulic oil discharged by the right main pump 14R to the bucket cylinder 9, and to discharge hydraulic oil in the bucket cylinder 9 into the hydraulic oil tank.

A regulator 13 controls the discharge quantity of the main pump 14 by adjusting the swash plate tilt angle of the main pump 14 in accordance with the discharge pressure of the main pump 14 (for example, by total horsepower control). In the example of FIG. 2, the regulator 13 includes a left regulator 13L corresponding to the left main pump 14L, and a right regulator 13R corresponding to the right main pump 14R.

A boom operating lever 26A is an operation device for raising or lowering the boom 4. The boom operating lever 26A uses hydraulic oil discharged by a pilot pump 15 to cause a control pressure corresponding to the amount of lever operation to act on a left or a right pilot port of the control valve 154. As a result, the stroke of a spool in the control valve 154 is controlled, such that the flow rate of hydraulic oil supplied to the boom cylinder 7 is controlled. The same applies to the control valve 153. In FIG. 2, pilot lines that connect the boom operating lever 26A to the left pilot port of the control valve 153, the right pilot port of the control valve 153, and a left pilot port of the control valve 154 are not depicted for clarification purposes.

An operating pressure sensor 29A detects the details of the operator's operation of the boom operating lever 26A in the form of pressure, and outputs the detected value to the controller 30. Examples of the details of the operator's operation include the direction of lever operation and the amount of lever operation (the angle of lever operation).

A turning operating lever 26B is an operation device that brings the turning mechanism 2 into operation by driving the turning hydraulic motor 2A. For example, the turning operating lever 26B uses hydraulic oil discharged by the pilot pump 15 to cause a control pressure corresponding to the amount of lever operation to act on a left or a right pilot port of the control valve 157. As a result, the stroke of a spool in the control valve 157 is controlled, such that the flow rate of hydraulic oil supplied to the turning hydraulic motor 2A is controlled. The same applies to the control valve 153. In FIG. 2, a pilot line that connects the turning operating lever 26B to the right pilot port of the control valve 157 is not depicted for clarification purposes.

An operating pressure sensor 29B detects the details of the operator's operation of the turning operating lever 26B in the form of pressure, and outputs the detected value to the controller 30.

The shovel 100 includes traveling levers, traveling pedals, an arm operating lever, and a bucket operating lever (none of which is illustrated), in addition to the boom operating lever 26A and the turning operating lever 26B. Similar to the boom operating lever 26A and the turning operating lever 26B, each of these operation devices use hydraulic oil discharged by the pilot pump 15 to cause a control pressure corresponding to the amount of lever operation or the amount of pedal operation to act on a left or a right pilot port of a corresponding control valve. Further, the details of the operator's operation of each of the operation devices is detected in the form of pressure by a corresponding operating pressure sensor, similar to the operating pressure sensor 29A. Each of the operating pressure sensors outputs a detected value to the controller 30. In FIG. 2, pilot lines that connect these operation devices to corresponding control valves are not depicted for clarification purposes.

The controller 30 receives the output of each of the boom angle sensor S1, the arm angle sensor S2, the bucket angle sensor S3, the operating pressure sensor 29A, the operating pressure sensor 29B, a boom cylinder pressure sensor 7*a*, and a discharge pressure sensor 28, and appropriately outputs a control command to the engine 11 and the regulator 13.

The controller 30 may control the turning operation of the upper turning body 3 by outputting a control command to a pressure reducing valve 50L and adjusting a control pressure acting on the control valve 157. Further, the controller 30 may control the boom raising operation of the boom 4 by outputting a control command to a pressure reducing valve 50R and adjusting a control pressure acting on the control valve 154. In FIG. 2, a configuration in which a control pressure acting on the left pilot port of the control valve 157 is depicted, and a configuration in which a control pressure acting on the right pilot port of the control valve 157 is not depicted for clarification purposes. In addition, in FIG. 2, a configuration in which a control pressure acting on the right pilot port of the control valve 154 is depicted, and a configuration in which a control pressure acting on the left pilot port of the control valve 154 is not depicted for clarification purposes.

Therefore, the controller 30 can adjust a control pressure related to the control valve 157 through the pressure reducing valve 50L, based on the relative positional relationship between the bucket 6 and a dump truck. Further, the controller 30 can adjust a control pressure related to the control valve 154 through the pressure reducing valve 50R, based on the relative positional relationship between the bucket 6 and the dump truck. Accordingly, a boom raising and turning operation by lever operations can be properly assisted. The pressure reducing valve 50L and the pressure reducing valve 50R may be solenoid proportional valves.

Figure 3A:
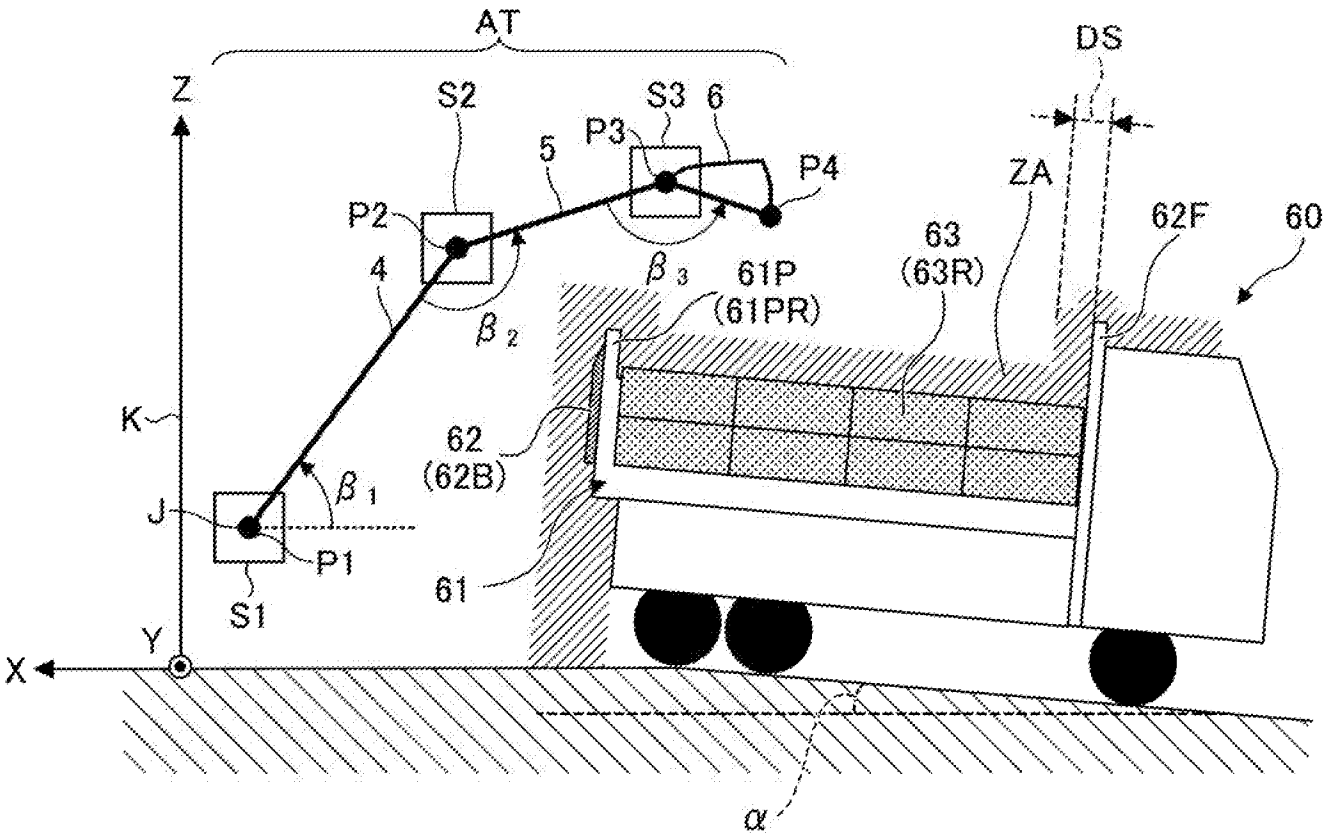
FIG. 3A is a diagram illustrating the positional relationship between the shovel and a dump truck.
Figure 3B:
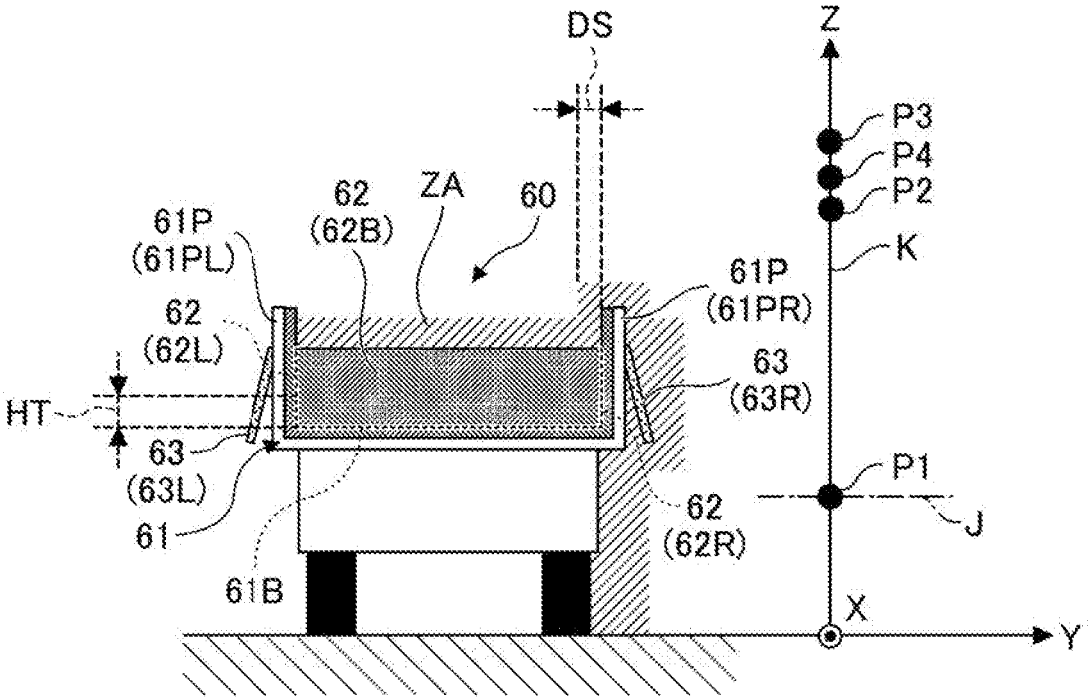
FIG. 3B is a diagram illustrating the positional relationship between the shovel and the dump truck.

Next, the controller 30's function of preventing contact between a dump truck 60 and the shovel 100 will be described with reference to FIG. 3A and FIG. 3B. FIG. 3A and FIG. 3B illustrate the positional relationship between the excavation attachment AT and the dump truck 60. Specifically, in FIG. 3A and FIG. 3B, a simplified model of the excavation attachment AT is depicted for clarification purposes. FIG. 3A is a right side view of the excavation attachment AT and the dump truck 60. FIG. 3B is a back side view of the excavation attachment AT and the dump truck 60. In the examples of FIG. 3A and FIG. 3B, the shovel 100 is located at the obliquely right rear side of the dump truck 60, and directs the excavation attachment AT in a direction parallel to the X-axis.

As illustrated in FIG. 3A, the boom 4 is configured to vertically pivot about a pivot axis J parallel to the Y-axis. The arm 5 is attached to the end of the boom 4. The bucket 6 is attached to the end of the arm 5. The boom angle sensor S1 is attached to a coupling portion of the upper turning body 3 and the boom 4. The coupling portion of the upper turning body 3 and the boom 4 is indicated by a point P1. The arm angle sensor S2 is attached to a coupling portion of the boom 4 and the arm 5. The coupling portion of the boom 4 and the arm 5 is indicated by a point P2. The bucket angle sensor S3 is attached to a coupling portion of the arm 5 and the bucket 6. The coupling portion of the arm 5 and the bucket 6 is indicated by a point P3. A point P4 indicates the position of the end (tip) of the bucket 6.

In FIG. 3A, the boom angle sensor S1 measures the boom angle $\beta_1$ between the longitudinal direction of the boom 4 and a reference horizontal plane (XY plane). The arm angle sensor S2 measures the arm angle $\beta_2$ between the longitudinal direction of the boom 4 and the longitudinal direction of the arm 5. The bucket angle sensor S3 measures the bucket angle $\beta_3$ between the longitudinal direction of the arm 5 and the longitudinal direction of the bucket 6. The longitudinal direction of the boom 4 refers to a direction of a straight line passing through the point P1 and the point P2 in a plane (XZ plane) perpendicular to the pivot axis J. The longitudinal direction of the arm 5 refers to a direction of a straight line passing through the point P2 and the point $\beta_3$ in the XZ plane. The longitudinal direction of the bucket 6 refers to a direction of a straight line passing through the point $\beta_3$ and the point P4 in the XZ plane. The pivot axis J is located at a position away from a turning axis K (Z-axis). The pivot axis J may be located such that the turning axis K and the pivot axis J cross each other.

For example, the controller 30 can derive the relative position of the point P1 with respect to the turning axis based on the outputs of the body tilt sensor S4 and the turning angular velocity sensor S5. Further, the controller 30 can derive the relative position of each of the point P2 to P4 with respect to the point P1, based on the outputs of the boom angle sensor S1, the arm angle sensor S2, and the bucket angle sensor S3. Similarly, the controller 30 can derive the relative position of any portion of the excavation attachment AT, such as the edge of the back surface of the bucket 6, with respect to the point P1.

In the examples of FIG. 3A and FIG. 3B, the dump truck 60 is a soil dump truck having a relatively shallow loading space. However, the dump truck 60 may be a large-capacity dump truck having a relatively deep loading space. A gate 62 is attached to a bed 61 of the dump truck 60. The gate 62 is an openable and closable member that forms the side walls of the bed 61, and includes a back gate 62B, a left gate 62L, and a right gate 62R (see FIG. 5). A front panel 62F is provided at the front end of the bed 61. A pillar 61P is provided at the back end of the bed 61. The pillar 61P is a member that supports the back gate 62B such that the back gate 62B is openable and closable, and includes a left pillar 61PL and a right pillar 61PR. A cover 63 may be attached to the gate 62. The cover 63 is a member that prevents the falling of excavated material loaded in the bed 61, and is also referred to as a "truck curtain". In the examples of FIG. 3A and FIG. 3B, a left cover 63L formed of a synthetic resin is attached to the upper end of the left gate 62L such that the left cover 63L is openable and closable. Similarly, a right cover 63R formed of a synthetic resin is attached to the upper end of the right gate 62R such that the right cover 63R is openable and closable. In the examples of FIG. 3A and FIG. 3B, the left cover 63L and the right cover 63R are configured to be separately openable and closable by an electric motor in accordance with the operation of switches provided in a cabin of the dump truck 60. However, the left cover 63L and the right cover 63R may be configured to be manually openable and closable.

Further, as illustrated in FIG. 3A, the dump truck 60 is stopped on a slope of a tilt angle $\alpha$. Therefore, the bed 61 is inclined relative to the horizontal plane, and the back end of the bed 61 is positioned higher than the front end of the bed 61.

An area of oblique lines illustrated in each of FIG. 3A and FIG. 3B represents a part of a prohibited area ZA where the entry of the excavation attachment AT is prohibited. For example, the controller 30 may derive and set the prohibited area ZA, based on the output of the surroundings monitoring device. In each of the examples of FIG. 3A and FIG. 3B, the controller 30 derives the prohibited area ZA based on the output of a LIDAR serving as the object detector 70, which is an example of the surroundings monitoring device.

For example, the prohibited area ZA may be set as a space whose outline is larger than the outline of the dump truck 60 by a predetermined distance DS. That is, the prohibited area ZA may be set as a three-dimensional space whose outline is a similar extension of the outline of the dump truck 60. Specifically, as illustrated in FIG. 3A, the prohibited area ZA may be set such that one of boundary surfaces of the prohibited area ZA is located at a position that is away from the front panel 62F toward the back by the distance DS. Further, as illustrated in FIG. 3B, the prohibited area ZA may be set such that one of the boundary surfaces is located at a position that is away from the right gate 62R toward the left by the distance DS. The same applies to the other boundary surfaces defining the prohibited area ZA.

The prohibited area ZA may be set to include a rectangular parallelepiped space surrounded by an inner bottom surface 61B, the front panel 62F, the left gate 62L, the right gate 62R, and the back gate 62B of the dump truck 60. In this case, as illustrated in in FIG. 3B, the rectangular parallelepiped space may be set to have a boundary surface (an upper surface) at a position higher than the inner bottom surface 61B by a predetermined distance HT.

For example, the controller 30 may be configured to use a hypothetical three-dimensional model, such as a polygon model or a wireframe model, to identify the three-dimensional overall outline (outer surface) of the dump truck 60 or the bed 61, and derive a prohibited area ZA based on the identified results.

The controller 30 identifies that an object (dump truck 60) detected by the object detector 70 has entered the working radius of the excavation attachment AT of the shovel 100. Then, the controller 30 identifies that the object within the working radius of the excavation attachment AT is the dump truck 60. Accordingly, the controller 30 calculates the positional relationship between the object and the shovel 100 without interrupting the operation of the shovel 100 even when the object is located within the working radius of the excavation attachment AT. At this time, the controller 30 generates a prohibited area ZA and a target trajectory, which will be described below, based on the positional relationship between the object and the shovel 100. However, the state of the dump truck 60 (object) may change. Specifically, the tilt angle of the dump truck 60 may change each time loading work is performed. Further, the prohibited area ZA and the target trajectory should be different between when the dump truck 60 is located on an inclined ground and when the dump truck 60 is located on a flat ground. For this reason, in the present embodiment, the controller 30 determines the state of the object based on the output of the object detector 70, and sets a prohibited area ZA based on the state of the object. The controller 30 may set a prohibited area ZA based on the output of the image capturing device 80, which is another example of the surroundings monitoring device.

For example, the controller 30 determines whether the excavation attachment AT has entered the prohibited area ZA. If the controller 30 determines that the excavation attachment AT has entered the prohibited area ZA, the controller 30 stops the movement of the excavation attachment AT. For example, if the controller 30 determines that the excavation attachment AT has entered the prohibited area ZA during a turning operation, the controller 30 may forcibly stop the turning hydraulic motor 2A by outputting a control command to the pressure reducing valve 50L. The controller 30 may determine whether the excavation attachment AT is approaching the prohibited area ZA. If the controller 30 determines that the excavation attachment AT is approaching the prohibited area ZA, the controller 30 may slow the movement of the excavation attachment AT. For example, if the controller 30 determines that the excavation attachment AT is approaching the prohibited area ZA during a turning operation, the controller 30 may forcibly slow the turning hydraulic motor 2A by outputting a control command to the pressure reducing valve 50L. If the controller 30 determines that the excavation attachment AT has entered the prohibited area ZA, or determines that the excavation attachment AT is approaching the prohibited area ZA, the controller 30 may only perform at least one of outputting an alarm sound and turning on an alarm lamp.

With the above-described configuration, the controller 30 can securely prevent contact between the excavation attachment AT and the dump truck 60, by appropriately setting the prohibited area ZA in accordance with the state of the dump truck 60. Specifically, when the dump truck 60 is stopped on a slope, the controller 30 can reflect the tilt angle of the slope (the tilt angle of the bed 61) in the prohibited area ZA. Further, when the pillar 61P is provided at the back end of the bed 61, the controller 30 can reflect the shape of the pillar 61P in the prohibited area ZA. Further, when the cover 63 is attached to the gate 62 such that the cover 63 is openable and closable, the controller 30 can reflect the opening/closing state of the cover 63 in the prohibited area ZA.

Figure 4:
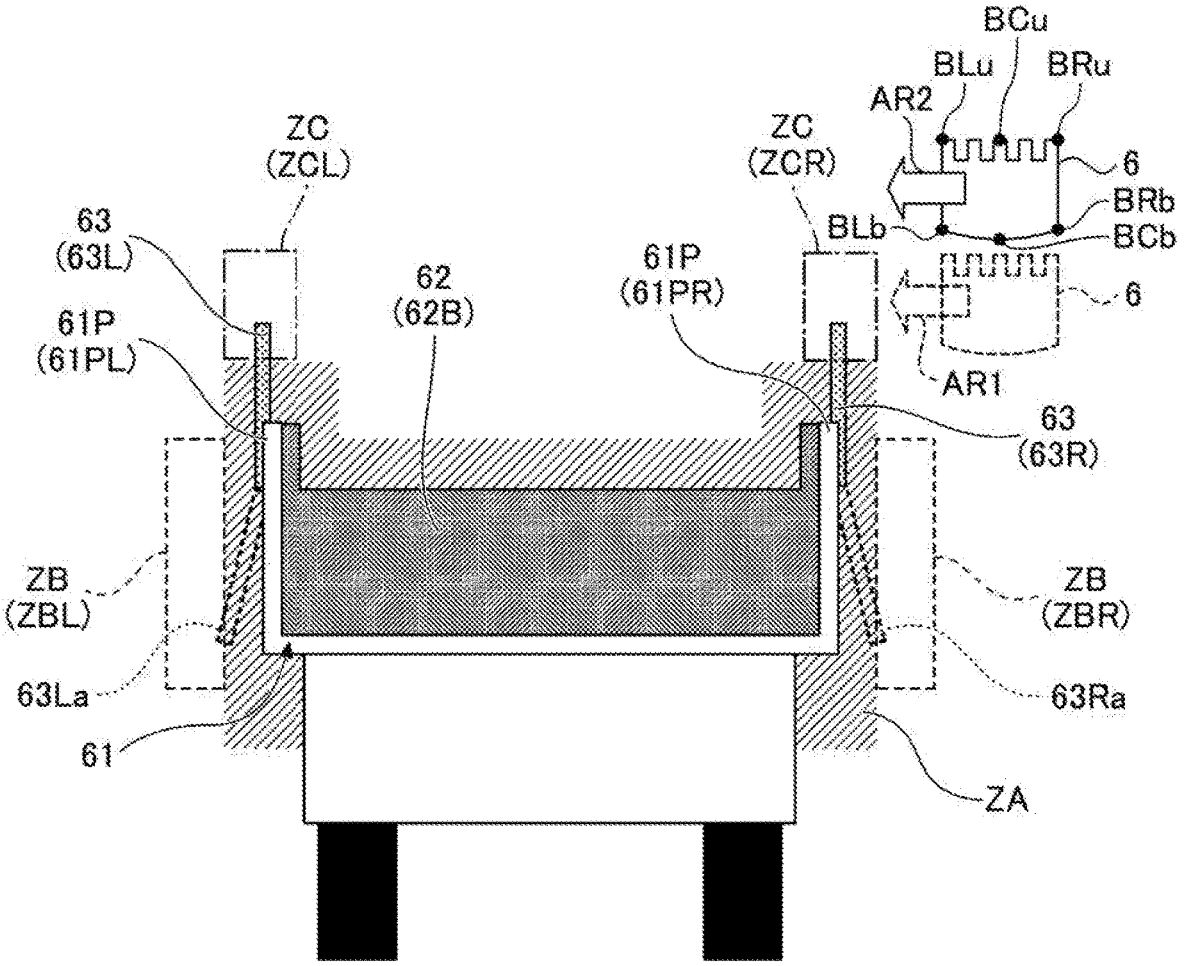
FIG. 4 is a back side view of the dump truck.
Figure 5:
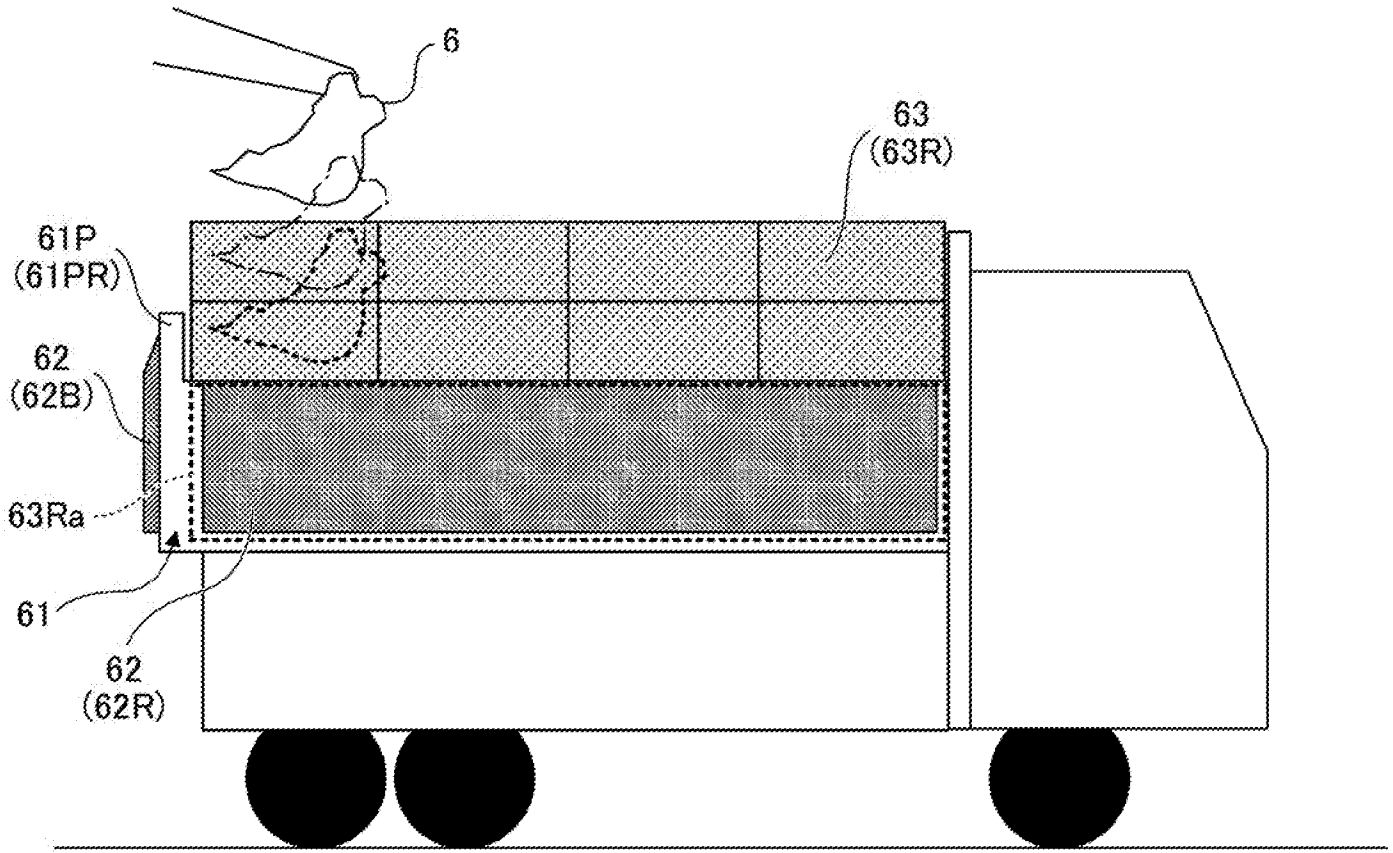
FIG. 5 is a right side view of the dump truck.

Next, the controller 30's function of correcting the size of a prohibited area ZA will be described with reference to FIG. 4 and FIG. 5. FIG. 4 is a back side view of the dump truck 60. FIG. 5 is a right side view of the dump truck 60. In FIG. 4 and FIG. 5, each of the left cover 63L and the right cover 63R are closed to an upright position. A left cover 63La drawn by a dotted line indicates the left cover 63L that is in a full-open position before being closed to the upright position. Similarly, a right cover 63Ra drawn by a dotted line indicates the right cover 63R that is in a full-open position before being closed to the upright position.

The controller 30 derives a prohibited area ZA based on the output of the LIDAR serving as the object detector 70, which is an example of the surroundings monitoring device. An area of oblique lines illustrated in FIG. 4 indicates a part of the prohibited area ZA. An area surrounded by a dashed line indicates an area ZB that is excluded from the prohibited area ZA because the state of the dump truck 60 is changed. An area surrounded by a dash-dot line indicates an area ZC that is newly included in the prohibited area ZA because the state of the dump truck 60 is changed. Specifically, the area ZB includes an area ZBL and an area ZBR. The area ZBL is excluded from the prohibited area ZA because the left cover 63L is closed, and the area ZBR is excluded from the prohibited area ZA because the right cover 63R is closed. Further, the area ZC includes an area ZCL and an area ZCR. The area ZCL is newly included in the prohibited area ZA because the left cover 63L is closed to the upright position, and the area ZCR is newly included in the prohibited area ZA because the right cover 63R is closed to the upright position.

As described, the controller 30 can identify the state of the dump truck 60 based on the output of the LIDAR, and correct the size of the prohibited area ZA in accordance with the state of the dump truck 60. Examples of the state of the dump truck 60 include the opening/closing state of the cover 63, the opening/closing state of the gate 62, and the inclination state of the bed 61.

For example, as illustrated in FIG. 4, when the right cover 63R is in the upright position, the controller 30 can stop the movement of the bucket 6 approaching the right cover 63R as indicated by a dotted arrow AR1. In this case, the operator of the shovel 100 can move the bucket 6 above the upper end of the right cover 63R and toward the left as illustrated in the solid arrow AR2, such that the bucket 6 can be positioned above the bed 61 without contacting the right cover 63R. When the right cover 63R is fully open, the controller 30 can determine that the bucket 6 does not contact the dump truck 60. Thus, the controller 30 does not stop the movement of the bucket 6 toward the left as indicated by the dotted arrow AR1.

The controller 30 is configured to derive the relative position of the bucket 6 with respect to the prohibited area ZA, based on the output of the orientation detector. For example, as illustrated in FIG. 4, the controller 30 sets, as six main monitoring points, a coordinates point Blu of the left end of the tip of the bucket 6, a coordinates point BCu of the center of the tip of the bucket 6, a coordinates point BRu of the right end of the tip of the bucket 6, a coordinates point BLb of the left end of the back surface of the bucket 6, a coordinates point BCb of the center of the back surface of the bucket 6, and a coordinates point BRb of the right end of the back surface of the bucket 6, and repeatedly calculates the coordinates of each of the monitoring points in a predetermined control cycle. The term "monitoring point" means a point where changes in position are monitored. Then, the controller 30 determines whether the bucket 6 has entered the prohibited area ZA, that is, whether the bucket 6 may contact the dump truck 60, based on the coordinates of each of the monitoring points and a plurality of coordinates defining the prohibited area ZA. As in the case of identifying the three-dimensional outline of the dump truck 60 or the bed 61, the controller 30 may use a hypothetical three-dimensional model, such as a polygon model or a wireframe model, to identify the three-dimensional overall outline (outer surface) of the bucket 6, and determine whether the bucket 6 has entered the prohibited area ZA based on the identified results.

For example, as illustrated in FIG. 5, when the right cover 63R is in the upright position, the controller 30 is configured to perform a left turning operation at a height of the bucket 6 drawn by a solid line. That is, if a left turning operation is performed at a height of the bucket 6 drawn by a dash-dot line or a dotted line, the controller 30 is configured to stop the left turning operation. When the right cover 63R is fully open (as in the case of the right cover 63Ra drawn by the dotted line), the controller 30 is configured to perform the left turning operation at the height of the bucket 6 drawn by the dotted line instead of the dash-dot line. That is, the controller 30 is configured not to stop the left turning operation even when the left turning operation is performed at the height of the bucket 6 drawn by the dotted line. This is because the controller 30 can accurately identify the shape of the right pillar 61PR based on the output of the LIDAR. That is, the controller 30 can accurately identify that the upper end of the right gate 62R is lower than the upper end of the right pillar 61PR. Further, in the example illustrated in FIG. 5, the controller 30 can determine that the bucket 6 is located on the front side relative to the right pillar 61PR, and thus the bucket does not contact the right pillar 61PR even when the bucket 6 is moved to a position lower than the upper end of the right pillar 61PR. With the above-described configuration, the controller 30 can prevent excessive restriction of the movement of the excavation attachment AT.

Figure 6A:
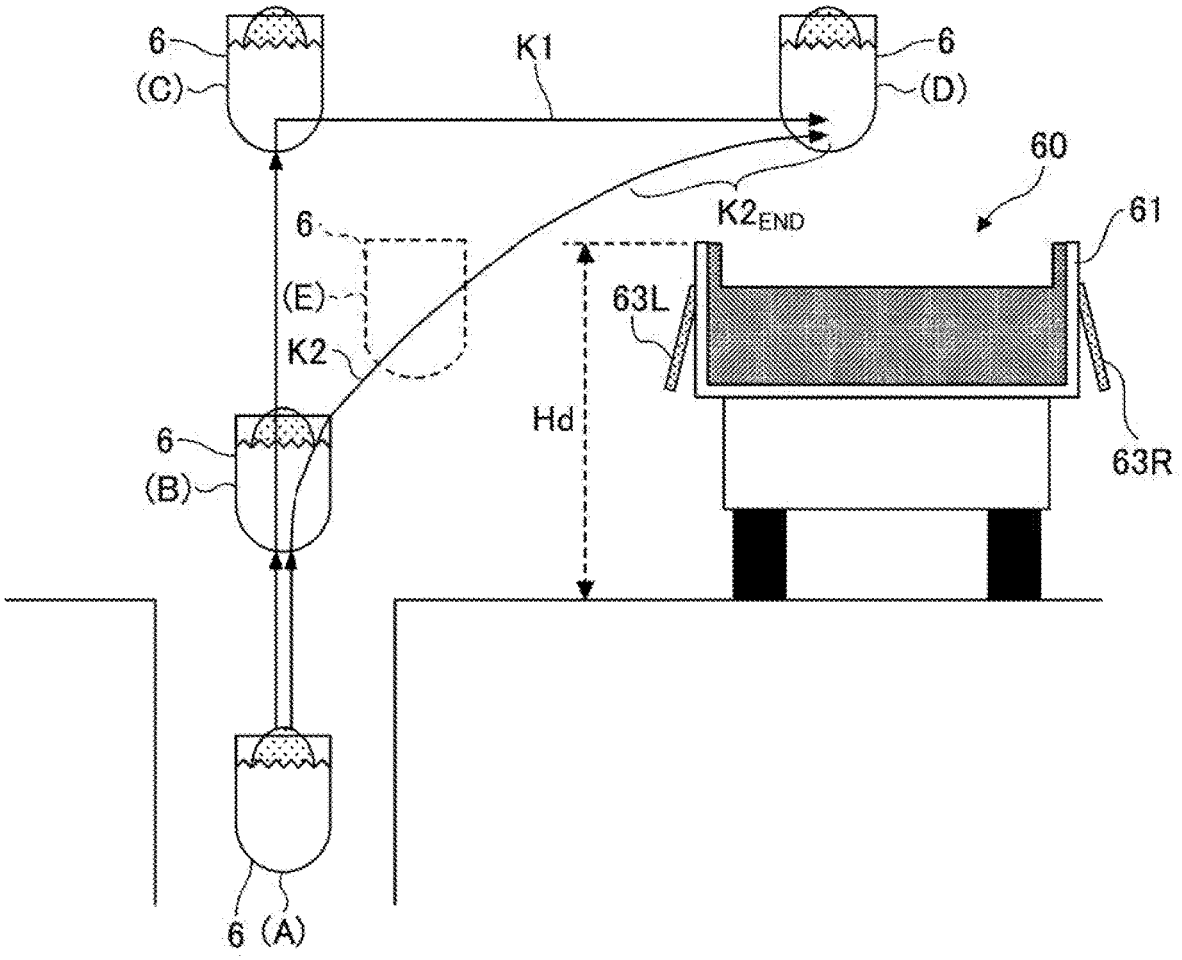
FIG. 6A is a back side view of a bucket and the dump truck.
Figure 6B:
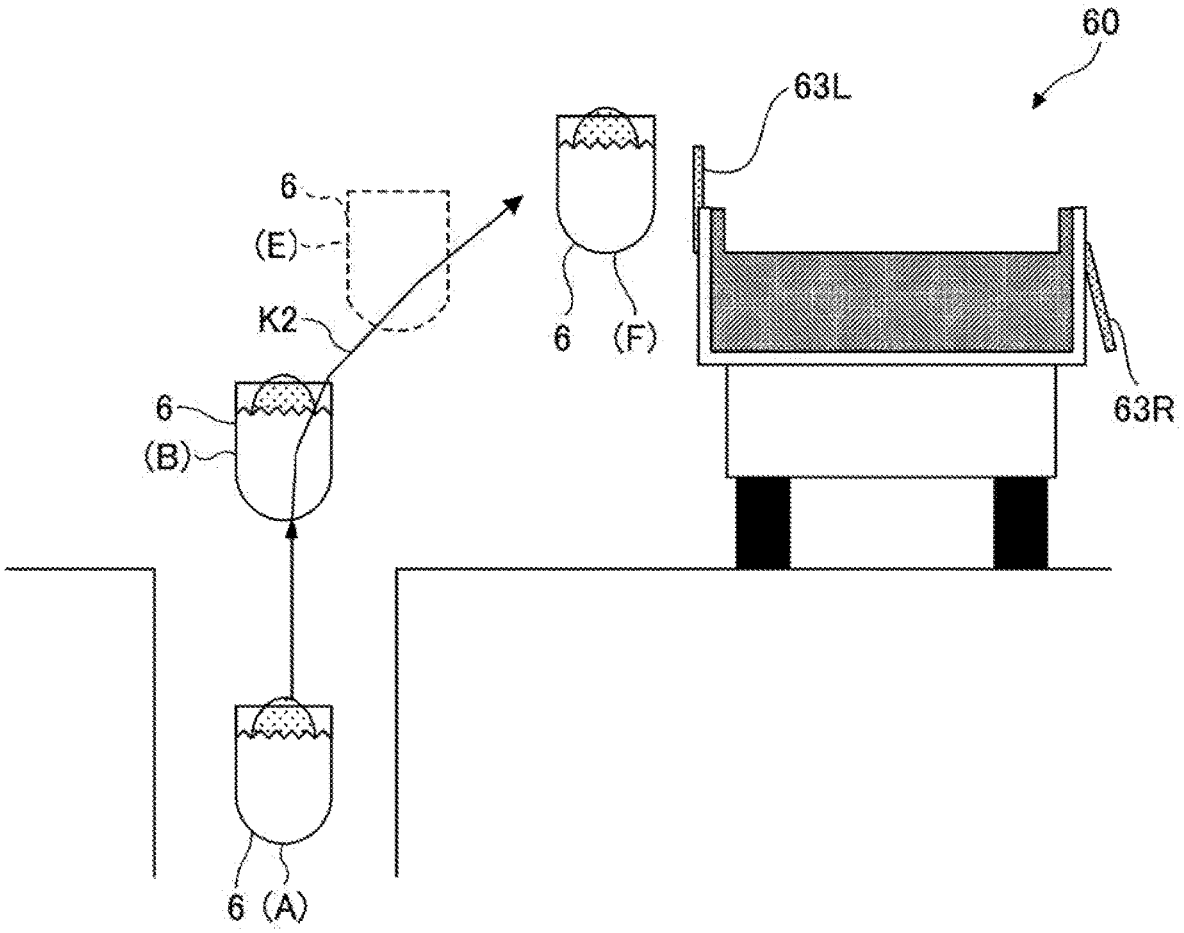
FIG. 6B is a back side view of the bucket and the dump truck.

The controller 30 may prevent contact between the excavation attachment AT and the dump truck 60 by predicting a trajectory of movement of the bucket 6. The controller 30's function of predicting a trajectory of movement of the bucket 6 will be described with reference to FIG. 6A and FIG. 6B. FIG. 6A and FIG. 6B are back side views of the bucket 6 and the dump truck 60. Specifically, in FIG. 6A and FIG. 6B, a simplified model of the bucket 6 is depicted for clarification purposes. In the examples of FIG. 6A and FIG. 6B, the shovel 100 excavates the ground to the left of the dump truck 60, and subsequently performs a loading operation of loading excavated material such as excavated soil into the bed 61 of the dump truck 60. FIG. 6A illustrates a trajectory of movement of the bucket 6 when the left cover 63L is fully open. FIG. 6B illustrates a trajectory of movement of the bucket 6 when the left cover 63L is in the upright position.

The bucket 6 loaded with the excavated material can follow two main patterns of a trajectory of movement in the loading operation. The first pattern is a trajectory of movement that follows a trajectory line K1. That is, the bucket 6 is approximately vertically raised by the boom 4 from an excavation completion position (A) to a bucket position (C) via a bucket position (B). At this time, the lower end of the bucket 6 is at a height greater than a height Hd of the upper end of the bed 61 of the dump truck 60. Then, the bucket 6 is moved to a soil discharging position (D) by clockwise turning of the upper turning body 3. At this time, the arm 5 is appropriately opened and closed. In the first pattern, the risk of the bucket 6 contacting the dump truck 60 is low, but an unnecessarily large vertical movement and an unnecessarily long travel distance result in poor fuel efficiency.

The second pattern is a trajectory of movement that follows a trajectory line K2. The trajectory line K2 is a trajectory of movement along which the bucket 6 travels the shortest distance to the soil discharging position (D). Specifically, the bucket 6 is moved from the excavation completion position (A) to the soil discharging position (D) via the bucket position (B) by boom raising and turning.

In the examples of FIG. 6A and FIG. 6B, the excavation completion position (A) is at a position lower than the bucket position (B), namely a position lower than a plane in which the dump truck 60 is positioned. However, the excavation completion position (A) may be at a position higher than the plane in which the dump truck 60 is positioned.

Typically, in the case of attempting to move the bucket 6 along the trajectory line K2, the operator tends to decrease the operating speed because there is a relatively high possibility that the bucket 6 may contact the dump truck 60. As a result, loading work efficiency may be impaired.

In view of the above, as illustrated in FIG. 6A, the controller 30 predicts a trajectory of movement of the bucket 6 while the bucket 6 is moving from the bucket position (B) toward the soil discharging position (D) along the trajectory line K2 before the distance between the bucket 6 and the dump truck 60 falls below a predetermined value. Specifically, when the bucket 6 reaches a bucket position (E), the controller 30 predicts a trajectory of movement from the bucket position (E), based on a trajectory of movement from the bucket position (B) to the bucket position (E). When the controller 30 determines that the bucket 6 enters a prohibited area ZA if the bucket 6 is moved along the predicted trajectory of movement, the controller 30 stops the turning hydraulic motor 2A in a forcible and stepwise manner by outputting a control command to the pressure reducing valve 50L. In this way, the turning operation can be stopped before the bucket 6 enters the prohibited area ZA.

As illustrated in FIG. 6A, when the left cover 63L is fully open, the controller 30 determines that the bucket 6 does not enter the prohibited area ZA based on the predicted result at the bucket position (E). In this case, the controller 30 does not stop the turning hydraulic motor 2A when the bucket 6 approaches the dump truck 60. However, the controller 30 may slow the movement of the bucket 6 when the bucket 6 enters a final range $K2_{END}$ of the trajectory line K2. As a result, the bucket 6 can be smoothly stopped at the soil discharging position (D).

When the left cover 63L is in the upright position as illustrated in FIG. 6B, the controller 30 determines that the bucket 6 enters the prohibited area ZA based on the predicted result at the bucket position (E). In this case, the controller 30 stops the turning hydraulic motor 2A in a forcible and stepwise manner, such that the turning operation can be stopped before the bucket 6 enters the prohibited area ZA. Specifically, the controller 30 stops the bucket 6 at a bucket position (F).

With the above-described configuration, the controller 30 can securely prevent contact between the bucket 6 and the dump truck 60.

Figure 7:
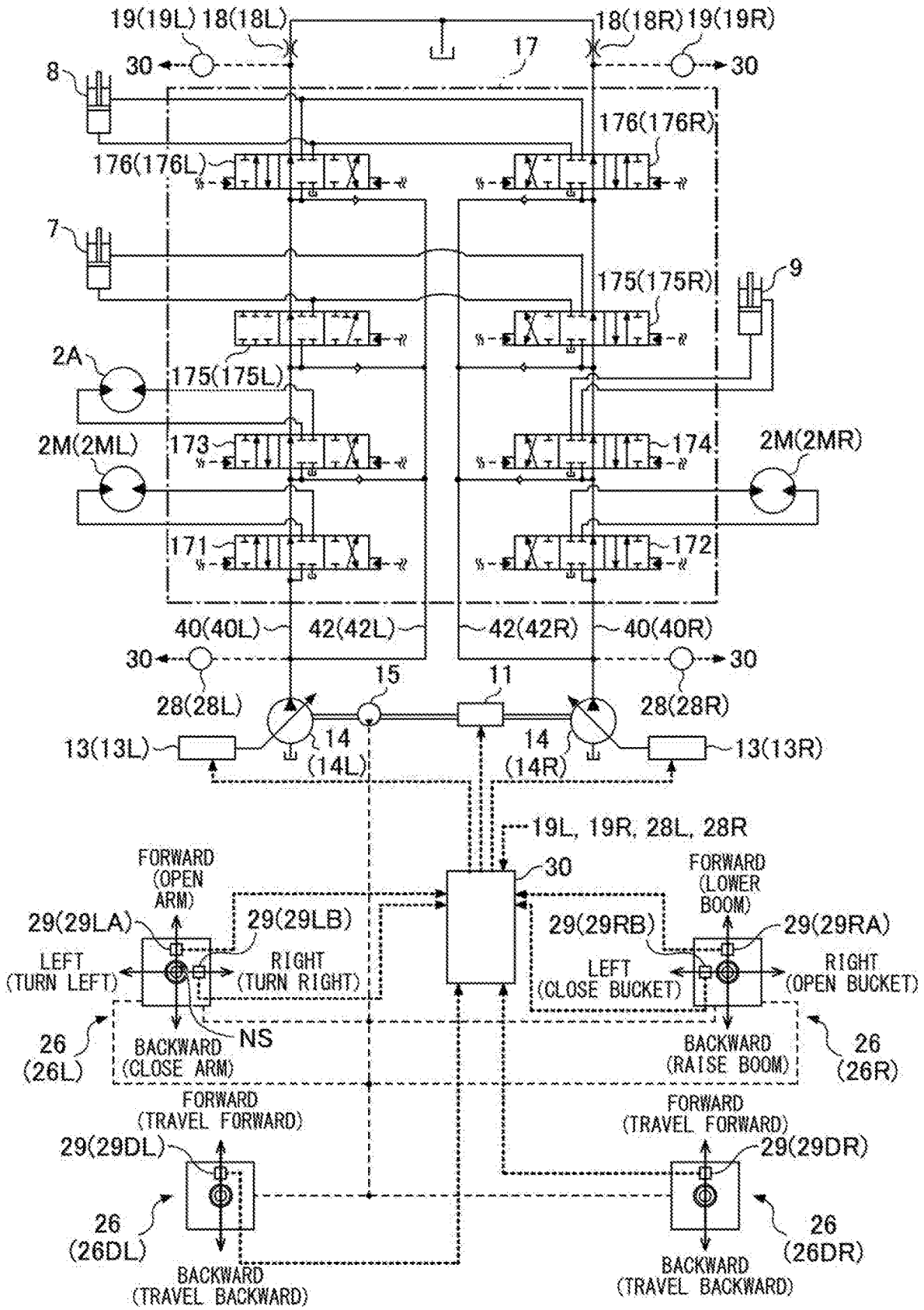
FIG. 7 is a diagram illustrating another example configuration of a hydraulic system installed in the shovel of FIG. 1A.

Next, another example configuration of a hydraulic system installed in the shovel 100 will be described with reference to FIG. 7. FIG. 7 is a diagram illustrating another example configuration of a hydraulic system installed in the shovel 100. Similar to FIG. 2, in FIG. 7, a mechanical power transmission system, a hydraulic oil line, a pilot line, and an electrical control system are indicated by a double line, a solid line, a dashed line, and a dotted line, respectively.

Similar to the hydraulic system of FIG. 2, the hydraulic system of FIG. 7 mainly includes an engine 11, a regulator 13, a main pump 14, a pilot pump 15, a control valve 17, an operation device 26, a discharge pressure sensor 28, an operating pressure sensor 29, and a controller 30.

In FIG. 7, the hydraulic system circulates hydraulic oil from the main pump 14 driven by the engine 11 to a hydraulic oil tank via a center bypass conduit 40 or a parallel conduit 42.

The engine 11 is a drive source of the shovel 100. In the present embodiment, the engine 11 is, for example, a diesel engine that operates so as to maintain a predetermined rotational speed. The output shaft of the engine 11 is coupled to the input shafts of the main pump 14 and the pilot pump 15.

The main pump 14 supplies hydraulic oil to the control valve 17 via a hydraulic oil line. In the present embodiment, the main pump 14 is a swash plate variable displacement hydraulic pump.

The regulator 13 controls the discharge quantity of the main pump 14. In the present embodiment, the regulator 13 controls the discharge quantity of the main pump 14 by adjusting the swash plate tilt angle of the main pump 14 in response to a control command from the controller 30.

The pilot pump 15 is configured so as to supply hydraulic oil to hydraulic control devices including the operation device 26 via a pilot line. In the present embodiment, the pilot pump 15 is a fixed displacement hydraulic pump. However, the pilot pump 15 may be omitted. In this case, the function carried by the pilot pump 15 may be implemented by the main pump 14. That is, the main pump 14 may have a function of supplying hydraulic oil to the operation device 26 after reducing the pressure of the hydraulic oil with a throttle or the like, in addition to a function of supplying hydraulic oil to the control valve 17.

The control valve 17 is a hydraulic control unit that controls the hydraulic system installed in the shovel 100. In the present embodiment, the control valve 17 includes control valves 171 through 176. The control valve 175 includes a control valve 175L and a control valve 175R, and the control valve 176 includes a control valve 176L and a control valve 176R. The control valve 17 can selectively supply hydraulic oil discharged by the main pump 14 to one or more hydraulic actuators through the control valves 171 through 176. The control valves 171 through 176 control the flow rate of hydraulic oil flowing from the main pump 14 to the hydraulic actuators and the flow rate of hydraulic oil flowing from the hydraulic actuators to the hydraulic oil tank. The hydraulic actuators include the boom cylinder 7, the arm cylinder 8, the bucket cylinder 9, the left traveling hydraulic motor 2ML, the right traveling hydraulic motor 2MR, and the turning hydraulic motor 2A.

The operation device 26 is a device used by the operator to operate actuators. The actuators include at least one of a hydraulic actuator and an electric actuator. In the present embodiment, the operation device 26 supplies hydraulic oil discharged by the pilot pump 15 to a pilot port of a corresponding control valve in the control valve 17 through a pilot line. The pressure of hydraulic oil supplied to each pilot port (pilot pressure) is a pressure corresponding to the direction of operation and the amount of operation of the operation device 26 for a corresponding hydraulic actuator. However, the operation device 26 may be of an electrical control type instead of the above-described pilot pressure type. In this case, the control valves in the control valve 17 may be electromagnetic solenoid spool valves.

The discharge pressure sensor 28 detects the discharge pressure of the main pump 14. In the present embodiment, the discharge pressure sensor 28 outputs the detected value to the controller 30.

The operating pressure sensor 29 detects the details of the operator's operation of the operation device 26. In the present embodiment, the operating pressure sensor 29 detects the direction of operation and the amount of operation of the operation device 26 corresponding to each actuator in the form of pressure (operating pressure), and outputs the detected value to the controller 30. The details of the operation of the operation device 26 may be detected using a sensor other than the operating pressure sensor.

The main pump 14 includes a left main pump 14L and a right main pump 14R. The left main pump 14L circulates hydraulic oil to the hydraulic oil tank through a left center bypass conduit 40L or a left parallel conduit 42L. The right main pump 14R circulates hydraulic oil to the hydraulic oil tank through a right center bypass conduit 40R or a right parallel conduit 42R.

The left center bypass conduit 40L is a hydraulic oil line that passes through the control valves 171, 173, 175L and 176L placed in the control valve 17. The right center bypass conduit 40R is a hydraulic oil line that passes through the control valves 172, 174, 175R and 176R placed in the control valve 17.

The control valve 171 is a spool valve that switches the flow of hydraulic oil in order to supply hydraulic oil discharged by the left main pump 14L to the left traveling hydraulic motor 2ML and to discharge hydraulic oil discharged by the left traveling hydraulic motor 2ML into the hydraulic oil tank.

The control valve 172 is a spool valve that switches the flow of hydraulic oil in order to supply hydraulic oil discharged by the right main pump 14R to the right traveling hydraulic motor 2MR and to discharge hydraulic oil discharged by the right traveling hydraulic motor 2MR into the hydraulic oil tank.

The control valve 173 is a spool valve that switches the flow of hydraulic oil in order to supply hydraulic oil discharged by the left main pump 14L to the turning hydraulic motor 2A and to discharge hydraulic oil discharged by the turning hydraulic motor 2A into the hydraulic oil tank.

The control valve 174 is a spool valve that switches the flow of hydraulic oil in order to supply hydraulic oil discharged by the right main pump 14R to the bucket cylinder 9 and to discharge hydraulic oil in the bucket cylinder 9 into the hydraulic oil tank.

The control valve 175L is a spool valve that switches the flow of hydraulic oil in order to supply hydraulic oil discharged by the left main pump 14L to the boom cylinder 7.

The control valve 175R is a spool valve that switches the flow of hydraulic oil in order to supply hydraulic oil discharged by the right main pump 14R to the boom cylinder 7 and to discharge hydraulic oil in the boom cylinder 7 into the hydraulic oil tank.

The control valve 176L is a spool valve that switches the flow of hydraulic oil in order to supply hydraulic oil discharged by the left main pump 14L to the arm cylinder 8 and to discharge hydraulic oil in the arm cylinder 8 into the hydraulic oil tank.

The control valve 176R is a spool valve that switches the flow of hydraulic oil in order to supply hydraulic oil discharged by the right main pump 14R to the arm cylinder 8 and to discharge hydraulic oil in the arm cylinder 8 into the hydraulic oil tank.

The left parallel conduit 42L is a hydraulic oil line parallel to the left center bypass conduit 40L. When the flow of hydraulic oil through the left center bypass conduit 40L is restricted or blocked by any of the control valves 171, 173 and 175L, the left parallel conduit 42L can supply hydraulic oil to a control valve further downstream. The right parallel conduit 42R is a hydraulic oil line parallel to the right center bypass conduit 40R. When the flow of hydraulic oil through the right center bypass conduit 40R is restricted or blocked by any of the control valves 172, 174 and 175R, the right parallel conduit 42R can supply hydraulic oil to a control valve further downstream.

The regulator 13 includes a left regulator 13L and a right regulator 13R. The left regulator 13L controls the discharge quantity of the left main pump 14L by adjusting the swash plate tilt angle of the left main pump 14L in accordance with the discharge pressure of the left main pump 14L. Specifically, the left regulator 13L reduces the discharge quantity of the left main pump 14L by adjusting the swash plate tilt angle of the left main pump 14L in accordance with an increase in the discharge pressure of the left main pump 14L. The same applies to the right regulator 13R. With this configuration, it is possible to prevent the absorbed power of the main pump 14 expressed by the product of the discharge pressure and the discharge quantity from exceeding the output power of the engine 11.

The operation device 26 includes a left operating lever 26L, a right operating lever 26R, and a traveling lever 26D. The traveling lever 26D includes a left traveling lever 26DL and a right traveling lever 26DR.

The left operating lever 26L is used for a turning operation and to operate the arm 5. When operated forward or backward, the left operating lever 26L causes a control pressure corresponding to the amount of lever operation to act on a pilot port of the control valve 176, using hydraulic oil discharged by the pilot pump 15. When operated rightward or leftward, the left operating lever 26L causes a control pressure corresponding to the amount of lever operation to act on a pilot port of the control valve 173, using hydraulic oil discharged by the pilot pump 15.

Specifically, when operated in an arm closing direction, the left operating lever 26L causes hydraulic oil to act on the right pilot port of the control valve 176L, and causes hydraulic oil to act on the left pilot port of the control valve 176R. Further, when operated in an arm opening direction, the left operating lever 26L causes hydraulic oil to act on the left pilot port of the control valve 176L, and causes hydraulic oil to act on the right pilot port of the control valve 176R. Further, when operated in a left turning direction, the left operating lever 26L causes, hydraulic oil to act on the left pilot port of the control valve 173. When operated in a right turning direction, the left operating lever 26L causes hydraulic oil to act on the right pilot port of the control valve 173.

The right operating lever 26R is used to operate the boom 4 and operate the bucket 6. When operated forward or backward, the right operating lever 26R causes a control pressure corresponding to the amount of lever operation to act on a pilot port of the control valve 175, using hydraulic oil discharged by the pilot pump 15. When operated rightward or leftward, the right operating lever 26R causes a control pressure corresponding to the amount of lever operation to act on a pilot port of the control valve 174, using hydraulic oil discharged by the pilot pump 15.

Specifically, when operated in a boom lowering direction, the right operating lever 26R causes hydraulic oil to act on the left pilot port of the control valve 175R. Further, when operated in a boom raising direction, the right operating lever 26R causes hydraulic oil to act on the right pilot port of the control valve 175L, and causes hydraulic oil to act on the left pilot port of the control valve 175R. Further, when operated in a bucket closing direction, the right operating lever 26R causes hydraulic oil to act on the right pilot port of the control valve 174. When operated in a bucket opening direction, the right operating lever 26R causes hydraulic oil to act on the left pilot port of the control valve 174.

The traveling lever 26D is used to operate the crawlers 1C. Specifically, the left traveling lever 26DL is used to operate the left crawler 1CL. The left traveling lever 26DL may be configured to operate together with a left traveling pedal. When operated forward or backward, the left traveling lever 26DL causes a control pressure corresponding to the amount of lever operation to act on a pilot port of the control valve 171, using hydraulic oil discharged by the pilot pump 15. The right traveling lever 26DR is used to operate the right crawler 1CR. The right traveling lever 26DR may be configured to operate together with a right traveling pedal. When operated forward or backward, the right traveling lever 26DR causes a control pressure corresponding to the amount of lever operation to act on a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs the detected value to the controller 30. The same applies to the discharge pressure sensor 28R.

The operating pressure sensor 29 includes operating pressure sensors 29LA, 29LB, 29RA, 29RB, 29DL, and 29DR. The operating pressure sensor 29LA detects the details of the operator's forward or backward operation of the left operating lever 26L in the form of pressure, and outputs the detected value to the controller 30. Examples of the details of the operator's operation include the direction of lever operation and the amount of lever operation (the angle of lever operation).

Likewise, the operating pressure sensor 29LB detects the details of the operator's rightward or leftward operation of the left operating lever 26L in the form of pressure, and outputs the detected value to the controller 30. The operating pressure sensor 29RA detects the details of the operator's forward or backward operation of the right operating lever 26R in the form of pressure, and outputs the detected value to the controller 30. The operating pressure sensor 29RB detects the details of the operator's rightward or leftward operation of the right operating lever 26R in the form of pressure, and outputs the detected value to the controller 30. The operating pressure sensor 29DL detects the details of the operator's forward or backward operation of the left traveling lever 26DL in the form of pressure, and outputs the detected value to the controller 30. The operating pressure sensor 29DR detects the details of the operator's forward or backward operation of the right traveling lever 26DR in the form of pressure, and outputs the detected value to the controller 30.

The controller 30 receives the output of the operating pressure sensor 29, and outputs a control command to the regulator 13 to change the discharge quantity of the main pump 14 as necessary. Furthermore, the controller 30 receives the output of a control pressure sensor 19 provided upstream of a throttle 18, and outputs a control command to the regulator 13 to change the discharge quantity of the main pump 14 as necessary. The throttle 18 includes a left throttle 18L and a right throttle 18R. The control pressure sensor 19 includes a left control pressure sensor 19L and a right control pressure sensor 19R.

In the left center bypass conduit 40L, the left throttle 18L is placed between the most downstream control valve 176L and the hydraulic oil tank. Therefore, the flow of hydraulic oil discharged by the left main pump 14L is restricted by the left throttle 18L. The left throttle 18L generates a control pressure for controlling the left regulator 13L. The left control pressure sensor 19L is a sensor that detects this control pressure, and outputs the detected value to the controller 30. The controller 30 controls the discharge quantity of the left main pump 14L by adjusting the swash plate tilt angle of the left main pump 14L in accordance with the control pressure. The controller 30 decreases the discharge quantity of the left main pump 14L as the control pressure increases, and increases the discharge quantity of the left main pump 14L as the control pressure decreases. The discharge quantity of the right main pump 14R is controlled in the same manner.

Specifically, as illustrated in FIG. 14, in the standby state where none of the hydraulic actuators in the shovel 100 is in operation, hydraulic oil discharged by the left main pump 14L passes through the left center bypass conduit 40L and reaches the left throttle 18L. The flow of hydraulic oil discharged by the left main pump 14L increases the control pressure generated upstream of the left throttle 18L. As a result, the controller 30 decreases the discharge quantity of the left main pump 14L to a minimum allowable discharge quantity to control pressure loss (pumping loss) during passage of the discharged hydraulic oil through the left center bypass conduit 40L. When a hydraulic actuator is operated, hydraulic oil discharged by the left main pump 14L flows into the operated hydraulic actuator through a control valve corresponding to the operated hydraulic actuator. The flow of hydraulic oil discharged by the left main pump 14L that reaches the left throttle 18L is reduced in amount or lost, so that the control pressure generated upstream of the left throttle 18L is reduced. As a result, the controller 30 increases the discharge quantity of the left main pump 14L to circulate sufficient hydraulic oil to the operated hydraulic actuator, thereby ensuring the driving of the operated hydraulic actuator. The controller 30 controls the discharge quantity of the right main pump 14R in the same manner.

With the configuration as described above, the hydraulic system of FIG. 7 can reduce unnecessary energy consumption in the main pump 14L in the standby state. The unnecessary energy consumption includes pumping loss that is caused in the center bypass conduit 40 by hydraulic oil discharged by the main pump 14. Furthermore, in the case of actuating a hydraulic actuator, the hydraulic system of FIG. 7 can ensure that necessary and sufficient hydraulic oil is supplied from the main pump 14 to the hydraulic actuator to be actuated.

Figure 8A:
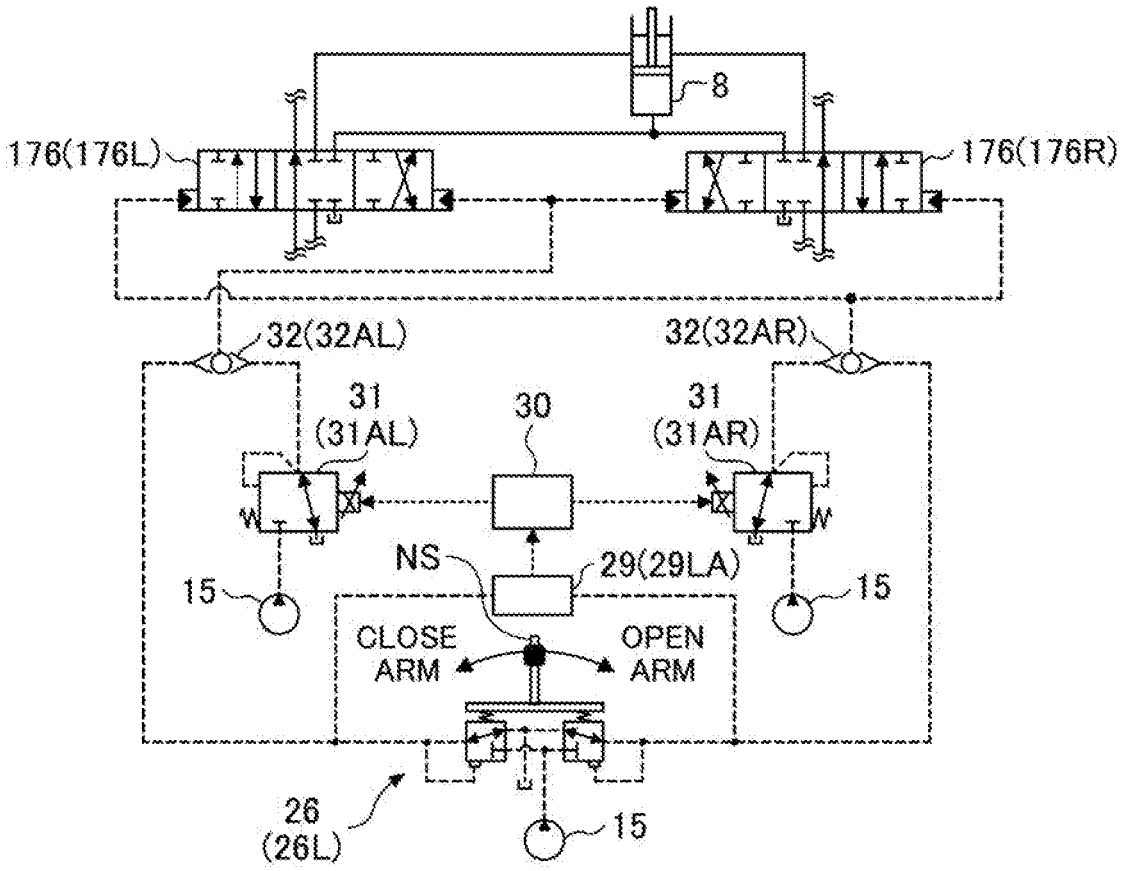
FIG. 8A is a diagram illustrating a part of the hydraulic system of FIG. 7.
Figure 8B:
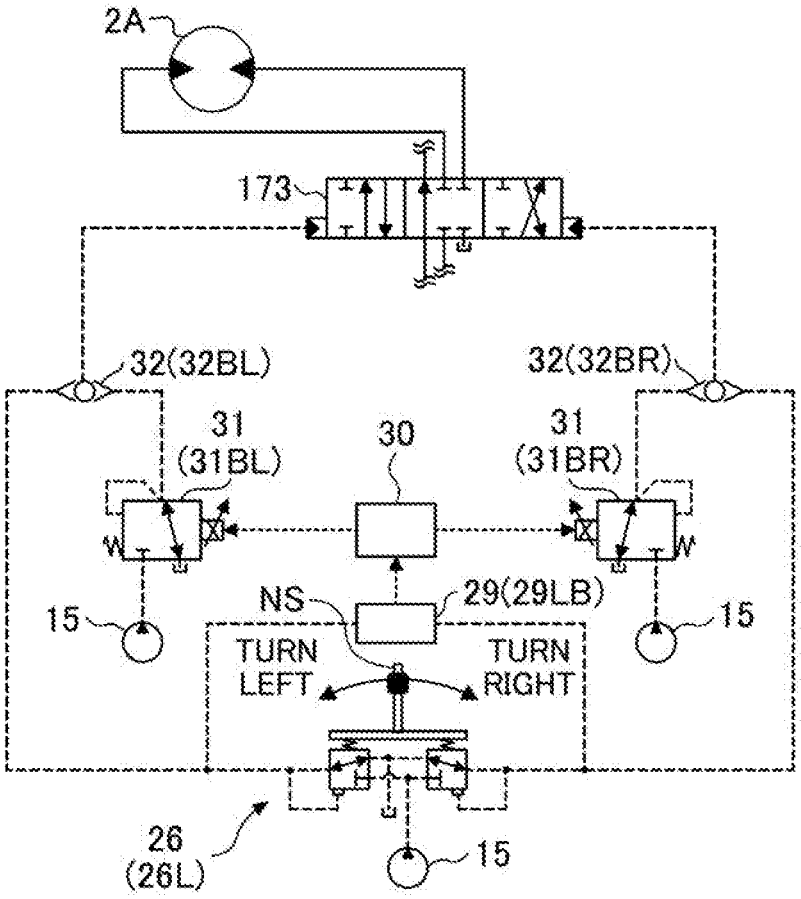
FIG. 8B is a diagram illustrating a part of the hydraulic system of FIG. 7.
Figure 8C:
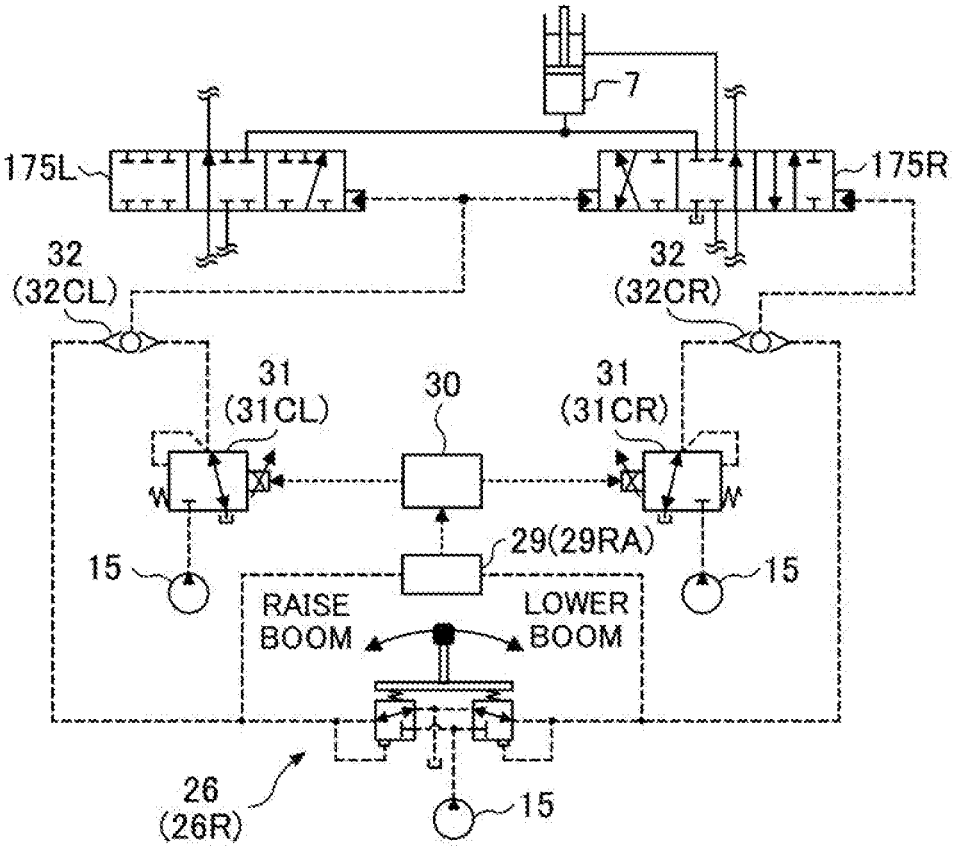
FIG. 8C is a diagram illustrating a part of the hydraulic system of FIG. 7.
Figure 8D:
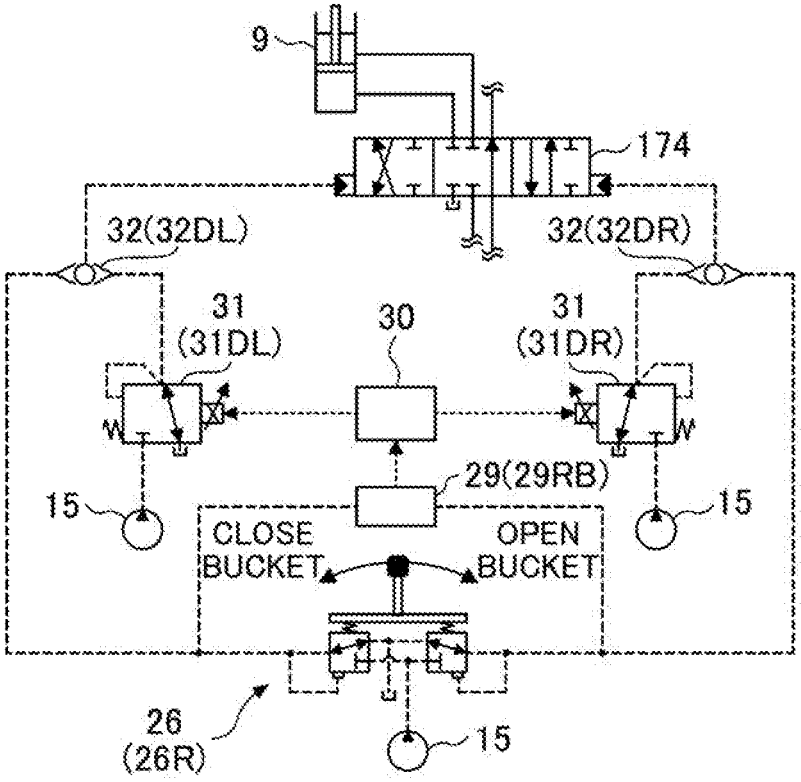
FIG. 8D is a diagram illustrating a part of the hydraulic system of FIG. 7.

Next, a configuration in which the controller 30 uses the machine control function to automatically operate an actuator will be described with reference to FIG. 8A through FIG. 8D. FIG. 8A through FIG. 8D are diagrams illustrating parts of the hydraulic system. Specifically, FIG. 8A is a diagram illustrating a part of the hydraulic system related to the operation of the arm cylinder 8. FIG. 8B is a diagram illustrating a part of the hydraulic system related to the operation of the turning hydraulic motor 2A. FIG. 8C is a diagram illustrating a part of the hydraulic system related to the operation of the boom cylinder 7. FIG. 8D is a diagram illustrating a part of the hydraulic system related to the operation of the bucket cylinder 9.

As illustrated in FIG. 8A through FIG. 8D, the hydraulic system includes a proportional valve 31 and a shuttle valve 32. The proportional valve 31 includes proportional valves 31AL through 31DL and 31AR through 31DR. The shuttle valve 32 includes shuttle valves 32AL through 32DL and 32AR through 32DR.

The proportional valve 31 operates as a control valve for machine control. The proportional valve 31 is placed in a conduit connecting the pilot pump 15 and the shuttle valve 32, and is configured to be able to change the flow area of the conduit. In the present embodiment, the proportional valve 31 operates in response to a control command output from the controller 30. Therefore, the controller 30 can supply hydraulic oil discharged by the pilot pump 15 to a pilot port of a corresponding control valve in the control valve 17 through the proportional valve 31 and the shuttle valve 32, independent of the operator's operation of the operation device 26.

The shuttle valve 32 includes two inlet ports and one outlet port. One of the two inlet ports is connected to the operation device 26, and the other is connected to the proportional valve 31. The outlet port is connected to a pilot port of a corresponding control valve in the control valve 17. Therefore, the shuttle valve 32 can cause the higher one of a pilot pressure generated by the operation device 26 and a pilot pressure generated by the proportional valve 31 to act on a pilot port of a corresponding control valve.

With the above-described configuration, the controller 30 can operate a hydraulic actuator corresponding to a specific operation device 26 even when no operation is performed on the specific operation device 26.

For example, as illustrated in FIG. BA, the left operating lever 26L is used to operate the arm 5. Specifically, the left operating lever 26L causes a pilot pressure corresponding to a forward or backward operation to act on a pilot port of the control valve 176, using hydraulic oil discharged by the pilot pump 15. More specifically, when operated in the arm closing direction (backward direction), the left operating lever 26L causes a pilot pressure corresponding to the amount of operation to act on the right pilot port of the control valve 176L and the left pilot port of the control valve 176R. Further, when operated in the arm opening direction (forward direction), the left operating lever 26L causes a pilot pressure corresponding to the amount of operation to act on the left pilot port of the control valve 176L and the right pilot port of the control valve 176R.

The left operating lever 26L is provided with a switch NS. In the present embodiment, the switch NS is a push button switch. The operator can operate the left operating lever 26L while pressing the switch NS. The switch NS may be provided on the right operating lever 26R or at a different position in the cabin 10.

The operating pressure sensor 29LA detects the details of the operator's forward or backward operation of the left operating lever 26L in the form of pressure, and outputs the detected value to the controller 30.

The proportional valve 31AL operates in response to a current command output from the controller 30. The proportional valve 31AL controls a pilot pressure generated by hydraulic oil introduced to the right pilot port of the control valve 176L and the left pilot port of the control valve 176R from the pilot pump 15 through the proportional valve 31AL and the shuttle valve 32AL. The proportional valve 31AR operates in response to a current command output from the controller 30. The proportional valve 31AR controls a pilot pressure generated by hydraulic oil introduced to the left pilot port of the control valve 176L and the right pilot port of the control valve 176R from the pilot pump 15 through the proportional valve 31AR and the shuttle valve 32AR. The proportional valves 31AL and 31AR can control the pilot pressure such that the control valves 176L and 176R can stop at a desired valve position.

With the above-described configuration, the controller 30 can supply hydraulic oil, discharged by the pilot pump 15, to the right pilot port of the control valve 176L and the left pilot port of the control valve 176R through the proportional valve 31AL and the shuttle valve 32AL, independent of the operator's arm closing operation. That is, the arm 5 can be automatically closed. Further, the controller 30 can supply hydraulic oil, discharged by the pilot pump 15, to the left pilot port of the control valve 176L and the right pilot port of the control valve 176R through the proportional valve 31AR and the shuttle valve 32AR, independent of the operator's arm opening operation. That is, the arm 5 can be automatically opened.

Further, as illustrated in FIG. 8B, the left operating lever 26L is also used to operate the turning mechanism 2. Specifically, the left operating lever 26L causes a pilot pressure corresponding to a rightward or leftward operation to act on a pilot port of the control valve 173, using hydraulic oil discharged by the pilot pump 15. More specifically, when operated in the left turning direction (leftward direction), the left operating lever 26L causes a pilot pressure corresponding to the amount of operation to act on the left pilot port of the control valve 173. Furthermore, when operated in the right turning direction (rightward direction), the left operating lever 26L causes a pilot pressure corresponding to the amount of operation to act on the right pilot port of the control valve 173.

The operating pressure sensor 29LB detects the details of the operator's rightward or leftward operation of the left operating lever 26L in the form of pressure, and outputs the detected value to the controller 30.

The proportional valve 31BL operates in response to a current command output from the controller 30. The proportional valve 31BL controls a pilot pressure generated by hydraulic oil introduced to the left pilot port of the control valve 173 from the pilot pump 15 through the proportional valve 31BL and the shuttle valve 32BL. The proportional valve 31BR operates in response to a current command output from the controller 30. The proportional valve 31BR controls a pilot pressure generated by hydraulic oil introduced to the right pilot port of the control valve 173 from the pilot pump 15 through the proportional valve 31BR and the shuttle valve 32BR. The proportional valves 31BL and 31BR can control the pilot pressure such that the control valve 173 can stop at a desired valve position.

With the above-described configuration, the controller 30 can supply hydraulic oil, discharged by the pilot pump 15, to the left pilot port of the control valve 173 through the proportional valve 31BL and the shuttle valve 32BL, independent of the operator's left turning operation. That is, the turning mechanism 2 can be automatically turned counterclockwise. Furthermore, the controller 30 can supply hydraulic oil, discharged by the pilot pump 15, to the right pilot port of the control valve 173 through the proportional valve 31BR and the shuttle valve 32BR, independent of the operator's right turning operation. That is, the turning mechanism 2 can be automatically turned clockwise.

As illustrated in FIG. 8C, the right operating lever 26R is used to operate the boom 4. Specifically, the right operating lever 26R causes a pilot pressure corresponding to a forward or backward operation to act on a pilot port of the control valve 175, using hydraulic oil discharged by the pilot pump 15. More specifically, when operated in the boom raising direction (backward direction), the right operating lever 26R causes a pilot pressure corresponding to the amount of operation to act on the right pilot port of the control valve 175L and the left pilot port of the control valve 175R. Furthermore, when operated in the boom lowering direction (forward direction), the right operating lever 26R causes a pilot pressure corresponding to the amount of operation to act on the right pilot port of the control valve 175R.

The operating pressure sensor 29RA detects the details of the operator's forward or backward operation of the right operating lever 26R in the form of pressure, and outputs the detected value to the controller 30.

The proportional valve 31CL operates in response to a current command output from the controller 30. The proportional valve 31CL controls a pilot pressure generated by hydraulic oil introduced to the right pilot port of the control valve 175L and the left pilot port of the control valve 175R from the pilot pump 15 through the proportional valve 31CL and the shuttle valve 32CL. The proportional valve 31CR operates in response to a current command output from the controller 30. The proportional valve 31CR controls a pilot pressure generated by hydraulic oil introduced to the left pilot port of the control valve 175L and the right pilot port of the control valve 175R from the pilot pump 15 through the proportional valve 31CR and the shuttle valve 32CR. The proportional valves 31CL and 31CR can control the pilot pressure such that the control valves 175L and 175R can stop at a desired valve position.

With the above-described configuration, the controller 30 can supply hydraulic oil, discharged by the pilot pump 15, to the right pilot port of the control valve 175L and the left pilot port of the control valve 175R through the proportional valve 31CL and the shuttle valve 32CL, independent of the operator's boom raising operation. That is, the boom 4 can be automatically raised. Furthermore, the controller 30 can supply hydraulic oil, discharged by the pilot pump 15, to the right pilot port of the control valve 175R through the proportional valve 31CR and the shuttle valve 32CR, independent of the operator's boom lowering operation. That is, the boom 4 can be automatically lowered.

As illustrated in FIG. 8D, the right operating lever 26R is also used to operate the bucket 6. Specifically, the right operating lever 26R causes a pilot pressure corresponding to a rightward or leftward operation to act on a pilot port of the control valve 174, using hydraulic oil discharged by the pilot pump 15. More specifically, when operated in the bucket closing direction (leftward direction), the right operating lever 26R causes a pilot pressure corresponding to the amount of operation to act on the left port of the control valve 174. Furthermore, when operated in the bucket opening direction (rightward direction), the right operating lever 26R causes a pilot pressure corresponding to the amount of operation to act on the right pilot port of the control valve 174.

The operating pressure sensor 29RB detects the details of the operator's rightward or leftward operation of the right operating lever 26R in the form of pressure, and outputs the detected value to the controller 30.

The proportional valve 31DL operates in response to a current command output from the controller 30. The proportional valve 31DL controls a pilot pressure generated by hydraulic oil introduced to the left pilot port of the control valve 174 from the pilot pump 15 through the proportional valve 31DL and the shuttle valve 32DL. The proportional valve 31DR operates in response to a current command output from the controller 30. The proportional valve 31DR controls a pilot pressure generated by hydraulic oil introduced to the right pilot port of the control valve 174 from the pilot pump 15 through the proportional valve 31DR and the shuttle valve 32DR. The proportional valves 31DL and 31DR can control the pilot pressure such that the control valve 174 can stop at a desired valve position.

With the above-described configuration, the controller 30 can supply hydraulic oil, discharged by the pilot pump 15, to the left pilot port of the control valve 174 through the proportional valve 31DL and the shuttle valve 32DL, independent of the operator's bucket closing operation. That is, the bucket 6 can be automatically closed. Furthermore, the controller 30 can supply hydraulic oil, discharged by the pilot pump 15, to the right pilot port of the control valve 174 through the proportional valve 31DR and the shuttle valve 32DR, independent of the operator's bucket opening operation. That is, the bucket 6 can be automatically opened.

The shovel 100 may include a configuration in which the lower traveling body 1 automatically travels forward and backward. In this case, a part of the hydraulic system related to the operation of the left travel hydraulic motor 2ML and a part of the hydraulic system related to the operation of the right traveling hydraulic motor 2MR may be configured in the same manner as the part of the hydraulic system related to the operation of the boom cylinder 7.

In FIG. 2, FIG. 7, and FIG. 8A through FIG. 8D, a hydraulic operating lever including a hydraulic pilot circuit has been described. However, an electrical operating lever including an electrical pilot circuit may be employed instead of the hydraulic operating lever. In this case, the amount of lever operation of the electrical operating lever is input to the controller 30 as an electrical signal. Further, a solenoid valve is placed between the pilot pump 15 and a pilot port of each control valve. The solenoid valve is configured to operate in response to an electrical signal from the controller 30. With this configuration, when a manual operation using the electrical operating lever is performed, the controller 30 can move each control valve by controlling the solenoid valve using an electrical signal corresponding to the amount of lever operation so as to increase or decrease a pilot pressure. Note that each of the control valves may be constituted of a solenoid spool valve. In this case, the solenoid spool valve operates in response to an electrical signal from the controller 30 corresponding to the amount of lever operation of the electrical operating lever.

Figure 9:
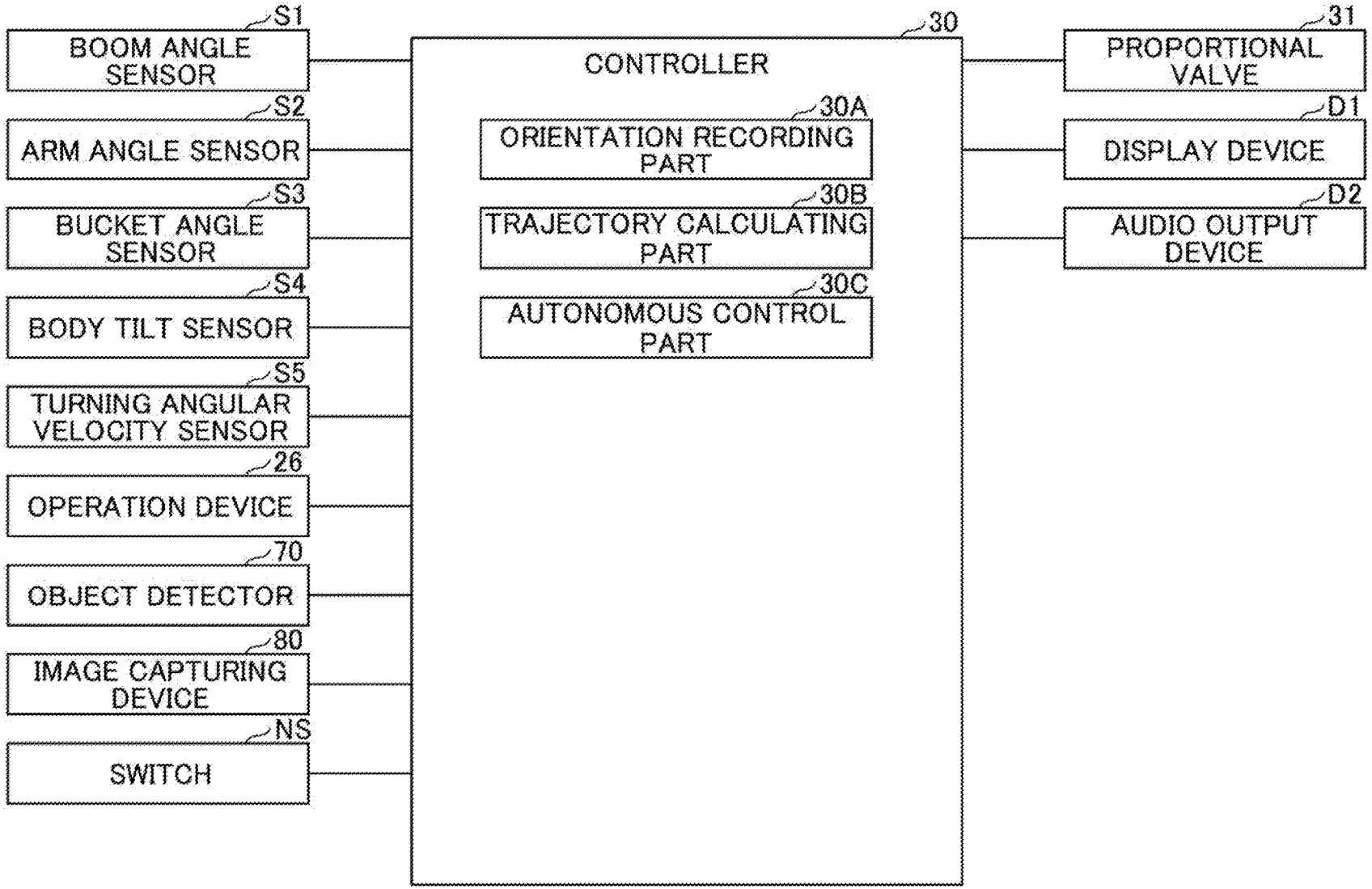
FIG. 9 is a functional block diagram of the controller.

Next, functions of the controller 30 will be described with reference to FIG. 9. FIG. 9 is a functional block diagram of the controller 30. In the example of FIG. 9, the controller 30 is configured to receive signals output from the orientation detector, the operation device 26, the object detector 70, the image capturing device 80, the switch NS, and the like, execute various computations, and output control signals to the proportional valve 31, the display device D1, the audio output device D2, and the like. The orientation detector includes the boom angle sensor S1, the arm angle sensor S2, the bucket angle sensor S3, the body tilt sensor S4, and the turning angular velocity sensor S5. The controller 30 includes an orientation recording part 30A, a trajectory calculating part 30B, and an autonomous control part 30C as functional elements. The functional elements may be constituted of hardware, or may constituted of software.

The orientation recording part 30A is configured to record information related to the orientation of the shovel 100. In the present embodiment, the orientation recording part 30A records, in a random-access memory (RAM), information related to the orientation of the shovel 100 when the switch NS is pressed. Specifically, the orientation recording part 30A records the output of the orientation detector each time the switch NS is pressed. The orientation recording part 30A may be configured to start recording when the switch NS is pressed at a first time point, and stop the recording when the switch NS is pressed at a second time point. In this case, the orientation recording part 30A may repeatedly record information related to the orientation of the shovel 100 in a predetermined control cycle from the first time point to the second time point.

The trajectory calculating part 30B is configured to calculate a target trajectory that is a trajectory followed by a predetermined part of the shovel 100 when the shovel 100 is autonomously operated. For example, the predetermined part may be a predetermined point on the back surface of the bucket 6. In the present embodiment, the trajectory calculating part 30B calculates a target trajectory to be used by the autonomous control part 30C when causing the shovel 100 to autonomously operate. Specifically, the trajectory calculating part 30B calculates a target trajectory based on information related to the orientation of the shovel 100 recorded by the orientation recording part 30A.

The trajectory calculating part 30B may calculate a target trajectory based on the output of the LIDAR serving as the object detector 70, which is an example of the surroundings monitoring device. Alternatively, the trajectory calculating part 30B may calculate a target trajectory based on the output of the image capturing device 80, which is another example of the surroundings monitoring device. Alternatively, the trajectory calculating part 30B may calculate a target trajectory based on information related to the orientation of the shovel 100 recorded by the orientation recording part 30A and the output of the surroundings monitoring device.

The autonomous control part 30C is configured to cause the shovel 100 to autonomously operate. In the present embodiment, the autonomous control part 30C is configured to move a predetermined part of the shovel 100 along a target trajectory calculated by the trajectory calculating part 30B when a predetermined start condition is satisfied. Specifically, when the operation device 26 is operated with the switch NS being pressed, the autonomous control part 30C causes the shovel 100 to autonomously operate such that a predetermined part of the shovel 100 moves along a target trajectory. For example, when the left operating lever 26L is operated in the right turning direction and the right operating lever 26R is operated in the boom raising direction with the switch NS being pressed, the autonomous control part 30C may cause the shovel 100 to autonomously operate such that the lower end of the bucket 6 moves along a target trajectory. In this case, each of the left operating lever 26L and the right operating lever 26R may be operated with any amount of lever operation. Accordingly, the operator can move the lower end of the bucket 6 along the target trajectory at a predetermined movement speed, without paying attention to the amount of lever operation. Alternatively, the movement speed of the bucket 6 may be changed in accordance with the amount of lever operation of the left operating lever 26L or the right operating lever 26R.

The autonomous control part 30C may be configured to control at least one of the boom cylinder 7 and the turning hydraulic motor 2A, such that the lower end of the bucket 6 moves along the target trajectory. For example, the autonomous control part 30C may semi-automatically control the turning speed of the upper turning body 3 in accordance with the rising speed of the boom 4. For example, the autonomous control part 30C may increase the turning speed of the upper turning body 3 as the rising speed of the boom 4 increases. In this case, while the boom 4 rises at a speed corresponding to the amount of lever operation of the right operating lever 26R in the boom raising direction, the upper turning body 3 may turn at a speed different from a speed corresponding to the amount of lever operation of the left operating lever 26L in the right turning direction.

Alternatively, the autonomous control part 30C may semi-automatically control the rising speed of the boom 4 in accordance with the turning speed of the upper turning body 3. For example, the autonomous control part 30C may increase the rising speed of the boom 4 as the turning speed of the upper turning body 3 increases. In this case, while the upper turning body 3 may be turned at a speed corresponding to the amount of lever operation of the left operating lever 26L in the right turning direction, the boom 4 may be raised at a speed different from a speed corresponding to the amount of lever operation of the right operating lever 26R in the boom raising direction.

Alternatively, the autonomous control part 30C may semi-automatically control both the turning speed of the upper turning body 3 and the rising speed of the boom 4. In this case, the upper turning body 3 may be turned at a speed different from a speed corresponding to the amount of lever operation of the left operating lever 26L in the right turning direction: Likewise, the boom 4 may be raised at a speed different from a speed corresponding to the amount of lever operation of the right operating lever 26R in the boom raising direction.

The autonomous control part 30C may correct a target trajectory in accordance with the state of the dump truck 60. For example, the autonomous control part 30C may change a target trajectory in accordance with the opening/closing state of the left cover 63L or the opening/closing state of the right cover 63R.

The autonomous control part 30C may set a target trajectory by taking into account the surrounding situation in addition to the state of the dump truck 60. For example, the autonomous control part 30C may set a target trajectory such that the excavation attachment AT does not contact an object such as a wall while the upper turning body 3 is turned. Alternatively, the autonomous control part 30C may set a target trajectory, such that the excavation attachment AT does not extend over a guardrail to the road during a turning operation when the shovel 100 is in operation on a sidewalk.

Figure 10:
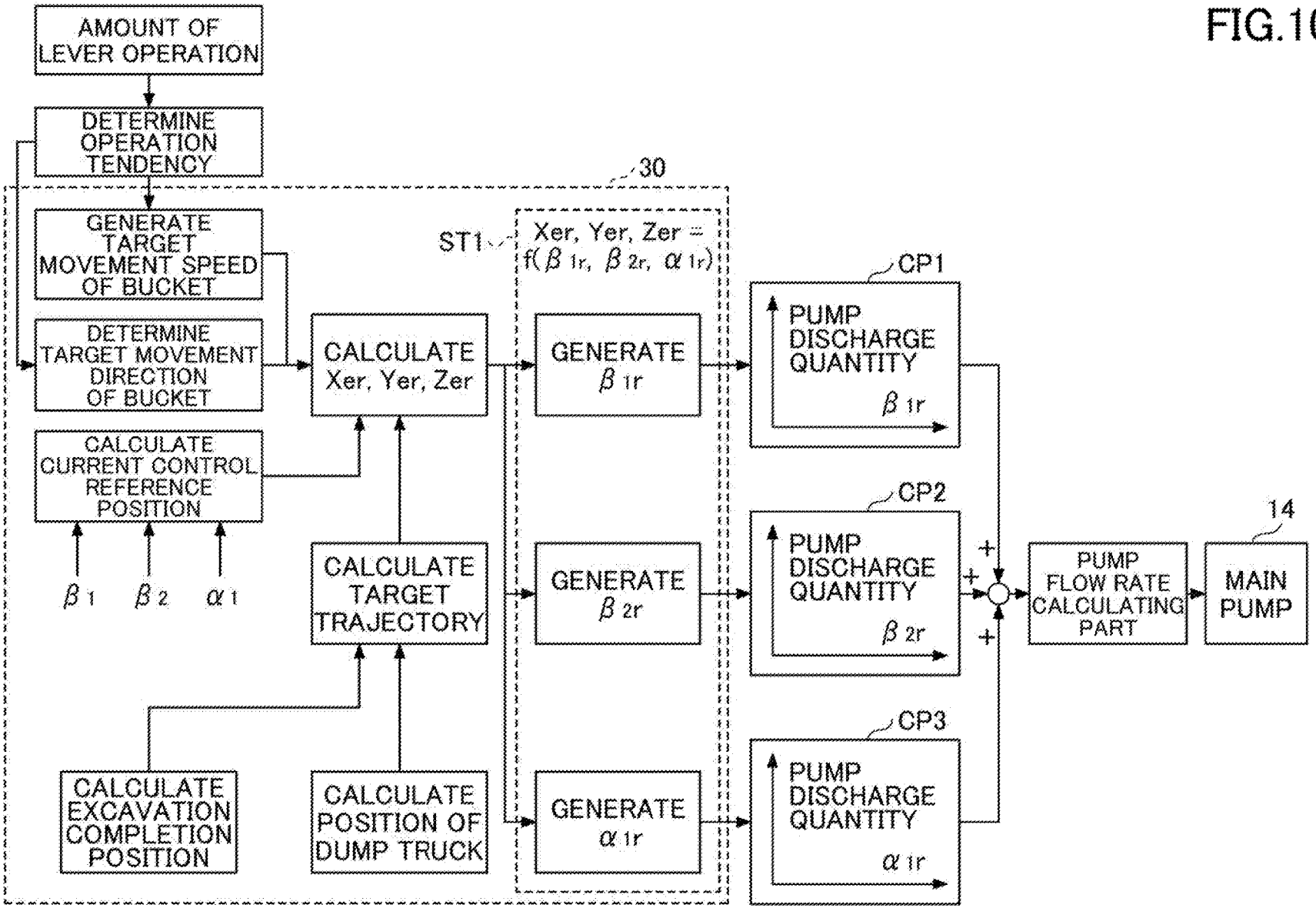
FIG. 10 is a block diagram illustrating an autonomous control function.
Figure 11:
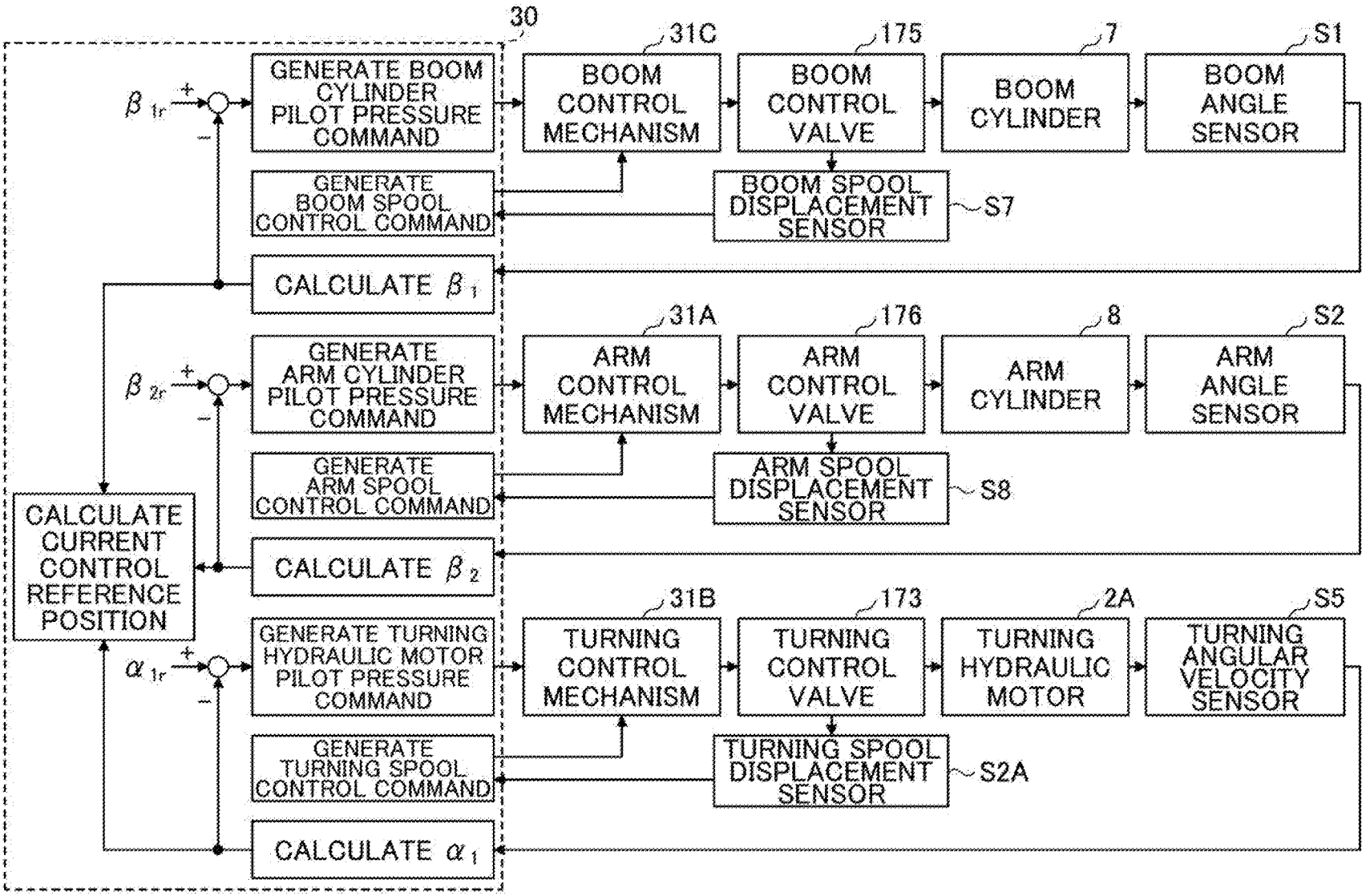
FIG. 11 is a block diagram illustrating the autonomous control function.

Next, an example of the controller 30's function of autonomously controlling the movement of the attachment (hereinafter referred to as an "autonomous control function") will be described with reference to FIG. 10 and FIG. 11. FIG. 10 and FIG. 11 are block diagrams illustrating the autonomous control function.

First, as illustrated in FIG. 10, the controller 30 generates a target movement speed of the bucket based on the operation tendency, and determines the target movement speed of the bucket. For example, the operation tendency may be determined based on the amount of lever operation. The target movement speed of the bucket is a target value of the movement speed of a reference control point on the bucket 6. A target movement direction of the bucket is a target value of the movement direction of the reference control point on the bucket 6. For example, the reference control point may be a predetermined point on the back surface of the bucket 6. In FIG. 10, the current control reference position is the current position of the reference control point. For example, the current control reference position is calculated based on the boom angle $\beta_1$, the arm angle $\beta_2$, and a turning angle $\alpha_1$. The controller 30 may further use the bucket angle $\beta_3$ to calculate the current control reference position.

Then, the controller 30 calculates the three-dimensional coordinates (Xer, Yer, Zer) of the control reference position after the elapse of a unit time, based on the target movement speed of the bucket, the target movement direction of the bucket, and the three-dimensional coordinates (Xe, Ye, and Ze) of the current control reference position. For example, the three-dimensional coordinates (Xer, Yer, Zer) of the control reference position after the elapse of the unit time may be coordinates on a target trajectory. For example, the unit time may be a time equal to an integral multiple of a control cycle. The target trajectory may be a target trajectory related to loading work for loading soil into a dump truck. In this case, the target trajectory may be calculated based on the position of the dump truck and an excavation completion position. The excavation completion position is the position of the reference control point when excavation is completed. For example, the position of the dump truck may be calculated based on the output of at least one of the object detector 70 and the image capturing device 80. For example, the excavation completion position may be calculated based on the output of the orientation detector.

Thereafter, the controller 30 generates command values $\beta_{1r}$ and $\beta_{2r}$ related to pivot operations of the boom 4 and the arm 5 and a command value $\alpha_{1r}$ related to a turning operation of the upper turning body 3, based on the calculated three-dimensional coordinates (Xer, Yer, Zer). For example, the command value $\beta_{1r}$ represents the boom angle $\beta_1$ when the control reference position matches the three-dimensional coordinates (Xer, Yer, Zer). Similarly, the command value $\beta_{2r}$ represents the arm angle $\beta_2$ when the control reference position matches the three-dimensional coordinates (Xer, Yer, Zer), and the command value $\alpha_{1r}$ represents the turning angle $\alpha_1$ when the control reference position matches the three-dimensional coordinates (Xer, Yer, Zer).

Thereafter, as illustrated in FIG. 11, the controller 30 operates the boom cylinder 7, the arm cylinder 8, and the turning hydraulic motor 2A, such that the boom angle $\beta_1$, the arm angle $\beta_2$, and the turning angle $\alpha_1$ match the generated command values $\beta_{1r}$, $\beta_{2r}$, and $\alpha_{1r}$, respectively. Note that the turning angle $\alpha_1$ may be calculated based on the output of the turning angular velocity sensor S5, for example.

Specifically, the controller 30 generates a boom cylinder pilot pressure command corresponding to a difference $\Delta\beta_1$ between the current value of the boom angle $\beta_1$ and the command value $\beta_{1r}$. Then, the controller 30 outputs a control current corresponding to the boom cylinder pilot pressure command to a boom control mechanism 31C. The boom control mechanism 31C is configured such that a pilot pressure, which is commensurate with the control current corresponding to the boom cylinder pilot pressure command, acts on the control valve 175 serving as a boom control valve. The boom control mechanism 31C may be the proportional valve 31CL and the proportional valve 31CR of FIG. 8C.

Thereafter, the control valve 175, which has received the pilot pressure generated by the boom control mechanism 31C, supplies hydraulic oil discharged by the main pump 14 to the boom cylinder 7 in a flow direction and at a flow rate corresponding to the pilot pressure.

At this time, the controller 30 may generate a boom spool control command based on the amount of displacement of a spool constituting the control valve 175 detected by a boom spool displacement sensor S7. The boom spool displacement sensor S7 is a sensor that detects the amount of displacement of the spool constituting the control valve 175. The controller 30 may output a control current corresponding to the boom spool control command to the boom control mechanism 31C. In this case, the boom control mechanism 31C causes a pilot pressure, which is commensurate with the control current corresponding to the boom spool control command, to act on the control valve 175.

The boom cylinder 7 extends or retracts by the hydraulic oil supplied via the control valve 175. The boom angle sensor S1 detects the boom angle $\beta_1$ of the boom 4 that is moved by the extending or retracting boom cylinder 7.

Thereafter, the controller 30 feeds back the boom angle $\beta_1$ detected by the boom angle sensor S1. The boom angle $\beta_1$ is used as the current value of the boom angle $\beta_1$ when the boom cylinder pilot pressure command is generated.

The above description relates to the operation of the boom 4 based on the command value $\beta_{1r}$, but can also be applied to the operation of the arm 5 based on the command value $\beta_{2r}$ and the turning operation of the upper turning body 3 based on the command value $\alpha_{1r}$. An arm control mechanism 31A is configured such that a pilot pressure, which is commensurate with a control current corresponding to an arm cylinder pilot pressure command, acts on the control valve 176 serving as an arm control valve. The arm control mechanism 31A may be the proportional valve 31AL and the proportional valve 31AR of FIG. 8A. Further, a turning control mechanism 31B is configured such that a pilot pressure, which is commensurate with a control current corresponding to a turning hydraulic motor pilot pressure command, acts on the control valve 173 serving as a turning control valve. The turning control mechanism 31B may be the proportional valve 31BL and the proportional valve 31BR of FIG. 8B. An arm spool displacement sensor S8 is a sensor that detects the amount of displacement of a spool constituting the control valve 176. A turning spool displacement sensor S2A is a sensor that detects the amount of displacement of a spool constituting the control valve 173.

As illustrated in FIG. 10, the controller 30 may use pump discharge quantity deriving parts CP1, CP2, and CP3 to derive pump discharge quantities based on the values $\beta_{1r}$, $\beta_{2r}$, and $\alpha_{1r}$. In the present embodiment, the pump discharge quantity deriving parts CP1, CP2, and CP3 derive pump discharge quantities based on the values $\beta_{1r}$, $\beta_{2r}$, and $\alpha_{1r}$ by referring to a pre-registered reference table. The pump discharge quantities derived by the pump discharge quantity deriving parts CP1, CP2, and CP3 are summed and input into a pump flow rate calculating part as a total pump discharge quantity. The pump flow rate calculating part controls the discharge quantity of the main pump 14 based on the total pump discharge quantity that has been input. In the present embodiment, the pump flow rate calculating part controls the discharge quantity of the main pump 14 by changing the swash plate tilt angle of the main pump 14 in accordance with the total pump discharge quantity.

As described above, the controller 30 can control the opening of each of the control valve 175 serving as the boom control valve, the control valve 176 serving as the arm control valve, and the control valve 173 serving as the turning control valve while controlling the discharge quantity of the main pump 14 at the same time. Thus, the controller 30 can supply an appropriate amount of hydraulic oil to each of the boom cylinder 7, the arm cylinder 8, and the turning hydraulic motor 2A.

Further, the controller 30 sets the calculation of the three-dimensional coordinates (Xer, Yer, Zer), the generation of the command values $\beta_{1r}$, $\beta_{2r}$, and $\alpha_{1r}$, and the determination of the discharge quantity of the main pump 14 as one control cycle, and performs autonomous control by repeating the control cycle. Further, the controller 30 can improve the accuracy of autonomous control by performing feedback control of the control reference position based on the output of each of the boom angle sensor S1, the arm angle sensor S2, and the turning angular velocity sensor S5. Specifically, the controller 30 can improve the accuracy of autonomous control by performing feedback control of the flow rate of hydraulic oil flowing into each of the boom cylinder 7, the arm cylinder 8, and the turning hydraulic motor 2A. Note that the controller 30 may control the flow rate of hydraulic oil flowing into the bucket cylinder 9 in the same manner.

Figure 12A:
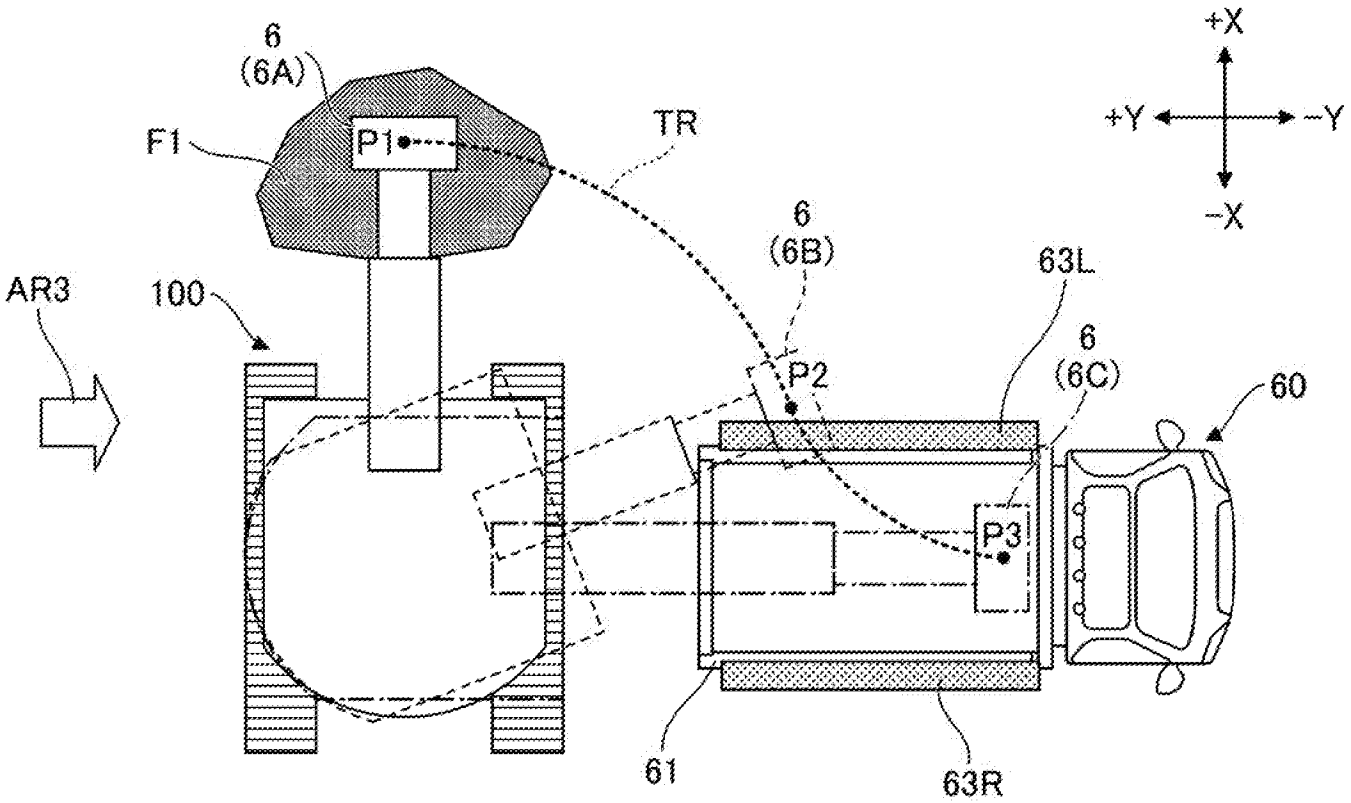
FIG. 12A is a diagram illustrating an example of a work site situation.
Figure 12B:
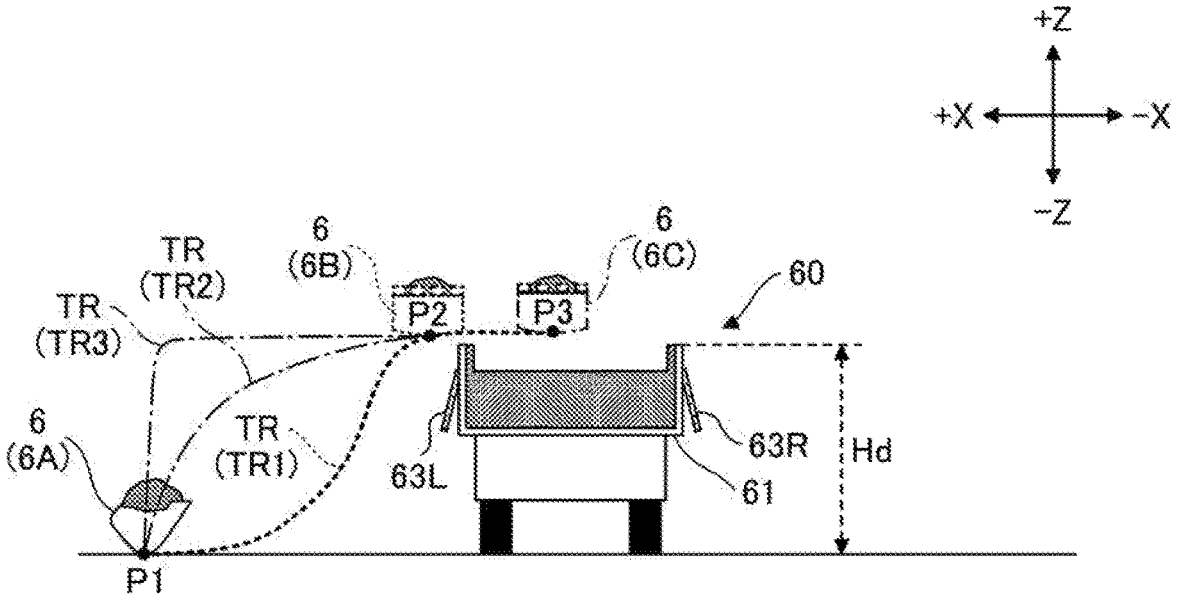
FIG. 12B is a diagram illustrating the example of the work site situation.
Figure 12C:
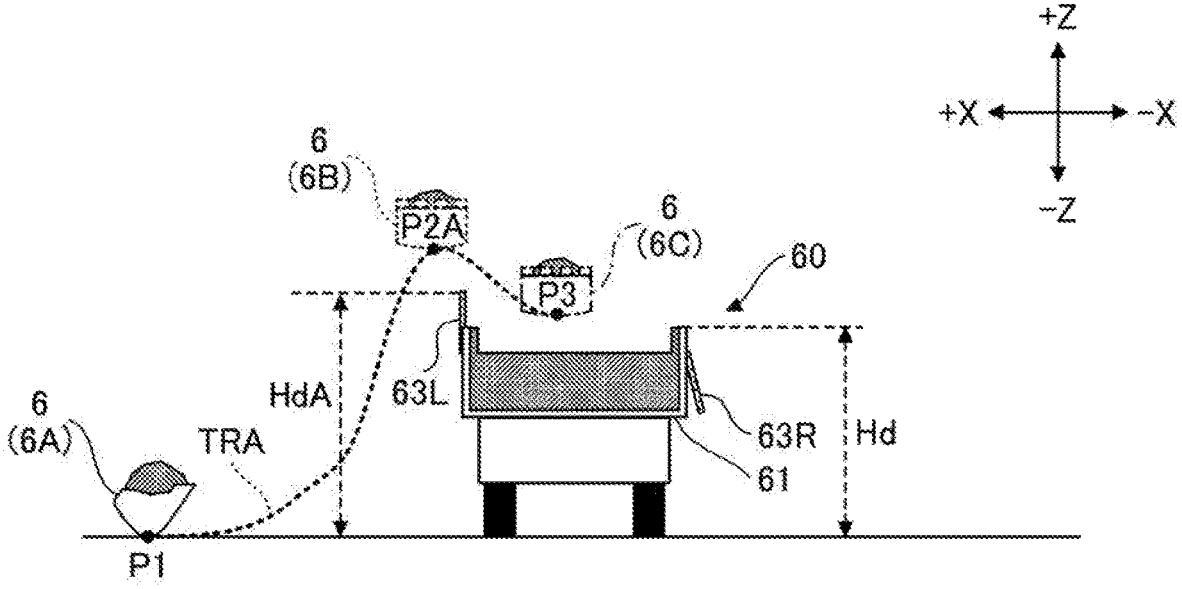
FIG. 12C is a diagram illustrating the example of the work site situation.

Next, an example of setting a target trajectory will be described with reference to FIG. 12A through FIG. 12A through FIG. 12C. FIG. 12A through FIG. 12C illustrate an example of a work site situation where the shovel 100 performs loading work into the dump truck 60. Specifically, FIG. 12A is a top view of a work site. FIG. 12B and FIG. 12C are diagrams illustrating the work site as viewed in a direction indicated by an arrow AR3 of FIG. 12A. For clarification purposes, the shovel 100 (except for the bucket 6) is not depicted in FIG. 12B and FIG. 12C. FIG. 12B indicates that the left cover 63L is fully open, and FIG. 12C indicates that the left cover 63L is in an upright position.

In FIG. 12A, the shovel 100 drawn by a solid line represents a state where an excavation operation is completed, the shovel 100 drawn by a dashed line represents a state where a turning operation is currently performed, and the shovel 100 drawn by a dash-dot line represents a state before a soil discharging operation is started. Similarly, in FIG. 12B and FIG. 12C, a bucket 6A drawn by a solid line represents a state where the excavation operation is completed, a bucket 6B drawn by a dashed line represents a state where the turning operation is currently performed, and a bucket 6C drawn by a dash-dot line represents a state before the soil discharging operation is started. A thick dotted line in each of FIG. 12A through FIG. 12C represents a target trajectory TR followed by a predetermined point on the back surface of the bucket 6.

The trajectory calculating part 30B calculates a target trajectory TR based on the output of the object detector 70 such that the bucket 6 is moved above the bed 61 of the dump truck 60 at the height Hd without contacting the bed 61 of the dump truck 60. Alternatively, the trajectory calculating part 30B may calculate a target trajectory based on the output of the image capturing device 80, which is another example of the surroundings monitoring device. Alternatively, the trajectory calculating part 30B may calculate a target trajectory based on information related to the orientation of the shovel 100, recorded by the orientation recording part 30A, and the output of the surroundings monitoring device.

The trajectory calculating part 30B may calculate a plurality of target trajectories TR such that the operator can select one of the plurality of target trajectories TR. FIG. 12B denotes three target trajectories TR1 through TR3 calculated by the trajectory calculating part 30B. The two target trajectories TR2 and TR3 indicated by dash-dot lines are calculated together with the target trajectory TR1 selected by the operator. That is, the target trajectories TR2 and TR3 are presented to the operator together with the target trajectory TR1, but are not selected by the operator. In the example illustrated in FIG. 12B, the trajectory calculating part 30B calculates the target trajectory TR1 that prioritizes a right turning operation, the target trajectory TR2 that prioritizes the balance between a right turning operation and a boom raising operation, and the target trajectory TR3 that prioritizes a boom raising operation. The operator may use an input device such as a touch panel to select one of the three target trajectories while looking at an image, including a graphic shape of the dump truck 60 and lines representing the three target trajectories, displayed on the display device D1 by the trajectory calculating part 30B.

Accordingly, in the present embodiment, when the operator presses the switch NS to perform a boom raising and turning operation, the controller 30 performs a combined operation including a right turning operation based on the created target trajectory TR. Specifically, the controller 30 performs a combined operation including a right turning operation and at least one of a boom raising operation and an arm closing operation, until the shovel 100 is oriented as indicated by the dashed line, namely until the lower end of the bucket 6 reaches a point P2. The combined operation may include an opening/closing operation of the bucket 6. In this manner, the bucket 6 can be moved above the bed 61 of the dump truck 60 at the height Hd without contacting the bed 61 of the dump truck 60.

Then, the controller 30 performs a combined operation including an arm opening operation and a right turning operation until the shovel 100 is oriented as indicated by the dash-dot line, namely until the lower end of the bucket 6 reaches a point P3. The combined operation may include at least one of a boom lowering operation and an opening/closing operation of the bucket 6. In this manner, soil can be discharged at the front side (cabin side) of the bed 61 of the dump truck 60.

In the above-described example, the controller 30 performs the boom raising and turning operation when the operator presses the switch NS. However, the controller 30 may perform the boom raising and turning operation when the operator tilts the left operating lever 26L toward a direction of the dump truck 60 while pressing the switch NS.

The controller 30 uses the calculated target trajectory TR to perform the boom raising and turning by means of autonomous control. Specifically, the controller 30 automatically turns the turning mechanism 2 clockwise, such that a trajectory of the lower end of the bucket 6 is moved along the target trajectory TR while automatically raising the boom 4. In the present embodiment, the end position of the target trajectory TR is set such that the lower end of the bucket 6 is located directly above the bed 61 of the dump truck 60. Thus, at a time when the boom raising and turning by means of autonomous control is completed, the operator is required to only perform a bucket opening operation to discharge soil placed in the bucket 6 into the bed 61. In this case, the end position of the target trajectory TR may be calculated based on information related to the bucket 6 such as the volume of the bucket 6, and information related to the dump truck 60. Further, because the boom raising and turning operation is repeatedly performed, the end position of the target trajectory TR may be the same as the end position of the trajectory in the previous boom raising and turning operation. That is, the end position of the target trajectory TR may be the previous position of the lower end of the bucket 6.

When the boom raising and turning by means of autonomous control is completed, the operator manually discharges soil. In the present embodiment, the operator can discharge soil placed in the bucket 6 into the bed 61 by only performing a bucket opening operation.

After discharging the soil, the operator manually performs a boom lowering and turning operation. Next, the operator manually performs an excavation operation to load soil forming a bank F1 into the bucket 6 again. Then, when the excavation operation is completed, the operator starts a boom raising and turning operation by means of autonomous control again. The same applies to subsequent boom raising and turning operations.

In the present embodiment, the controller 30 is configured to change the end position of the target trajectory TR based on information related to the dump truck 60, each time a boom raising and turning operation by means of autonomous control is performed. Accordingly, the operator of the shovel 100 can discharge soil into the bed of the dump truck 60 at an appropriate position by only performing a bucket opening operation each time a boom raising and turning operation by means of autonomous control is completed.

Further, the controller 30 may change the target trajectory TR in accordance with the change in the state of the dump truck 60. For example, as illustrated in FIG. 12C, when the left cover 63L is changed from a full-open state to an upright state during an excavation operation, the controller 30 may change the target trajectory TR. Specifically, the controller 30 detects a change in the state of the dump truck 60 (detection object) based on the output of the LIDAR, and changes the target trajectory TR used in the previous boom raising and turning operation to a target trajectory TRA to be used in a boom raising and turning operation after the state of the dump truck 60 is changed. The target trajectory TRA is a trajectory that passes through a point P2A located higher than the point P2. In this manner, the bucket 6 can be moved above the bed 61 without contacting the left cover 63L at a height HdA.

Figure 13A:
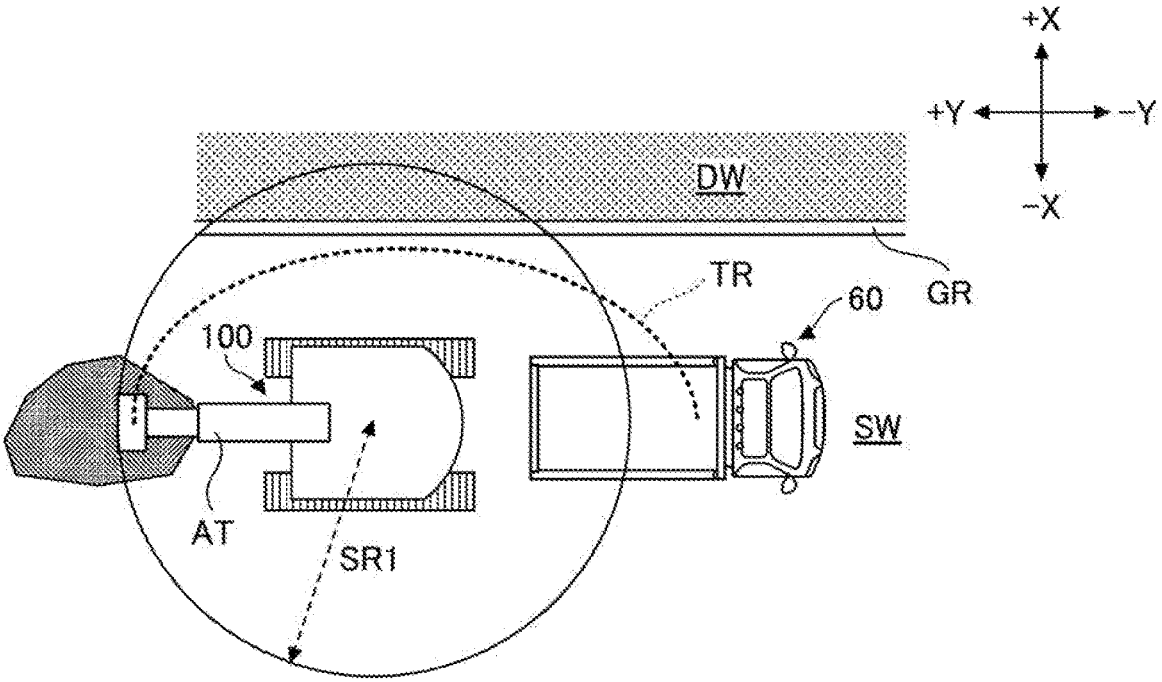
FIG. 13A is a diagram illustrating another example of a work site situation.
Figure 13B:
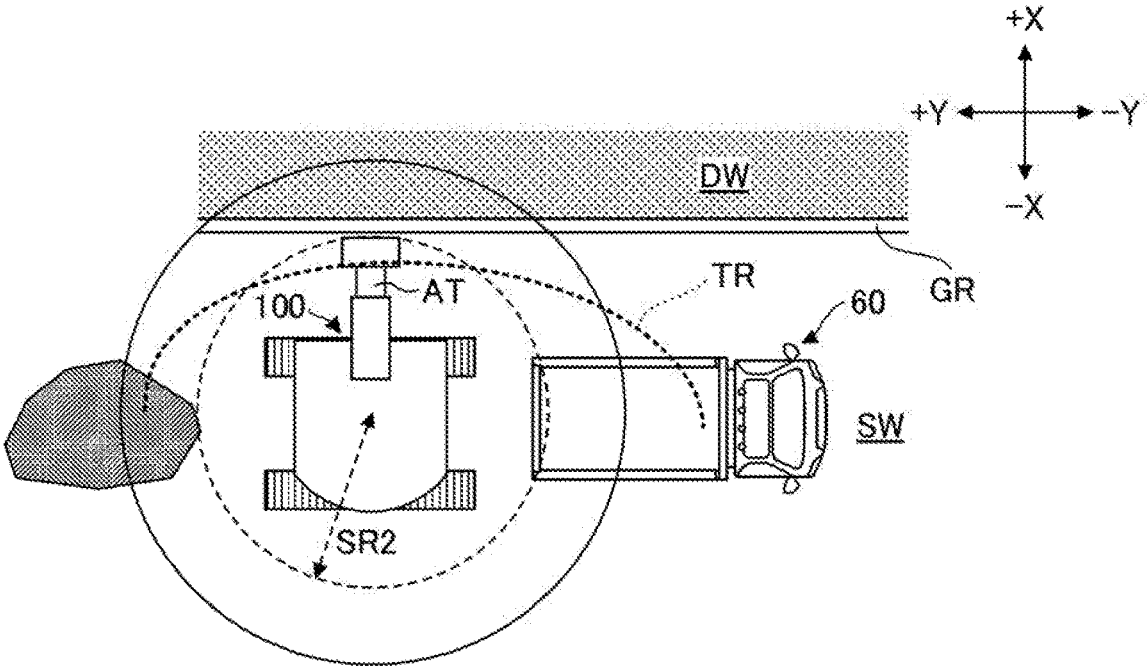
FIG. 13B is a diagram illustrating the other example of the work site situation.
Figure 13C:
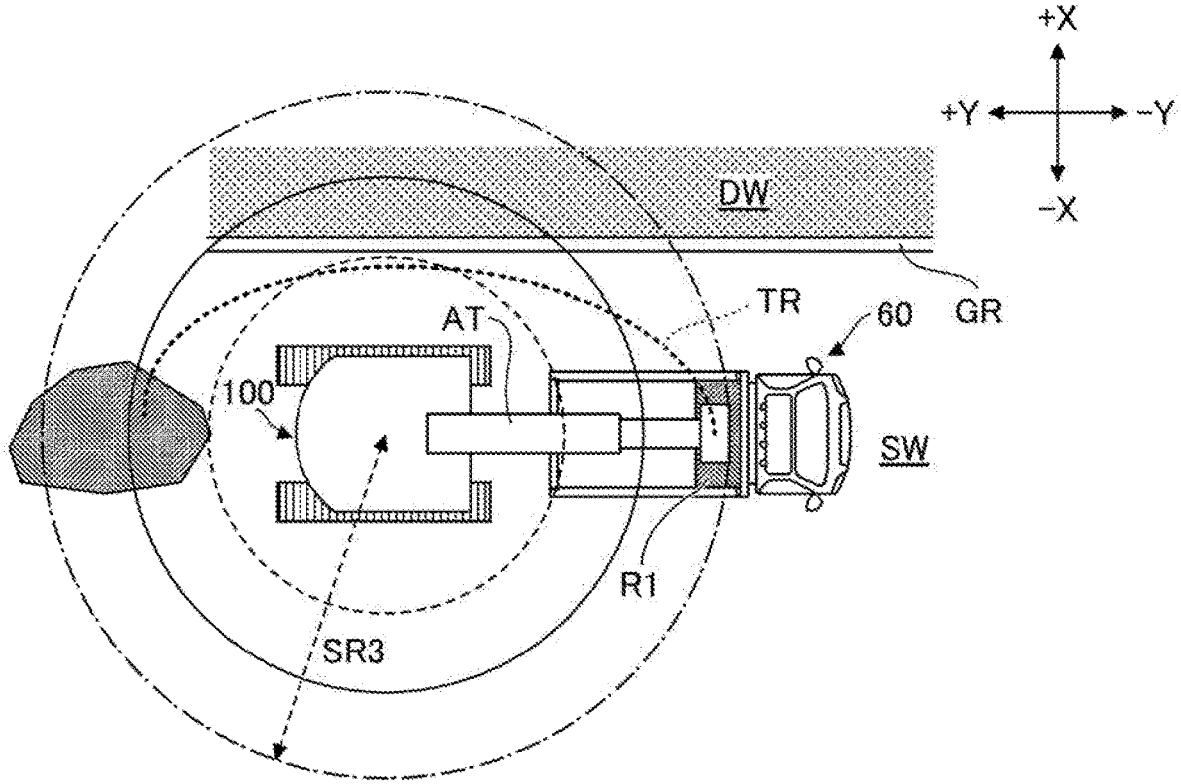
FIG. 13C is a diagram illustrating the other example of the work site situation.

Next, loading work into the dump truck 60 performed by the shovel 100 by means of autonomous control will be described with reference to FIG. 13A through FIG. 13C. FIG. 13A through FIG. 13C are top views of a work site. In the example of FIG. 13A through FIG. 13C, both the shovel 100 and the dump truck 60 are located on a sidewalk SW. The sidewalk SW is located along a road DW. The sidewalk SW and the road DW are separated by a guardrail GR. For example, the controller 30 calculates a target trajectory TR based on the output of the LIDAR serving as the object detector 70, which is an example of the surroundings monitoring device. However, the controller 30 may calculate a target trajectory TR based on information related to the orientation of the shovel 100 recorded when a boom raising and turning operation is manually performed as described above.

FIG. 13A illustrates a state in which the shovel 100 has completed an excavation operation. At this time, the shovel 100 is oriented in the +Y direction, and the dump truck 60 is oriented in the −Y direction. A dotted line indicates a target trajectory TR calculated by the controller 30 based on the output of the LIDAR. The controller 30 calculates the target trajectory TR such that the end of the excavation attachment AT does not extend over the guardrail GR to the road DW during a boom raising and turning operation. A solid circle is a virtual circle drawn with the current turning radius SR1 of the shovel 100.

FIG. 13B illustrates a state in which the shovel 100 is performing a boom raising and turning operation. At this time, the shovel 100 is oriented in the +X direction. A dashed circle is a virtual circle drawn with the current turning radius SR2 of the shovel 100. The turning radius SR2 is smaller than the turning radius SR1.

FIG. 13C illustrates a state in which the shovel 100 has completed a soil discharging operation. At this time, the shovel 100 is oriented in the −Y direction similar to the dump truck 60. A dash-dot circle is a virtual circle drawn with the current turning radius SR3 of the shovel 100. The turning radius SR3 is larger than the turning radius SR1.

As illustrated in FIG. 13A through FIG. 13C, the controller 30 may set the target trajectory TR such that the turning radius changes during the turning operation. Specifically, the controller 30 may set the target trajectory TR such that the turning radius temporarily decreases. As a result, it is possible to prevent the end of the excavation attachment AT from extending over the guardrail GR to the road DW during the turning operation.

Further, the controller 30 may be configured to dynamically correct the target trajectory TR. For example, if the excavation attachment AT is moved along the currently set target trajectory TR, and there is a possibility that the excavation attachment AT may contact a construction machine that is approaching the shovel 100, the controller 30 may correct the target trajectory TR such that the turning radius decreases.

Further, the controller 30 may take into consideration the presence of power lines installed above the work site when setting or correcting a target trajectory TR. Further, if the controller 30 is unable to set an appropriate target trajectory TR or unable to appropriately correct a target trajectory TR, the controller 30 may use one of sound, light, and vibration to notify the operator in this regard.

As described above, according to the embodiment of the present invention, the shovel 100 includes the lower traveling body 1, the upper turning body 3 mounted on the lower traveling body 1, the surroundings monitoring device attached to the upper turning body 3, and the controller 30 serving as a control device configured to identify the state of an object based on the output of the surroundings monitoring device. The surroundings monitoring device may be the object detector 70, or may be the image capturing device 80. Identifying the state of the object may include not only identifying the maximum height of the object and the shortest distance to the object, but also identifying the three-dimensional shape of the object. That is, identifying the state of the object may include three-dimensionally identifying the state of the object. With this configuration, the shovel 100 can more securely prevent contact between the excavation attachment AT and an object during loading work. Thus, the security of a work site can be improved.

The controller 30 may be configured to perform control that avoids contact with an object. For example, the controller 30 may be configured to perform autonomous control of the excavation attachment AT so as to avoid contact with the dump truck 60. Further, the controller 30 may be configured to set a prohibited area ZA for the object. Further, the controller 30 may be configured to generate a target trajectory for the object. Further, the controller 30 may be configured to correct the target trajectory when the state of the object is changed.

For example, the object may be the dump truck 60. In this case, the controller 30 may be configured to three-dimensionally identify the state of the cover 63 attached to the gate 62 of the dump truck 60. With this configuration, the shovel 100 can control the movement of the excavation attachment AT in accordance with the opening/closing state of the cover 63. Accordingly, it is possible to prevent contact between the excavation attachment AT and the cover 63.

The controller 30 may be configured to three-dimensionally identify the pillar 61P located at the back end of the bed 61 of the dump truck 60. With this configuration, the shovel 100 can prevent contact between the excavation attachment AT and the pillar 61P. Further, by the controller 30 identifying that the bed 61 is positioned lower than the pillar 61P, it is possible to prevent excessive restriction of the movement of the excavation attachment AT.

The state of the dump truck 60 may include the inclination of the dump truck 60. That is, the shovel 100 may be configured to identify the tilt angle of the bed 61 of the dump truck 60 relative to the longitudinal axis or the lateral axis. With this configuration, the shovel 100 can control the movement of the excavation attachment AT while identifying the inclination of the dump truck 60 in detail. Accordingly, it is possible to more securely prevent contact between the excavation attachment AT and the dump truck 60. Further, excavated material can be more appropriately discharged into the bed 61 of the dump truck 60.

Figure 14A:
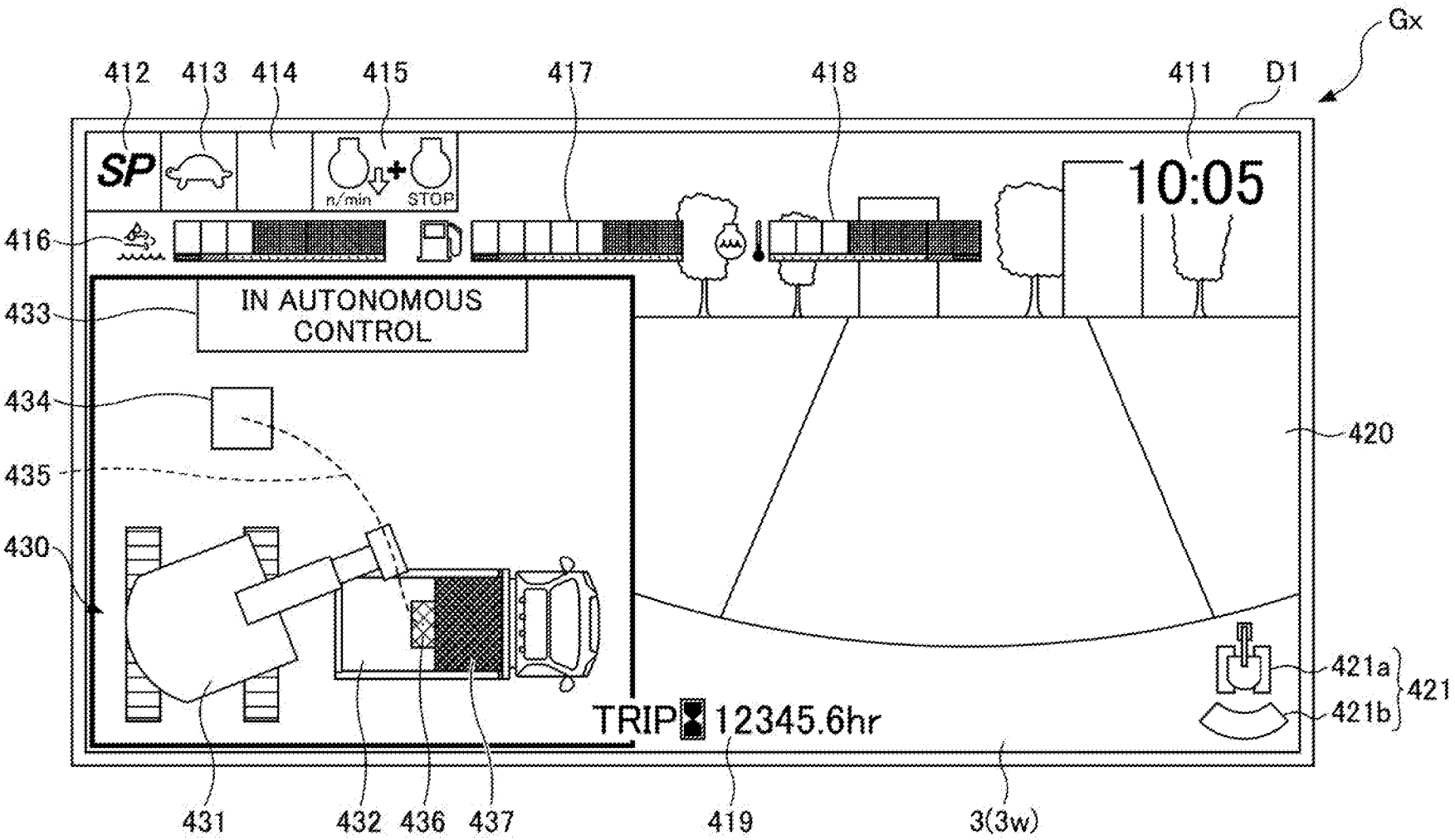
FIG. 14A is a diagram illustrating an example image displayed during autonomous control.
Figure 14B:
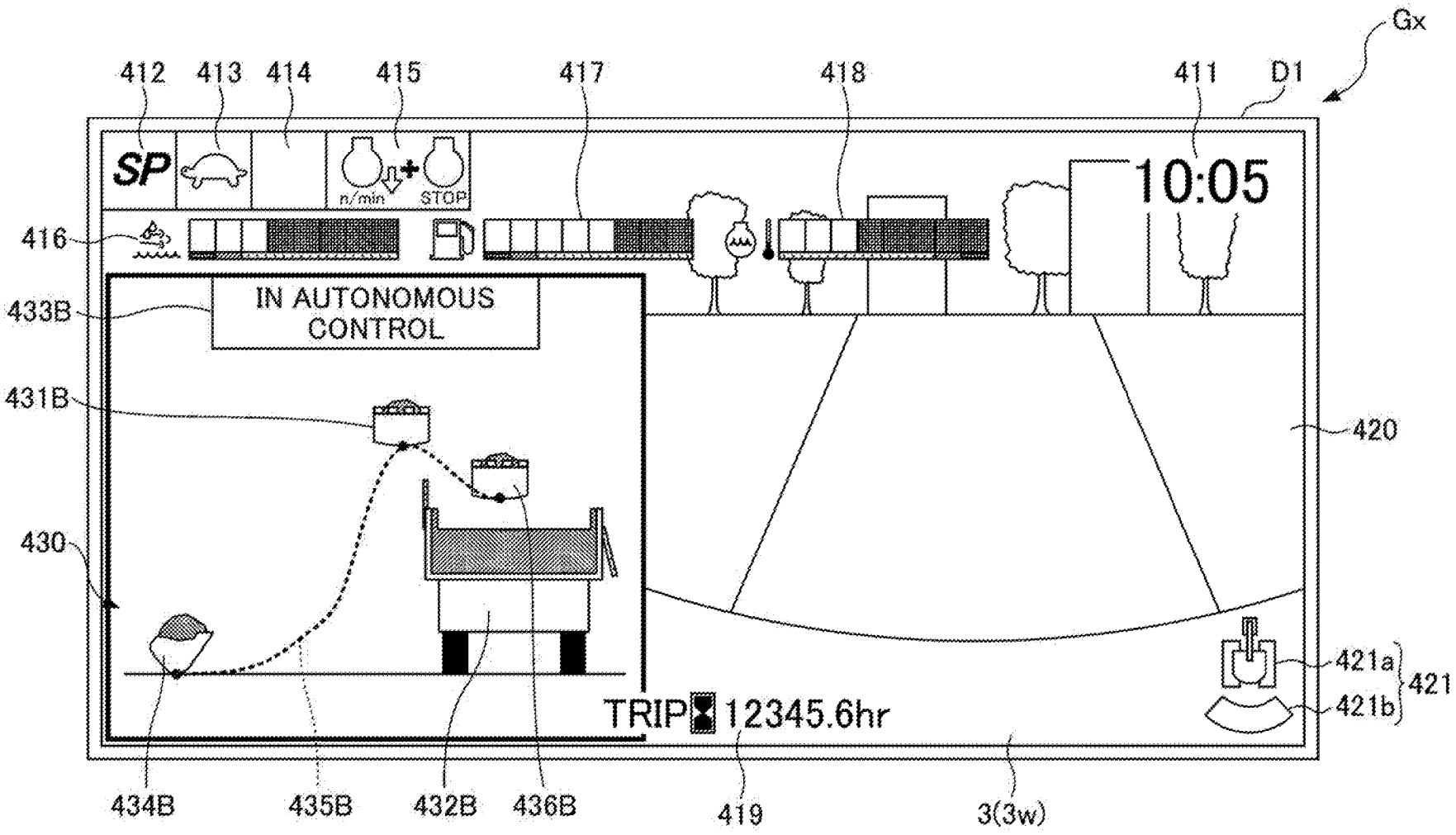
FIG. 14B is a diagram illustrating another example image displayed during autonomous control.

Next, example images displayed during autonomous control will be described with reference to FIG. 14A and FIG. 14B. As illustrated in FIG. 14A and FIG. 14B, each of images Gx displayed on the display device D1 includes a time display part 411, a rotational speed mode display part 412, a traveling mode display part 413, an attachment display part 414, an engine control status display part 415, a remaining aqueous urea solution amount display part 416, a remaining fuel amount display part 417, a coolant water temperature display part 418, an engine operating time display part 419, a camera image display part 420, and a work status display part 430. An image Gx illustrated in FIG. 14A differs from an image Gx illustrated in FIG. 14B in that the state of the work site (see FIG. 12A) as viewed from the top is displayed in the work status display part 430 included in the image Gx illustrated in FIG. 14A, while the state of the work site (see FIG. 12A) as viewed from the side is displayed in the work status display part 430 included in the image Gx illustrated in FIG. 14B.

The rotational speed mode display part 412, the traveling mode display part 413, the attachment display part 414, and the engine control status display part 415 are display parts that display information related to the settings of the shovel 100. The remaining aqueous urea solution amount display part 416, the remaining fuel amount display part 417, the coolant water temperature display part 418, and the engine operating time display part 419 are display parts that display information related to the operating condition of the shovel 100. Images displayed in the respective parts are generated by the display device D1 based on various kinds of data transmitted from the controller 30 and image data transmitted from the image capturing device 80.

The time display part 411 displays the current time. The rotational speed mode display part 412 displays a rotational speed mode set by the engine rotational speed adjustment dial (not illustrated) as operating information of the shovel 100. The traveling mode display part 413 displays a traveling mode as operating information of the shovel 100. The traveling mode represents the settings of traveling hydraulic motors that use variable displacement motors. For example, the traveling mode includes a low-speed mode and a high-speed mode. A "turtle"-shaped mark is displayed during the low-speed mode, and a "rabbit"-shaped mark is displayed during the high-speed mode. The attachment display part 414 is an area that displays an icon representing the type of a currently mounted attachment. The engine control status display part 415 displays the control status of the engine 11 as operating information of the shovel 100. In each of the examples of FIG. 14A and FIG. 14B, an "automatic deceleration and automatic stop mode" is selected as the control status of the engine 11. The "automatic deceleration and automatic stop mode" means a control status in which the engine rotational speed of the engine 11 is automatically reduced and further the engine 11 is automatically stopped in accordance with the duration of the non-operating state of the engine 11. Other control statuses of the engine 11 include "automatic deceleration mode", "automatic stop mode", and "manual deceleration mode".

The remaining aqueous urea solution amount display part 416 displays the status of the remaining amount of an aqueous urea solution stored in an aqueous urea solution tank as operating information of the shovel 100. In each of the examples of FIG. 14A and FIG. 14B, a bar gauge representing the current status of the remaining amount of an aqueous urea solution is displayed in the remaining aqueous urea solution amount display part 416. The remaining amount of an aqueous urea solution is displayed based on the output data of a remaining aqueous urea solution amount sensor provided in the aqueous urea solution tank.

The remaining fuel amount display part 417 displays the status of the remaining amount of fuel stored in a fuel tank as operating information of the shovel 100. In each of the examples of FIG. 14A and FIG. 14B, a bar gauge representing the current status of the remaining amount of fuel is displayed in the remaining fuel amount display part 417. The remaining amount of fuel is displayed based on the output data of a remaining fuel amount sensor provided in the fuel tank.

The coolant water temperature display part 418 displays the temperature condition of engine coolant water as operating information of the shovel 100. In each of the examples of FIG. 14A and FIG. 14B, a bar gauge representing the temperature condition of engine coolant water is displayed. The temperature of engine coolant water is displayed based on the output data of a water temperature sensor attached to the engine 11.

The engine operating time display part 419 displays the cumulative operating time of the engine 11 as operating information of the shovel 100. In each of the examples of FIG. 14A and FIG. 14B, the engine operating time display part 419 displays the cumulative operating time after the restart of counting by the operator, together with a unit "hr (hour)." The engine operating time display part 419 may display a lifelong operating time for the entire period after the manufacture of the shovel or a section operating time after the restart of counting by the operator.

The camera image display part 420 displays an image captured by the image capturing device 80. In each of the examples of FIG. 14A and FIG. 14B, an image captured by the back camera 80B attached to the back end of the upper surface of the upper turning body 3 is displayed in the camera image display part 420. A camera image captured by the left camera 80L attached to the left end of the upper surface of the upper turning body 3 or the right camera 80R attached to the right end of the upper surface of the upper turning body 3 may be displayed in the camera image display part 420. Further, images captured by two or more of the left camera 80L, the right camera 80R, and the back camera 80B may be displayed side by side in the camera image display part 420. Further, images captured by two or more of the left camera 80L, the right camera 80R, and the back camera 80B may be displayed side by side in the camera image display part 1420. Further, a composite image of multiple camera images captured by at least two of the left camera 80L, the right camera 80R, and the back camera 80B may be displayed in the camera image display part 420. The composite image may be, for example, an overhead view image.

Each camera is installed such that a part of the upper turning body 3 is included in a camera image. By including a part of the upper turning body 3 in a displayed image, it becomes possible for the operator to easily understand the distance between an object displayed in the camera image display part 420 and the shovel 100. In each of the examples of FIG. 14A and FIG. 14B, the camera image display part 420 displays an image of a counterweight 3*w* of the upper turning body 3.

The camera image display part 420 displays a graphic shape 421 representing the direction of the image capturing device 80 that has captured a currently displayed camera image. The graphic shape 421 includes a shovel graphic shape 1421*a* representing the shape of the shovel 100 and a strip-shaped direction indicator graphic shape 1421*b* representing the imaging direction of the image capturing device 80 that has captured the currently displayed camera image. The graphic shape 421 includes a shovel graphic shape 421*a* representing the shape of the shovel 100 and a strip-shaped direction indicator graphic shape 421*b* representing the imaging direction of the image capturing device 80 that has captured the currently displayed camera image. The graphic shape 421 is a display part that displays information related to the settings of the shovel 100.

In each of the examples of FIG. 14A and FIG. 14B, the direction indicator graphic shape 421*b* is displayed below the shovel graphic shape 421*a* (on the opposite side from the graphic shape representing the excavation attachment AT). This indicates that an image of an area behind the shovel 100 captured by the back camera 80B is displayed in the camera image display part 420. For example, when an image captured by the right camera 80R is displayed in the camera image display part 420, the direction indicator graphic shape 421*b* is displayed to the right of the shovel graphic shape 421*a*. For example, when an image captured by the left camera 80L is displayed in the camera image display part 420, the direction indicator graphic shape 421*b* is displayed to the left of the shovel graphic shape 421*a*.

For example, the operator can switch an image displayed in the camera image display part 420 to an image captured by another camera by pressing an image change switch (not illustrated) provided in the cabin 10.

If the shovel 100 is not provided with the image capturing device 80, the camera image display part 420 may be replaced with a display part that displays different information.

The work status display part 430 displays the work status of the shovel 100. In the example of FIG. 14A, the work status display part 430 includes a graphic shape 431 of the shovel 100, a graphic shape 432 of the dump truck 60, a graphic shape 434 indicating an excavation completion position, a graphic shape 435 indicating a target trajectory, a graphic shape 436 indicating a soil discharging start position, and a graphic shape 437 of soil already loaded into the bed of the dump truck 60. The graphic shape 431 indicates the state of the shovel 100 as viewed from the top. The graphic shape 432 indicates the state of the dump truck 60 as viewed from the top. The graphic shape 433 is a text message indicating the state of the shovel 100. The graphic shape 434 indicates the state of the bucket 6 as viewed from the top when an excavation operation is completed. The graphic shape 435 indicates the target trajectory as viewed from the top. The graphic shape 436 indicates the state of the bucket 6 as viewed from the top when a soil discharging operation is started, that is, when the bucket 6 is located at the end position of the target trajectory. The graphic shape 437 indicates the state of the soil already loaded into the bed of the dump truck 60.

In the example of FIG. 14B, the work status display part 430 includes a graphic shape 431B of the bucket 6, a graphic shape 432B of the dump truck 60, a graphic shape 433B indicating the state of the shovel 100, a graphic shape 434B indicating an excavation completion position, a graphic shape 435B indicating a target trajectory, and a graphic shape 436B indicating a soil discharging start position. The graphic shape 431B indicates the state of the bucket 6 as viewed from the +Y side (see FIG. 12A). The graphic shape 432B indicates the state of the dump truck 60 as viewed from the +Y side. The graphic shape 433B is a text message indicating the state of the shovel 100. The graphic shape 434B indicates the state of the bucket 6 as viewed from the +Y side when an excavation operation is completed. The graphic shape 435B indicates the target trajectory as viewed from the +Y side. The graphic shape 436B indicates the state of the bucket 6 as viewed from the +Y side when a soil discharging operation is started, that is, when the bucket 6 is located at the end position of the target trajectory.

The controller 30 may be configured to generate the graphic shape 431 through the graphic shape 436 based on information related to the orientation of the shovel 100 and information related to the orientation of the dump truck 60. Specifically, the controller 30 may generate the graphic shape 431 such that the graphic shape 431 represents the actual orientation of the shovel 100, and the controller 30 may generate the graphic shape 432 such that the graphic shape 432 represents the actual direction and size of the dump truck 60. Further, the controller 30 may generate the graphic shape 434 such that the graphic shape 434 represents information recorded by the orientation recording part 30A. The controller 30 may generate the graphic shape 435 and the graphic shape 436 based on information calculated by the trajectory calculating part 30B. The same applies to the graphic shape 431B through the graphic shape 436B. Further, the controller 30 may detect the state of the soil already loaded into the bed of the dump truck 60 based on the output of at least one of the object detector 70 and the image capturing device 80, and change the position and size of the graphic shape 437 in accordance with the detected state.

The controller 30 may display, on the work status display part 430, the number of boom raising and turning operations for the dump truck 60, the number of boom raising and turning operations by means of autonomous control, the weight of soil loaded into the dump truck 60, and the ratio of the weight of soil loaded into the dump truck 6 to the maximum load capacity of the dump truck 6.

With the above-described configuration, the operator of the shovel 100 can identify whether autonomous control is performed by looking at each of the images Gx.

In the example illustrated in FIG. 14A, the work status display part 430 that displays the state of the work site as viewed from the top is displayed in the work status display part 430 included in the image Gx. In the example illustrated in FIG. 14B, the state of the work site as viewed from the side (+Y side) is displayed in the work status display part 430 included in the image Gx. However, the work site as viewed from obliquely above or obliquely below may be displayed in the work status display part 430. Further, a combination of the state of the work site as viewed from the top, the state of the work site as viewed from the side (+Y side), and the work site as viewed from obliquely above or obliquely below may be displayed in the work status display part 43 at the same time. However, when each of the images Gx includes such a work status display part 430, each of the images Gx is configured to include the camera image display part 420 that displays an image captured by the back camera 80B. In this manner, the operator can always monitor the rear of the upper turning body 3 when a boom raising and turning operation is performed.

As described above, according to the embodiment of the present invention, the shovel 100 includes the lower traveling body 1, the upper turning body 3 mounted on the lower traveling body 1, the excavation attachment AT serving as an attachment pivotably attached to the upper turning body 3, and the controller 30 serving as a control unit provided in the upper turning body 3. The controller 30 is configured to autonomously perform a combined operation including an operation of the excavation attachment AT and a turning operation. With this configuration, the shovel 100 can autonomously perform a combined operation including a turning operation in accordance with the operator's intention.

A combined operation including a turning operation may be a boom raising and turning operation. A target trajectory for a boom raising and turning operation may be calculated based on information recorded when a manual boom raising and turning operation is performed. However, the target trajectory for the boom raising and turning operation may be calculated based on information recorded when a manual boom lowering and turning operation is performed. Further, a combined operation including a turning operation may be a boom lowering and turning operation. A target trajectory for a boom lowering and turning operation may be calculated based on information recorded when a manual boom lowering and turning operation is performed. However, the target trajectory for the boom lowering and turning operation may be calculated based on information recorded when a manual boom raising and turning operation is performed. Further, a combined operation including a turning operation may be another repeated operation including a turning operation.

The shovel 100 may include an orientation detector that acquires information related to the orientation of the excavation attachment AT. The orientation detector includes at least one of the boom angle sensor S1, the arm angle sensor S2, the bucket angle sensor S3, the body tilt sensor S4, and the turning angular velocity sensor S5. The controller 30 may calculate a target trajectory followed by a predetermined point on the excavation attachment AT, based on the information acquired by the orientation detector, and autonomously perform a combined operation such that the predetermined point on the excavation attachment AT moves along the target trajectory. The predetermined point on the excavation attachment AT may be a predetermined point on the back surface of the bucket 6.

The controller 30 may be configured to repeatedly perform a combined operation, and change a target trajectory each time the combined operation is performed. For example, as described with reference to FIG. 12A through FIG. 12C, the controller 30 may change the end position of a target trajectory each time a boom raising and turning operation by means of autonomous control is performed.

The shovel 100 may include a recording switch NS1, which serves as a second switch provided in the cabin 10. The controller 30 may be configured to acquire information related to the orientation of the excavation attachment AT when the recording switch NS1 is operated.

Further, the controller 30 may be configured to autonomously perform the combined operation while an automatic switch NS2, which serves as a first switch, is operated or while a turning operation is performed with the automatic switch NS2 being operated. Further, if the automatic switch NS2 is not included, the controller 30 may be configured to autonomously perform a combined operation including a turning operation on the condition that the operator's operation is performed after information related to the orientation of the shovel 100 is recorded.

Although the embodiment of the present invention has been described in detail above, the present invention is not limited to the above-described embodiment. Variations and replacements, may be applied to the above-described embodiment without departing from the scope of the present invention. Furthermore, the separately described features may be suitably combined as long as no technical contradiction occurs.

Figure 15:
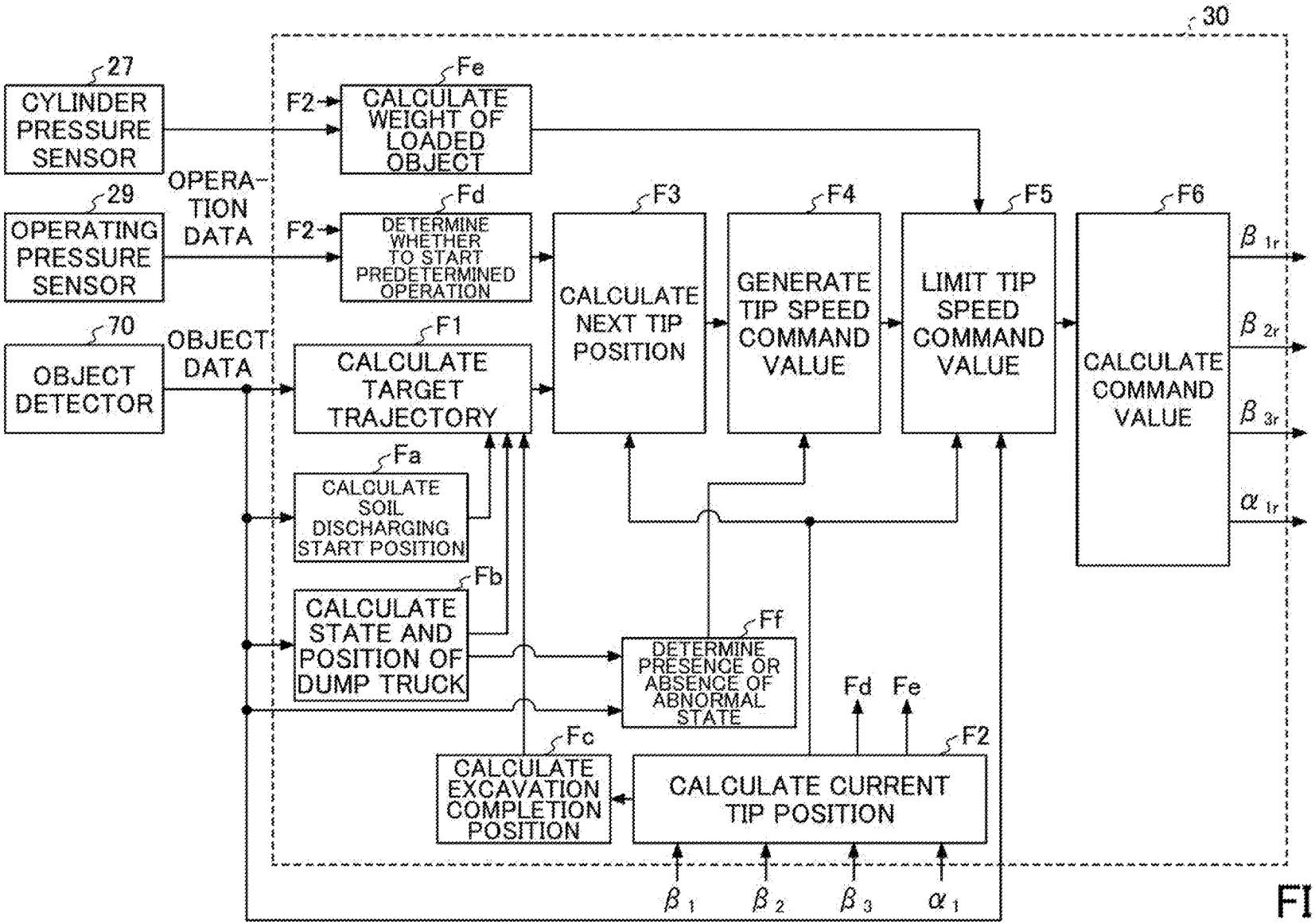
FIG. 15 is a block diagram illustrating another example configuration of the autonomous control function.

For example, the shovel 100 may autonomously perform a combined operation by executing the autonomous control function as described below. FIG. 15 is a block diagram illustrating another example configuration of the autonomous control function. In the example of FIG. 15, the controller 30 includes functional elements Fa through Ff and F1 through F6 for performing autonomous control. The functional elements may be constituted of hardware, may be constituted of software, or may be constituted of a combination of software and hardware.

The functional element Fa is configured to calculate a soil discharging start position. In the present embodiment, the functional element Fa calculates, as the soil discharging start position, the position of the bucket 6 when a soil discharging operation is started before the soil discharging operation is actually performed, based on object data output from the object detector 70. The soil discharging start position is basically calculated as a position in the space above the bed of the dump truck 60. Further, the soil discharging start position is desirably calculated as a position away from the cover 63 by a predetermined distance.

Specifically, the functional element Fa detects the state of soil already loaded into the bed of the dump truck 60, based on object data output from the object detector 70. The functional element Fa may detect the state of soil already loaded into the bed of the dump truck 60, based on an image captured by the image capturing device 80. Examples of the state of soil include how much soil is loaded into what portion of the bed of the dump truck 60. Then, the functional element Fa calculates the soil discharging start position based on the detected state of soil. However, the functional element Fa may calculate the soil discharging start position, based on the orientation of the shovel 100 (the detected value of the orientation detector) recorded when a soil discharging operation was performed in the past.

The functional element Fa may be configured to correct the calculated soil discharging start position based on the state of soil already loaded into the bed of the dump truck 60 or the state of the dump truck 60, when a boom raising and turning operation is performed. For example, the functional element Fa may move the soil discharging start position by a predetermined distance away from the edge of the bed of the dump truck 60, when the dropping of soil from the edge of the bed of the dump truck 60 is detected based on the output of at least one of the object detector 70 and the image capturing device 80. In this manner, it is possible to prevent soil from dropping from the edge of the bed of the dump truck 60 when a subsequent soil discharging operation is performed. Alternatively, when a slight movement of the dump truck 60 (by a distance less than a predetermined allowable distance) caused by misoperation is detected based on the output of at least one of the object detector 70 and the image capturing device 80, the functional element Fa may correct the soil discharging start position in accordance with the direction of and the amount of the movement of the dump truck 60. In this manner, it is possible to offset the displacement of the soil discharging start position caused by the movement of the dump truck 60. With this configuration, the shovel 100 can discharge soil at the same position of the bed as that when the dump truck 60 is not moved. In this case, the functional element F1, which will be described later, calculates a target trajectory again in accordance with the corrected soil discharging start position.

The functional element Fb is configured to calculate the state of the dump truck 60 and the position of each part constituting the dump truck 60. In the present embodiment, the functional element Fb calculates each part constituting the bed of the dump truck 60, based on the object data output from the object detector 70. Further, the functional element Fb calculates, as the state of the dump truck 60, the degree of opening/closing of the cover 63 attached to the bed of the dump truck 60 and the tilt angle of the dump truck 60 based on the object data output from the object detector 70.

The functional element Fc is configured to calculate an excavation completion position. In the present embodiment, the functional element Fc calculates the position of the bucket 6 when an excavation operation is completed as an excavation completion position, based on the tip position of the bucket 6 when the previous excavation operation is completed. Specifically, the functional element Fc calculates an excavation completion position based on the current tip position of the bucket 6 calculated by the functional element F2, which will be described later. Note that the functional element Fc may be configured to calculate the excavation completion position based on the output of at least one of the orientation detector, the object detector 70, and the image capturing device 80.

The functional element Fd is configured to determine whether to start a predetermined operation. In the present embodiment, the functional element Fd determines whether to start a boom raising and turning operation, based on operation data output from the operating pressure sensor 29 and the current tip position of the bucket 6 calculated by the functional element F2, which will be described later. Specifically, the functional element Fd determines whether the boom 4 is raised and whether the bucket 6 is located above the ground surface (e.g., a virtual horizontal plane including the ground surface contacted by the shovel 100) by a predetermined vertical distance, based on the current tip position of the bucket 6. If the functional element Fd determines that the boom 4 is raised and the bucket 6 is located above the ground surface by the predetermined vertical distance, the functional element Fd determines to start the boom raising and turning operation. If the functional element Fd determines to start the boom raising and turning operation, the functional element Fd inputs the operation data output from the operating pressure sensor 29 into the functional element F3, which will be described later.

The functional element Fe is configured to calculate the weight of a loaded object. In the present embodiment, the functional element Fe calculates the weight of soil loaded into the bucket 6 as the weight of a loaded object, based on the output of a cylinder pressure sensor 27 and the current orientation of the excavation attachment AT calculated by the functional element F2, which will be described later. For example, the cylinder pressure sensor 27 includes a sensor that detects the pressure of hydraulic oil in a bottom-side oil chamber of the boom cylinder 7. The functional element Fe outputs the calculated weight of the loaded object to the functional element F5, which will be described later.

The functional element Ff is configured to determine the presence or absence of various abnormal states. In the present embodiment, the functional element Ff is configured to determine the presence or absence of an abnormal state of the object detector 70 based on the output of the object detector 70. Further, the functional element Ff is configured to determine the presence or absence of an abnormal state of the dump truck 60 based on the output of the functional element Fb. Specifically, if the dump truck 60 is moved by a distance exceeding the predetermined allowable distance due to misoperation, the functional element Ff determines that the state of the dump truck 60 is abnormal. If the functional element Ff determines that the state of the object detector 70 is abnormal or the state of the dump truck 60 is abnormal, the functional element Ff outputs a command to the functional element F4, which will be described later, to slow or stop the movement of the shovel 100.

The functional element F1 is configured to generate a target trajectory. In the present embodiment, the functional element F1 generates a trajectory followed by the tip of the bucket 6 as a target trajectory, based on the object data output from the object detector 70 and the excavation completion position calculated by the functional element Fc. For example, the object data may be information related to an object located in the vicinity of the shovel 100, such as the position and the shape of the dump truck 60. Specifically, the functional element F1 calculates a target trajectory based on the soil discharging start position calculated by the functional element Fa, the position of the dump truck calculated by the functional element Fb, and the excavation completion position calculated by the functional element Fc. Typically, the functional element F1 is configured to calculate a target trajectory each time a boom raising and excavation operation is started. That is, the target trajectory is typically updated each time a boom raising and excavation operation is started. Similarly, the excavation completion position and the soil discharging start position are updated each time a boom raising and excavation operation is started.

The functional element F2 is configured to calculate a current tip position. In the present embodiment, the functional element F2 calculates the coordinates of the coordinates point of the tip of the bucket 6 as a current tip position, based on the boom angle $\beta_1$ detected by the boom angle sensor S1, the arm angle $\beta_2$ detected by the arm angle sensor S2, the bucket angle $\beta_3$ detected by the bucket angle sensor S3, and the turning angle $\alpha_1$ detected by the turning angular velocity sensor S5. The functional element F2 may use the output of the body tilt sensor S4 to calculate the current tip position.

The functional element F3 is configured to calculate the next tip position. In the present embodiment, the functional element F3 calculates a tip position after a predetermined period of time as a target tip position, based on the operation data output by the operating pressure sensor 29, the target trajectory generated by the functional element F1, and the current tip position calculated by the functional element F2.

The functional element F3 may determine whether the deviation between the current tip position and the target trajectory is within an acceptable range. In the present embodiment, the functional element F3 determines whether the distance between the current tip position and the target trajectory is equal to or less than a predetermined value. If the distance is equal to or less than the predetermined value, the functional element F3 determines that the deviation is within the acceptable range, and calculates the target tip position. If the distance exceeds the predetermined value, the functional element F3 determines that the deviation is outside the acceptable range, and slows or stops the movement of an actuator irrespective of the amount of lever operation.

The functional element F4 is configured to generate a command value related to the tip speed. In the present embodiment, the functional element F4 calculates the tip speed required to move the current tip position to the next tip position in a predetermined period of time as a command value related to the tip speed, based on the current tip position calculated by the functional element F2 and the next tip position calculated by the functional element F3.

The functional element F5 is configured to limit the command value related to the tip speed. In the present embodiment, if the functional element F5 determines that the distance between the tip and the dump truck 60 is less than a predetermined value, based on the current tip position calculated by the functional element F2 and the output of the object detector 70, the functional element F5 limits the command value related to the tip speed by a predetermined upper limit value. In this manner, the controller 30 reduces the tip speed if the tip approaches the dump truck 60. The functional element F5 may be configured to change the upper limit value, based on the weight of the loaded object calculated by the functional element Fe. The functional element F5 may be configured to change the upper limit value, based on the turning radius of the excavation attachment AT. The turning radius of the excavation attachment AT may be calculated by the functional element F2, or may be calculated by the functional element F5.

The functional element F6 is configured to calculate a command value for operating an actuator. In the present embodiment, the functional element F6 calculates a command value $\beta_{1r}$ associated with the boom angle $\beta_1$, a command value $\beta_{2r}$ associated with the arm angle $\beta_2$, a command value $\beta_{3r}$ associated with the bucket angle $\beta_3$, and a command value $\alpha_{1r}$ associated with the turning angle $\alpha_1$, based on the target tip position calculated by the functional element F3, in order to move the current tip position to the target tip position. Even when the boom 4 is not operated, the functional element F6 calculates the command value $\beta_{1r}$ as necessary, such that the boom 4 is automatically operated. The same applies to the arm 5, the bucket 6, and the turning mechanism 2.

Figure 16:
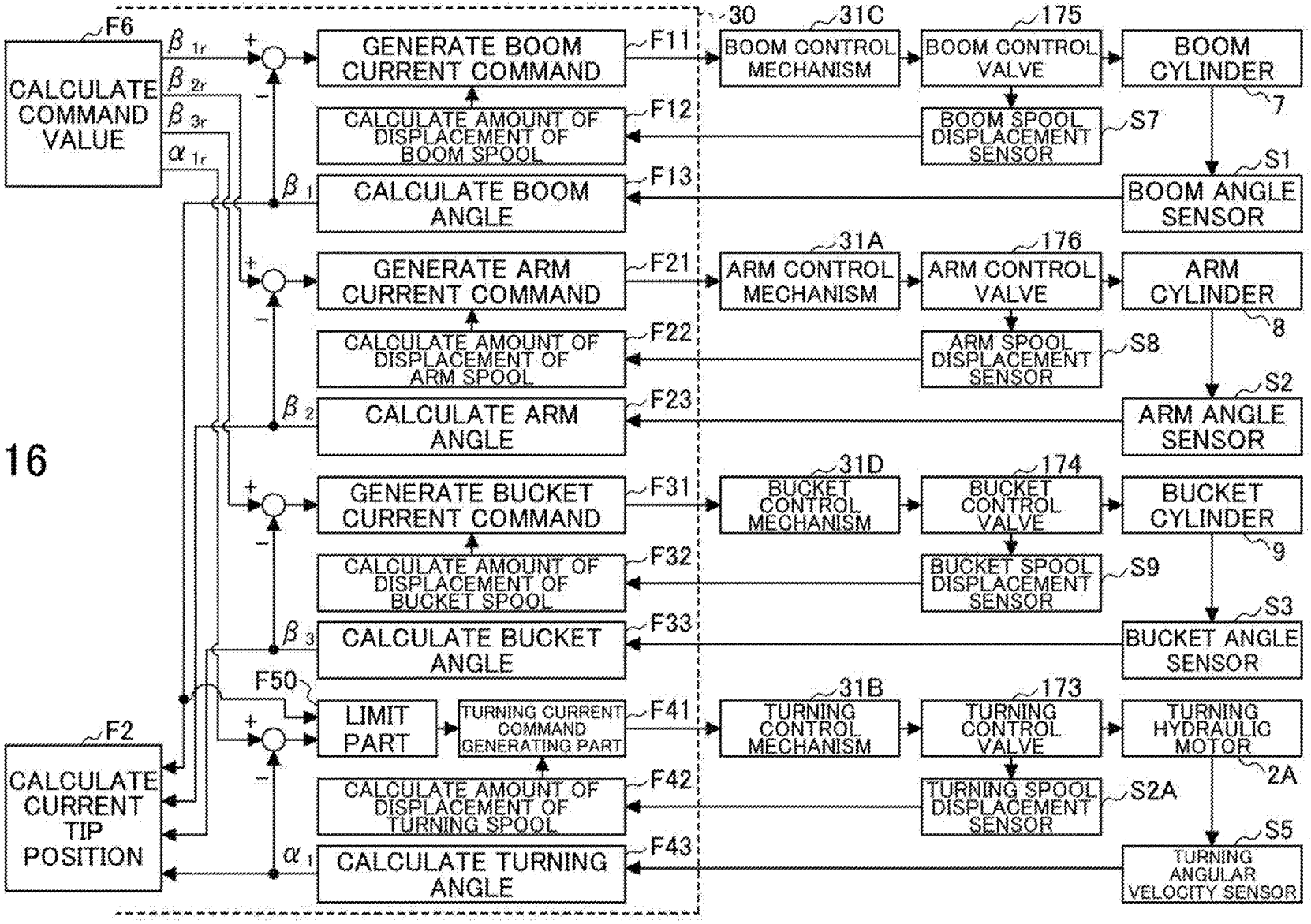
FIG. 16 is a block diagram illustrating the other example configuration of the autonomous control function.

Next, the functional element F6 will be described in detail with reference to FIG. 16. FIG. 16 is a block diagram illustrating an example configuration of the functional element F6 that calculates various command values.

As illustrated in FIG. 16, the controller 30 further includes functional elements F11 through F13, functional elements F21 through F23, functional elements F31 through F33, functional elements F41 through F43, and a functional element F50 associated with the generation of command values. The functional elements may be constituted of software, may be constituted of hardware, or may be constituted of a combination of software and hardware.

The functional elements F11 through F13 are functional elements associated with the command value $\beta_{1r}$. The functional elements F21 through F23 are functional elements associated with the command value $\beta_{2r}$. The functional elements F31 through F33 are functional elements associated with the command value $\beta_{3r}$, and the functional elements F41 through F43 are functional elements associated with the command value air.

The functional elements F11, F21, F31, and F41 are each configured to generate a current command output to a corresponding proportional valve 31. In the present embodiment, the functional element F11 outputs a boom current command to the boom control mechanism 31C, the functional element F21 outputs an arm current command to the arm control mechanism 31A, the functional element F31 outputs a bucket current command to a bucket control mechanism 31D, and the functional element F41 outputs a turning current command to the turning control mechanism 31B.

The bucket control mechanism 31D is configured such that a pilot pressure, which is commensurate with a control current corresponding to a bucket cylinder pilot pressure command, acts on the control valve 174 serving as a bucket control valve. The bucket control mechanism 31D may be the proportional valve 31DL and the proportional valve 31DR in FIG. 8D.

The functional elements F12, F22, F32, and F42 are each configured to calculate the amount of displacement of a spool that is a constituent of a spool valve. In the present embodiment, the functional element F12 calculates the amount of displacement of a boom spool that is a constituent of the control valve 175 pertaining to the boom cylinder 7, based on the output of the boom spool displacement sensor S7. The functional element F22 calculates the amount of displacement of an arm spool that is a constituent of the control valve 176 pertaining to the arm cylinder 8, based on the output of the arm spool displacement sensor S8. The functional element F32 calculates the amount of displacement of a bucket spool that is a constituent of the control valve 174 pertaining to the bucket cylinder 9, based on the output of a bucket spool displacement sensor S9. The functional element F42 calculates the amount of displacement of a turning spool that is a constituent of the control valve 173 pertaining to the turning hydraulic motor 2A, based on the output of the turning spool displacement sensor S2A. The bucket spool displacement sensor S9 is a sensor that detects the amount of displacement of the spool constituting the control valve 174.

The functional elements F13, F23, F33, and F43 are each configured to calculate the rotation angle of a working body. In the present embodiment, the functional element F13 calculates the boom angle $\beta_1$ based on the output of the boom angle sensor S1. The functional element F23 calculates the arm angle $\beta_2$ based on the output of the arm angle sensor S2. The functional element F33 calculates the bucket angle $\beta_3$ based on the output of the bucket angle sensor S3. The functional element F43 calculates the turning angle $\alpha_1$ based on the output of the turning angular velocity sensor S5.

Specifically, the functional element F11 basically generates the boom current command to be output to the boom control mechanism 31C, such that the difference between the command value $\beta_{1r}$ generated by the functional element F6 and the boom angle $\beta_1$ calculated by the functional element F13 is zero. At this time, the functional element F11 adjusts the boom current command such that the difference between a target boom spool displacement amount derived from the boom current command and the amount of displacement of the boom spool calculated by the functional element F12 is zero. The functional element F11 outputs the adjusted boom current command to the boom control mechanism 31C.

The boom control mechanism 31C changes the opening area in accordance with the boom current command, and causes a pilot pressure commensurate with the size of the opening area to act on a pilot port of the control valve 175. The control valve 175 moves the boom spool in accordance with the pilot pressure, and causes hydraulic oil to flow into the boom cylinder 7. The boom spool displacement sensor S7 detects the displacement of the boom spool, and feeds back the detection result to the functional element F12 of the controller 30. The boom cylinder 7 extends or retracts in accordance with the flow of hydraulic oil to move up or down the boom 4. The boom angle sensor S1 detects the rotation angle of the vertically moving boom 4, and feeds back the detection result to the functional element F13 of the controller 30. The functional element F13 feeds back the calculated boom angle $\beta_1$ to the functional element F2.

The functional element F21 basically generates the arm current command to be output to the arm proportional valve 31B, such that the difference between the command value $\beta_{2r}$ generated by the functional element F6 and the arm angle $\beta_2$ calculated by the functional element F23 is zero. At this time, the functional element F21 adjusts the arm current command such that the difference between a target arm spool displacement amount derived from the arm current command and the amount of displacement of the arm spool calculated by the functional element F22 is zero. The functional element F21 outputs the adjusted arm current command to the arm control mechanism 31A.

The arm control mechanism 31A changes the opening area in accordance with the arm current command, and causes a pilot pressure commensurate with the size of the opening area to act on a pilot port of the control valve 176. The control valve 176 moves the arm spool in accordance with the pilot pressure to cause hydraulic oil to flow into the arm cylinder 8. The arm spool displacement sensor S8 detects the displacement of the arm spool, and feeds back the detection result to the functional element F22 of the controller 30. The arm cylinder 8 extends or retracts in accordance with the flow of hydraulic oil to open or close the arm 5. The arm angle sensor S2 detects the rotation angle of the opening or closing arm 5, and feeds back the detection result to the functional element F23 of the controller 30. The functional element F23 feeds back the calculated arm angle $\beta_2$ to the functional element F2.

The functional element F31 basically generates the bucket current command to be output to the bucket control mechanism 31D, such that the difference between the command value $\beta_{3r}$ generated by the functional element F6 and the bucket angle $\beta_3$ calculated by the functional element F33 is zero. At this time, the functional element F31 adjusts the bucket current command such that the difference between a target bucket spool displacement amount derived from the bucket current command and the amount of displacement of the bucket spool calculated by the functional element F32 is zero. The functional element F31 outputs the adjusted bucket current command to the bucket control mechanism 31D.

The bucket control mechanism 31D changes the opening area in accordance with the bucket current command, and causes a pilot pressure commensurate with the size of the opening area to act on a pilot port of the control valve 174.

The control valve 174 moves the bucket spool in accordance with the pilot pressure to cause hydraulic oil to flow into the bucket cylinder 9. The bucket spool displacement sensor S9 detects the displacement of the bucket spool, and feeds back the detection result to the functional element F32 of the controller 30. The bucket cylinder 9 extends or retracts in accordance with the flow of hydraulic oil to open or close the bucket 6. The bucket angle sensor S3 detects the rotation angle of the opening or closing bucket 6, and feeds back the detection result to the functional element F33 of the controller 30. The functional element F33 feeds back the calculated bucket angle $\beta_3$ to the functional element F2.

The functional element F41 basically generates the turning current command to be output to the turning control mechanism 31B, such that the difference between the command value $\alpha_{1r}$ generated by the functional element F6 and the turning angle $\alpha_1$ calculated by the functional element F43 is zero. At this time, the functional element F41 adjusts the turning current command such that the difference between a target turning spool displacement amount derived from the turning current command and the amount of displacement of the turning spool calculated by the functional element F42 is zero. The functional element F41 outputs the adjusted turning current command to the turning control mechanism 31B. Note that the difference between the command value $\alpha_{1r}$ generated by the functional element F6 and the turning angle $\alpha_1$ calculated by the functional element F43 may be limited by a limit part F50 before being input into the functional element F41.

The limit part F50 is configured to determine whether the boom 4 is raised to a predetermined height (angle), based on the boom angle $\beta_1$ calculated by the functional element F13. If the limit part F50 determines that the boom 4 is not raised to the predetermined height (angle), the limit part F50 limits the difference between the command value $\alpha_{1r}$ and the turning angle $\alpha_1$, which is a difference to be output to the functional element F41, to be equal to or less than a predetermined value. Accordingly, it is possible to prevent the upper turning body 3 from being turned when the boom 4 is not sufficiently raised.

The turning control mechanism 31B changes the opening area in accordance with the turning current command, and causes a pilot pressure commensurate with the size of the opening area to act on a pilot port of the control valve 173. The control valve 173 moves the turning spool in accordance with the pilot pressure to cause hydraulic oil to flow into the turning hydraulic motor 2A. The turning spool displacement sensor S2A detects the displacement of the turning spool, and feeds back the detection result to the functional element F42 of the controller 30. The turning hydraulic motor 2A rotates in accordance with the flow of hydraulic oil to turn the upper turning body 3. The turning angular velocity sensor S5 detects the turning angle of the upper turning body 3, and feeds back the detection result to the functional element F43 of the controller 30. The functional element F43 feeds back the calculated turning angle al to the functional element F4.

As described above, the controller 30 forms a three-stage feedback loop for each working body. That is, the controller 30 forms a feedback loop associated with the amount of displacement of a spool, a feedback loop associated with the rotation angle of a working body, and a feedback loop associated with the tip position. Therefore, the controller 30 can control the movement of the tip of the bucket 6 with high accuracy during autonomous control.

Figure 17:
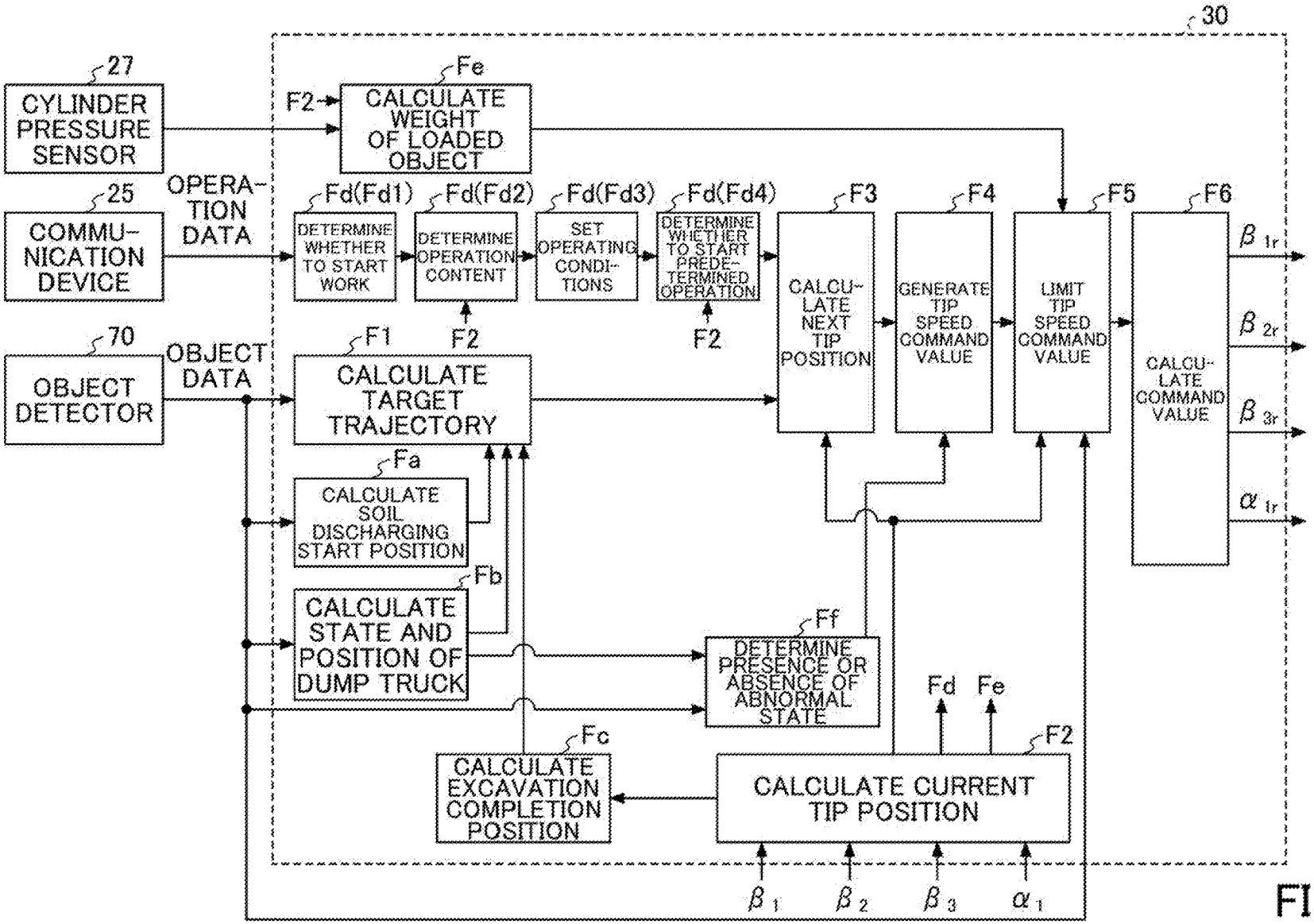
FIG. 17 is a block diagram illustrating yet another example configuration of the autonomous control function.

Next, yet another configuration example of the autonomous control function will be described with reference to FIG. 17. FIG. 17 is a block diagram illustrating yet another configuration example of the autonomous control function. The configuration illustrated in FIG. 17 differs from the configurations illustrated in FIG. 10 and FIG. 15, in that the configuration illustrated in FIG. 17 includes functional elements for unmanned automatic operation while the configurations illustrated in FIG. 10 and FIG. 15 include the functional elements for manned manual operation. Specifically, the configuration illustrated in FIG. 17 differs from the configuration illustrated in FIG. 15, in that the next tip position is calculated based on the output of a communication device 25 instead of the output of the operating pressure sensor 29, and also functional elements Fd1 through Fd4 are included. Therefore, in the following, a description of the same elements as those of FIG. 15 will not be provided, and only differences will be described.

The communication device 25 is configured to control communication between the shovel 100 and external equipment outside the shovel 100. In the present embodiment, the communication device 25 is configured to output a start command to the functional element Fd1, based on a signal received from the external equipment. The communication device 25 may be configured to output operation data to the functional element Fd1, based on a signal received from the external equipment. The communication device 25 may be an input device installed in the shovel 100.

The functional element Fd1 is configured to determine whether to start work. In the present embodiment, in response to receiving the start command from the communication device 25, the functional element Fd1 is configured to determine that the start of work is instructed, and output a start command to the functional element Fd2. In response to receiving the start command from the communication device 25, the functional element Fd1 may output a start command to the functional element Fd2 if the functional element Fd1 determines that there is no object in the vicinity of the shovel 100 based on the output of at least one of the object detector 70 and the image capturing device 80. When outputting the start command to the functional element Fd2, the functional element Fd1 may output a command to a solenoid opening/closing valve provided in a pilot line connecting the pilot pump 15 and the control valve 17 to open the pilot line.

The functional element Fd2 is configured to determine an operation content. In the present embodiment, in response to receiving the start command from the functional element Fd1, the functional element Fd2 is configured to determine whether any of an excavation operation, a boom raising and turning operation, and a soil discharging operation is currently performed or whether none of them is performed, based on the current tip position calculated by the functional element F2. If the functional element Fd2 determines that an excavation operation is completed based on the current tip position calculated by the functional element F2, the functional element Fd2 outputs a start command to the functional element Fd3.

The functional element Fd3 is configured to set operating conditions of the shovel 100. In the present embodiment, in response to receiving the start command from the functional element Fd2, the functional element Fd3 is configured to set operating conditions such as a turning speed at which a boom raising and turning operation by means of autonomous control is performed. After setting the operating conditions, the functional element Fd3 is configured to output a start command to the functional element Fd4.

The functional element Fd4 is configured to determine whether to start a predetermined operation. In the present embodiment, in response to receiving the start command from the functional element Fd3, the functional element Fd4 determines whether to start a boom raising and turning operation based on the current tip position of the bucket 6 calculated by the functional element F2. Specifically, the functional element Fd4 determines whether the boom 4 is raised and the bucket 6 is located above the ground surface (e.g., a virtual horizontal plane including the ground surface contacted by the shovel 100) by a predetermined vertical distance, based on the current tip position of the bucket 6. If it is determined that the boom 4 is raised and the bucket 6 is located above the ground surface by the predetermined vertical distance, the functional element Fd4 determines to start the boom raising and turning operation. If the functional element Fd4 determines to start the boom raising and turning operation, the functional element Fd4 causes operation data, automatically generated in the unmanned automatic operation, to be input into the functional element F3.

With the above-described configuration, the controller 30 can perform a boom raising and turning operation by means of autonomous control in a shovel for unmanned automatic operation, similar to a shovel for manned manual operation.

In the above-described embodiment, a hydraulic operating lever including a hydraulic pilot circuit is disclosed. Specifically, in a hydraulic pilot circuit associated with the left operating lever 26L serving as an arm operating lever, hydraulic oil supplied from the pilot pump 15 to a remote control valve of the left operating lever 26L is supplied to a pilot port of the control valve 176, which serves as an arm control valve, at a flow rate corresponding to the opening degree of the remote control valve 27A opened by tilting the left operating lever 26L.

However, instead of a hydraulic operating lever including such a hydraulic pilot circuit, an electric operating lever including an electric pilot circuit may be adopted. In this case, the amount of lever operation of the electric operating lever is input to the controller 30 as an electrical signal. Further, a solenoid valve is placed between the pilot pump 15 and a pilot port of each control valve. The solenoid valve is configured to operate in response to an electrical signal from the controller 30. With this configuration, when a manual operation using the electric operating lever is performed, the controller 30 can move each of the control valves by controlling the solenoid valve using an electrical signal corresponding to the amount of lever operation so as to increase or decrease a pilot pressure. Note that each of the control valves may be constituted of a solenoid spool valve. In this case, the solenoid spool valve operates in response to an electrical signal from the controller 30 corresponding to the amount of lever operation of the electrical operating lever.

Figure 18:
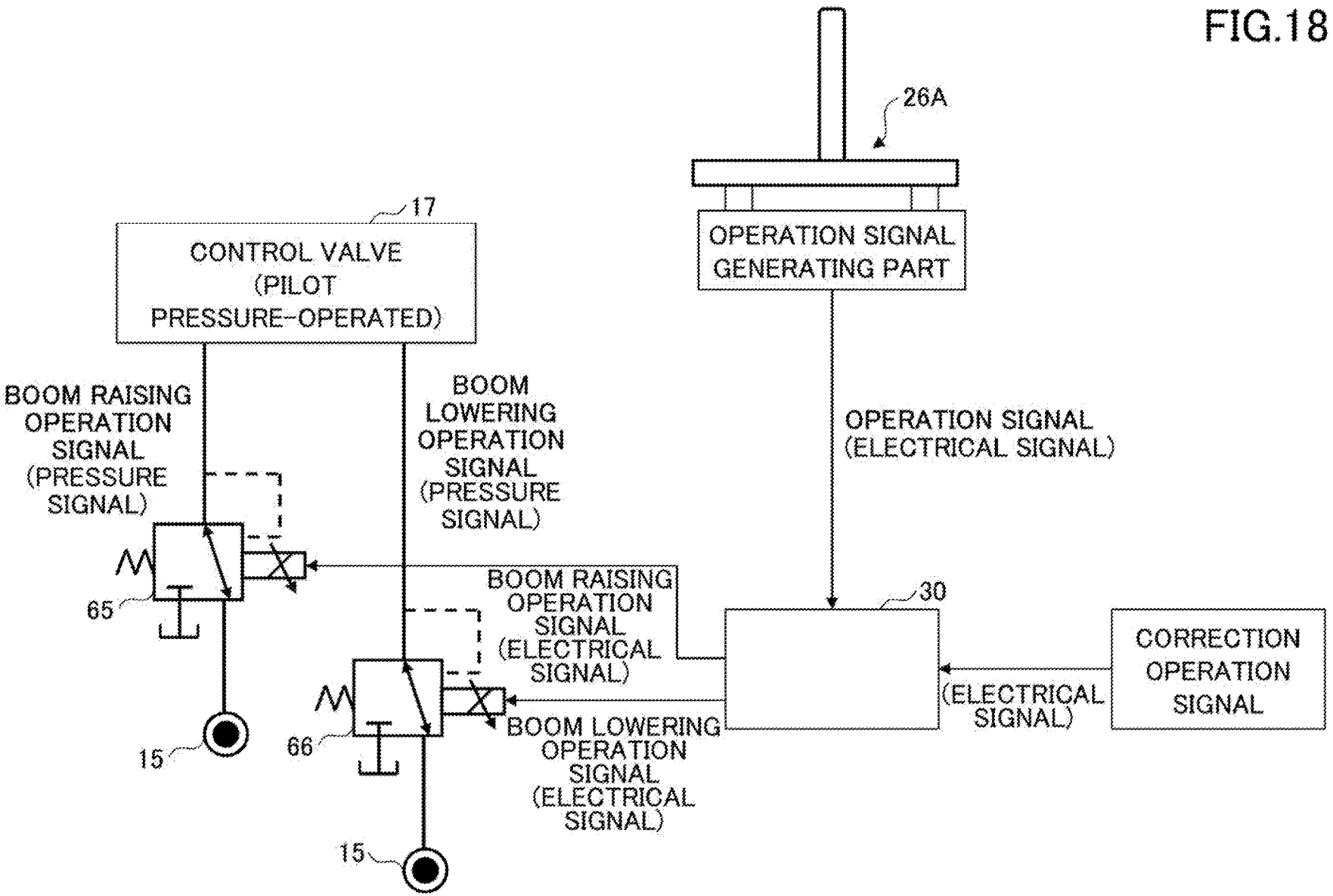
FIG. 18 is a diagram illustrating an example configuration of an electric operation system.

When an electric operation system including an electric operating lever is adopted, the controller 30 can readily perform the autonomous control function, as compared to when a hydraulic operation system including a hydraulic operating lever is adopted. FIG. 18 illustrates an example configuration of an electric operation system. Specifically, the electric operation system of FIG. 18 is an example of a boom operation system, and mainly includes the pilot pressure-operated control valve 17, the boom operating lever 26A serving as an electric operating lever, the controller 30, a solenoid valve 65 for boom raising operation, and a solenoid valve 66 for boom lowering operation. The electric operation system of FIG. 18 may be applied to an arm operation system, a bucket operation system, and the like in a similar manner.

The pilot pressure-operated control valve 17 includes the control valve 175 (see FIG. 2) pertaining to the boom cylinder 7, the control valve 176 (see FIG. 2) pertaining to the arm cylinder 8, and the control valve 174 (see FIG. 2) pertaining to the bucket cylinder 9. The solenoid valve 65 is configured to be able to adjust the flow area of a conduit connecting the pilot pump 15 and the raising-side pilot port of the control valve 175. The solenoid valve 66 is configured to be able to adjust the flow area of a conduit connecting the pilot pump 15 and the lowering-side pilot port of the control valve 175.

When a manual operation is performed, the controller 30 generates a boom raising operation signal (an electrical signal) or a boom lowering operation signal (an electrical signal) in accordance with an operation signal (electrical signal) output by an operation signal generating part of the boom operating lever 26A. The operation signal output by the operation signal generating part of the boom operating lever 26A is an electrical signal that changes in accordance with the amount of operation and the direction of operation of the boom operating lever 26A.

Specifically, when the boom operating lever 26A is operated in the boom raising direction, the controller 30 outputs a boom raising operation signal (an electrical signal) commensurate with the amount of lever operation to the solenoid valve 65. The solenoid valve 65 adjusts the flow area in accordance with the boom raising operation signal (pressure signal) to control a pilot pressure that acts on the raising-side pilot port of the control valve 175. Similarly, when the boom operating lever 26A is operated in the boom lowering direction, the controller 30 outputs a boom lowering operation signal (an electrical signal) commensurate with the amount of lever operation to the solenoid valve 66. The solenoid valve 66 adjusts the flow area in accordance with the boom lowering operation signal (pressure signal) to control a pilot pressure that acts on the lowering-side pilot port of the control valve 175.

When automatic control is performed, for example, the controller 30 generates a boom raising operation signal (an electrical signal) or a boom lowering operation signal (an electrical signal) in accordance with a correction operation signal (an electrical signal) instead of the operation signal output by the operation signal generating part of the boom operating lever 26A. The correction operation signal may be an electrical signal generated by the controller 30, or may be an electrical signal generated by an external control unit other than the controller 30.

Figure 19:
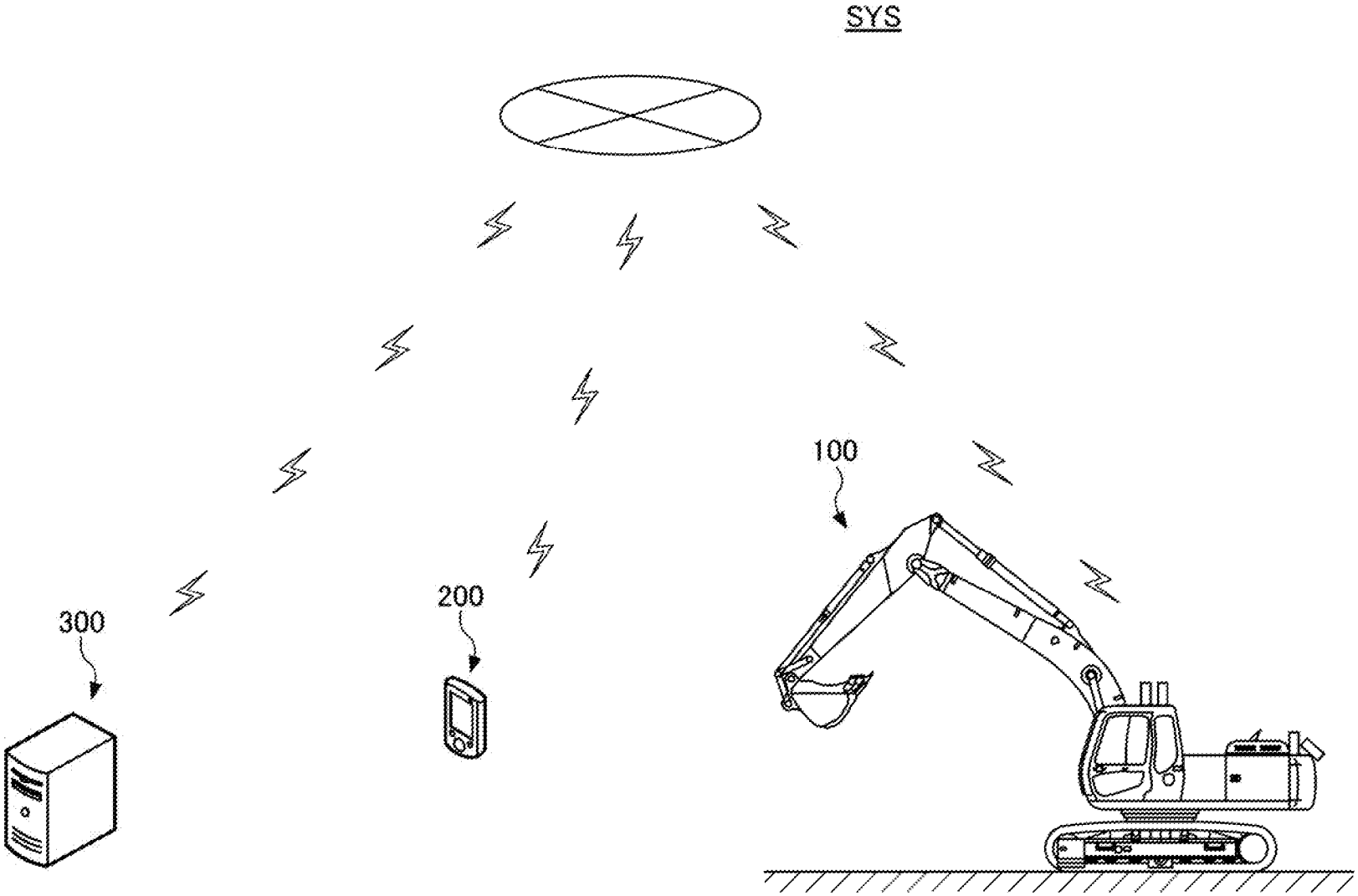
FIG. 19 is a schematic diagram illustrating an example configuration of a shovel management system.

Further, information acquired by the shovel 100 may be shared with a manager and other shovel operators through a shovel management system SYS as illustrated in FIG. 19. FIG. 19 is a schematic diagram illustrating an example configuration of the shovel management system SYS. The management system SYS is a system that manages one or more shovels 100. In the present embodiment, the management system SYS is mainly configured by a shovel 100, an assist device 200, and a management apparatus 300. The management system SYS may include one or more shovels 100, one or more assist devices 200, and one or more management apparatuses 300. In the example illustrated in FIG. 19, the management system SYS includes the one shovel 100, the one assist device 200, and the one management apparatus 300.

The assist device 200 is typically a portable terminal device, and may be, for example, a computer carried by a worker or the like at a construction site, such as a notebook personal computer (PC), a tablet PC, or a smartphone. The assist device 200 may be a computer carried by the operator of the shovel 100. Alternatively, the assist device 200 may be a stationary terminal apparatus.

The management apparatus 300 is typically a stationary terminal apparatus, and may be, for example, a server computer installed in a management center or the like outside a construction site. The management apparatus 300 may be a portable computer (for example, a portable terminal device such as a notebook PC, a tablet PC, or a smartphone).

At least one of the assist device 200 and the management apparatus 300 (hereinafter referred to as the "assist device 200 or the like") may include a monitor and a remote operation device. In this case, the operator operates the shovel 100 while using the remote operation device. The remote operation device is connected to the controller 30 via a communication network such as a wireless communication network. In the following, communication of information between the shovel 100 and the management apparatus 300 will be described. However, the following description is applied to communication of information between the shovel 100 and the assist device 200.

In the above-described shovel management system SYS, the controller 30 of the shovel 100 may transmit information related to at least one of the time and location at which autonomous control is started or stopped, a target trajectory used during the autonomous control, and a trajectory actually followed by a predetermined part during the autonomous control to the management apparatus 300. At this time, the controller 30 may transmit at least one of the output of the object detector 70 and an image captured by the image capturing device 80 to the management apparatus 300. The image may include a plurality of images captured during a predetermined period of time including a period of time in which the autonomous control is performed. Further, the controller 30 may transmit information related to at least one of data on work details of the shovel 100 during the predetermined period of time including the period of time in which the autonomous control is performed, data on the orientation of the shovel 100, and data on the orientation of the excavation attachment to the management apparatus 300. Accordingly, a manager using the management apparatus 300 can readily acquire information on a work site. The data on work details of the shovel 100 includes at least one of the number of times a soil discharging operation is performed, information on an object such as soil loaded into the bed of the dump truck 60, the type of the dump truck 60 for loading work, information on the position of the shovel 100 when loading work is performed, and information on the operation of the shovel 100 when loading work is performed. The information on an object includes at least one of the weight and the type of an object each time a soil discharging operation is performed, the weight and the type of an object loaded into each dump truck 60, and the weight and the type of an object loaded in loading work of a day. Information on a work environment may be information on the inclination of the ground surface in the vicinity of the shovel 100 or information on the weather in the vicinity of a work site. The information on the operation of the shovel 100 includes at least one of a pilot pressure and the pressure of hydraulic oil in a hydraulic actuator.

As described, according to the embodiment of the present information, the management system SYS of the shovel 100 allows information related to the shovel 100, acquired during a predetermined period of time including a period of time in which autonomous control is performed, to be shared with a manager and other shovel operators.

What is claimed is:

1. A shovel comprising:

a lower traveling body;

an upper turning body turnably mounted on the lower traveling body;

an attachment attached to the upper turning body, the attachment including an end attachment;

a surroundings monitoring device attached to the upper turning body and configured to monitor an object; and a hardware processor configured to calculate an excavation completion position and a soil discharging start position, calculate a trajectory along which to move the end attachment from the calculated excavation completion position to the calculated soil discharging start position during a boom raising and turning operation, detect a change in a state of a movable part of the object based on an output of the surroundings monitoring device, autonomously change the calculated trajectory when the movable part of the object is predicted to be in the calculated trajectory as a result of the change in the state of the movable part of the object, and autonomously move the end attachment along the changed trajectory, wherein the object is a dump truck, and the hardware processor is configured to detect a state of soil loaded onto a bed of the dump truck based on the output of the surroundings monitoring device and calculate the soil discharging start position based on the detected state of the soil, before a start of a soil discharging operation.

2. The shovel according to claim 1, wherein the hardware processor is configured to perform control that avoids contact with the object.

3. The shovel according to claim 1, wherein the hardware processor is configured to set a prohibited area for the dump truck based on the output of the surroundings monitoring device, the prohibited area being a three-dimensional space whose outline is a similar extension of an outline of the dump truck.

4. The shovel according to claim 1, wherein the dump truck includes the bed, a gate openably and closably attached to the bed, and a cover openably and closably attached to the gate, and the hardware processor is configured to three-dimensionally identify the state of the movable part, the movable part including the bed, the gate, and the cover.

5. The shovel according to claim 4, wherein the hardware processor is further configured to three-dimensionally identify a pillar located at a back end of the bed of the dump truck.

6. The shovel according to claim 4, wherein the state of the bed includes inclination of the dump truck.

7. The shovel according to claim 1, wherein the hardware processor is configured to identify a front panel of the dump truck.

8. The shovel according to claim 3, wherein the hardware processor is configured to correct the prohibited area in accordance with the change in the state of the movable part.

9. The shovel according to claim 3, wherein the hardware processor is configured to set the prohibited area larger than the bed of the dump truck.

10. The shovel according to claim 3, wherein the hardware processor is configured to set a boundary surface of the prohibited area at a position a predetermined distance away from a front panel of the dump truck toward a back of the dump truck.

11. The shovel according to claim 3, wherein the hardware processor is configured to set a boundary surface of the prohibited area at a position higher than an inner bottom surface of the bed of the dump truck by a predetermined distance.

12. The shovel according to claim 1, wherein the hardware processor is configured to compare a three-dimensional shape of the dump truck with a prestored three-dimensional model of the dump truck, determine the state of the movable part based on a result of said comparing, and calculate or change the trajectory based on the determined state of the movable part.

13. The shovel according to claim 1, wherein the hardware processor is configured to limit a speed of a working portion of the shovel by a predetermined upper limit value when a distance between the working portion and the dump truck is less than a predetermined value.

14. The shovel according to claim 1, wherein the change in the state of the movable part includes opening and closing of the movable part and an upward movement and a downward movement of the movable part.

15. The shovel according to claim 1, wherein the hardware processor is configured to predict, in response to determining that the end attachment reaches a predetermined position, a future trajectory of the end attachment from the predetermined position based on the calculated trajectory up to the predetermined position, and autonomously change the calculated trajectory in response to determining that if the end attachment continues to move along the calculated trajectory, the end attachment enters a predetermined area set for the object.

16. The shovel according to claim 1, wherein the hardware processor is configured to correct the soil discharging start position in accordance with a direction of movement and an amount of movement of the dump truck, in response to detecting a movement of the dump truck less than a predetermined allowable distance based on the output of the surroundings monitoring device, and calculate the trajectory again based on the corrected soil discharging start position.

* * * * *